US009979112B2

(12) United States Patent
Kato et al.

(10) Patent No.: US 9,979,112 B2
(45) Date of Patent: May 22, 2018

(54) PRESS-TYPE CONNECTOR

(71) Applicant: ACES ELECTRONICS CO., LTD., Zhongli, Taoyuan County (TW)

(72) Inventors: Nobukazu Kato, Fussa (JP); Chien-Feng Huang, Zhongli (TW); Hiroaki Hashimoto, Sagamihara Kanagawa (JP)

(73) Assignee: ACES ELECTRONICS CO., LTD., Zhongli, Taoyuan County (TW)

( * ) Notice: Subject to any disclaimer, the term of this patent is extended or adjusted under 35 U.S.C. 154(b) by 0 days. days.

(21) Appl. No.: 15/464,915

(22) Filed: Mar. 21, 2017

(65) Prior Publication Data

US 2017/0288332 A1 Oct. 5, 2017

(30) Foreign Application Priority Data

Mar. 29, 2016 (JP) ..... 2016-065664
Nov. 7, 2016 (JP) ..... 2016-216973

(51) Int. Cl.
*H01R 13/24* (2006.01)

(52) U.S. Cl.
CPC ..... *H01R 13/2428* (2013.01)

(58) Field of Classification Search
CPC ..... H01R 13/2428; H01R 13/2421; H01R 33/46; H01R 23/722; H01R 2201/20
USPC ..... 439/700, 357, 358
See application file for complete search history.

(56) References Cited

U.S. PATENT DOCUMENTS 5,649,840 A * 7/1997 Muto ..... H01R 24/58 439/668
5,904,597 A * 5/1999 Doi ..... H01R 13/2442 439/660
6,048,228 A * 4/2000 Aso ..... H01R 13/2428 439/660
6,159,055 A * 12/2000 Satitpunwaycha . H01L 21/6833 439/700
6,312,295 B2 * 11/2001 Nishimatsu ..... H01R 13/2428 439/660
6,396,294 B2 * 5/2002 An ..... G01R 1/0466 324/72.5
6,866,519 B2 * 3/2005 Fan ..... H01R 13/2421 439/66

(Continued)

FOREIGN PATENT DOCUMENTS

JP 2006173473 A 6/2006
JP 2016-186839 A 10/2016

*Primary Examiner* — Abdullah Riyami
*Assistant Examiner* — Vladimir Imas
(74) *Attorney, Agent, or Firm* — Chiesa Shahinian & Giantomasi PC

(57) ABSTRACT

A connector includes a first connector and a second connector mounted on an external device. The first connector includes a contact including a contact portion electrically connected to a connection terminal of the second connector by pressing the connection terminal in a predetermined direction; a flexible conductor connected to the contact; a protection member that protects the contact portion by covering a periphery of the contact; a base body that accommodates the contact, the flexible conductor, and the protection member; and an elastic member that is formed separately from the contact and presses the contact and the protection member in a direction opposite to the predetermined direction.

19 Claims, 60 Drawing Sheets

(56) References Cited

U.S. PATENT DOCUMENTS

| | | | | |
|---|---|---|---|---|
| 6,902,416 | B2 * | 6/2005 | Feldman | G01R 1/06772 324/755.01 |
| 7,040,935 | B2 * | 5/2006 | Wei | H01R 13/2428 439/700 |
| 7,270,558 | B1 * | 9/2007 | Chiang | H01R 13/2428 439/289 |
| 7,320,614 | B2 * | 1/2008 | Toda | H01R 23/6873 439/217 |
| 7,322,834 | B2 * | 1/2008 | Hu | H01R 13/2428 439/700 |
| 7,335,068 | B2 * | 2/2008 | Dwan | H01R 13/2428 439/570 |
| 7,585,192 | B1 * | 9/2009 | Lai | H01R 12/57 439/700 |
| 7,740,508 | B2 * | 6/2010 | Feldman | G01R 31/2889 324/755.02 |
| 8,784,145 | B2 * | 7/2014 | Koyama | H01R 13/2464 439/500 |
| 9,130,328 | B1 * | 9/2015 | Huang | H01R 13/2421 |
| 9,461,391 | B2 | 10/2016 | Kato | |
| 9,543,722 | B2 | 1/2017 | Kato et al. | |
| 9,774,124 | B2 * | 9/2017 | Kato | H01R 13/4538 |
| 2008/0146060 | A1 * | 6/2008 | Kato | H01R 13/193 439/171 |
| 2015/0311619 | A1 | 10/2015 | Kato | |
| 2016/0036176 | A1 | 2/2016 | Kato et al. | |
| 2016/0172776 | A1 | 6/2016 | Kato et al. | |

* cited by examiner

PRESS-TYPE CONNECTOR

CROSS-REFERENCE TO RELATED APPLICATIONS

The disclosures of the following priority applications are incorporated herein by reference: Japanese Patent Application No. 2016-065664 filed on Mar. 29, 2016; and Japanese Patent Application No. 2016-216973 filed on Nov. 7, 2016.

BACKGROUND OF THE INVENTION

The present invention relates to a connector to be connected to a connection terminal of an external device.

Conventionally, there is known a cradle for a portable information terminal including a connector having a spring terminal (for example, refer to Patent Literature 1). According to this cradle for a portable information terminal, when the portable information terminal is mounted on the cradle, a connection terminal of the portable information terminal is pressed against the spring terminal, whereby the portable information terminal and the connector are electrically connected.

CITATION LIST

Patent Literature 1: JP 2006-173473 A

SUMMARY OF THE INVENTION

The cradle for a portable information terminal described above includes a spring charging terminal and a spring signal terminal. That is, a contact portion for conducting with the connection terminal of the portable information terminal and a spring portion for pressing the contact portion against the connection terminal of the portable information terminal are integrated. In recent years, high-speed charging or high-speed transmission has been required for charging or data communication; however, there is a problem that the structure of a terminal in which the contact portion and the spring portion are integrated is complicated, and is not suitable for high-speed charging or high-speed transmission. There is another problem that the size and shape of the terminal as well as the size and shape of the connector are heavily restricted in the terminal in which the contact portion and the spring portion are integrated, thus lowering the design freedom.

An object of the present invention is to provide a connector suitable for high-speed transmission, and to provide a connector that is compact and can increase the design freedom.

A connector according to an embodiment of the present invention includes: a first connector; and a second connector mounted on an external device, wherein the first connector includes: a contact including a contact portion that is electrically connected to a connection terminal of the second connector by pressing the connection terminal in a predetermined direction; a flexible conductor connected to the contact; a protection member that protects the contact portion by covering a periphery of the contact; a base body that accommodates the contact, the flexible conductor, and the protection member; and an elastic member that is formed separately from the contact and presses the contact and the protection member in a direction opposite to the predetermined direction, the base body includes a first opening through which the protection member protrudes in the direction opposite to the predetermined direction, the protection member includes a second opening through which the contact portion protrudes toward the second connector farther than a pressing surface against which the connection terminal of the second connector is pressed, the protection member being movable in the predetermined direction and in the direction opposite to the predetermined direction along with movement of the second connector, and before the second connector comes in contact with the contact portion or the protection member, the contact portion is located at a position protruding toward the second connector through the second opening, and in a final coupled state with the second connector, the contact portion is located substantially on the same plane as the pressing surface.

A connector according to an embodiment of the present invention includes: a first connector; and a second connector mounted on an external device, wherein the first connector includes: a first contact including a first contact portion that is electrically connected to a first connection terminal of the second connector by pressing the first connection terminal in a predetermined direction; a second contact including a second contact portion that is electrically connected to a second connection terminal of the second connector by pressing the second connection terminal in the predetermined direction; a wiring member including a conductor electrically connected to the first contact and a grounding conductor connected to the ground; a base body that accommodates the first contact, the second contact, and the wiring member; a first elastic member that is formed separately from the first contact and presses the first contact in a direction opposite to the predetermined direction; and a second elastic member that is formed separately from the second contact and presses the second contact in the direction opposite to the predetermined direction, the second contact and the grounding conductor are electrically connected, the first contact portion and the second contact portion are protrudable from the base body toward the second connector farther than a pressing surface against which the first connection terminal and the second connection terminal are pressed, and before the second connector comes in contact with the first contact portion or the second contact portion, the first contact portion and the second contact portion are located at positions protruding toward the second connector farther than the pressing surface, and in a final coupled state with the second connector, the first contact portion and the second contact portion are located substantially on the same plane as the pressing surface.

A connector according to an embodiment of the present invention includes: a first connector; and a second connector mounted on an external device, wherein the first connector includes: a first contact including a first contact portion that is electrically connected to a first connection terminal of the second connector by pressing the first connection terminal in a predetermined direction; a second contact including a second contact portion that is electrically connected to a second connection terminal of the second connector by pressing the second connection terminal in the predetermined direction; a wiring member including a conductor electrically connected to the first contact and a grounding conductor connected to the ground; a protection member that protects the first contact portion and the second contact portion by covering peripheries of the first contact and the second contact; a base body that accommodates the first contact, the second contact, the wiring member, and the protection member; a first elastic member that is formed separately from the first contact and presses the first contact and the protection member in a direction opposite to the predetermined direction; and a second elastic member that is formed separately from the second contact and presses the second contact and the protection member in the direction opposite to the predetermined direction, the second contact and the grounding conductor are electrically connected, the base body includes a first opening through which the protection member protrudes in the direction opposite to the predetermined direction, the protection member includes a second opening through which the first contact portion protrudes toward the second connector farther than a pressing surface against which the first connection terminal and the second connection terminal of the second connector are pressed, and a third opening through which the second contact portion protrudes toward the second connector farther than the pressing surface, the protection member being movable in the predetermined direction and in the direction opposite to the predetermined direction along with movement of the second connector, before the second connector comes in contact with the first contact portion, the second contact portion, or the protection member, the first contact portion and the second contact portion are located at positions protruding toward the second connector through the second opening and the third opening respectively, and in a final coupled state with the second connector, the first contact portion and the second contact portion are located substantially on the same plane as the pressing surface.

In the connector according to an embodiment of the present invention, impedance between the conductor and the grounding conductor is matched.

In the connector according to an embodiment of the present invention, impedance between the first contact and the second contact is matched.

In the connector according to an embodiment of the present invention, the grounding conductor includes a first grounding conductor covering the conductor via an insulator and a second grounding conductor electrically connected to the second contact, and the first grounding conductor and the second grounding conductor are electrically connected using a connection member.

In the connector according to an embodiment of the present invention, the connection member includes a grounding connection member and a ground terminal disposed in the vicinity of the first contact, the second contact includes an elastic body, the ground terminal is electrically connected to the first grounding conductor, and the ground terminal and the second contact are electrically connected by being pressed against the grounding connection member.

In the connector according to an embodiment of the present invention, the connection member includes a grounding connection member and a ground terminal disposed in the vicinity of the first contact, the grounding connection member includes an elastic body, the ground terminal is electrically connected to the first grounding conductor, and the ground terminal and the second contact are electrically connected by being pressed against the grounding connection member.

In the connector according to an embodiment of the present invention, the connection member includes: a first fixing portion that fixes the first grounding conductor; a second fixing portion that fixes the second grounding conductor; and a flexible portion disposed between the first fixing portion and the second fixing portion and having flexibility.

In the connector according to an embodiment of the present invention, the first contact has the same shape as a part of the second contact including the second contact portion, and the ground terminal has the same shape as a part of the second contact including a part connected to the grounding connection member.

In the connector according to an embodiment of the present invention, the connection member includes a grounding connection member and a ground terminal disposed in the vicinity of the first contact, the ground terminal is electrically connected to the first grounding conductor, the grounding connection member is disposed between the ground terminal and the first elastic member and between the second contact and the second elastic member, and the grounding connection member is pressed against the ground terminal by an elastic force of the first elastic member and the grounding connection member is pressed against the second contact by an elastic force of the second elastic member, and consequently the ground terminal and the second contact are electrically connected.

In the connector according to an embodiment of the present invention, the wiring member is a flexible flat cable or a flexible printed circuit, and a slit is provided between the conductors of the wiring member on a side connected to the first contact and the second contact along a longitudinal direction of the wiring member.

In the connector according to an embodiment of the present invention, the first contact includes a first pressing portion that presses the wiring member against the first contact or a first member that holds the first contact, and the first contact and the conductor are electrically connected when the first pressing portion presses the conductor against the first contact or the first member.

In the connector according to an embodiment of the present invention, the second contact includes a second pressing portion that presses the wiring member against the second contact or a second member that holds the second contact, and the second contact and the grounding conductor are electrically connected when the second pressing portion presses the grounding conductor against the second contact or the second member.

In the connector according to an embodiment of the present invention, the base body is disposed around the pressing surface of the protection member, and includes an outer edge portion that protrudes toward the second connector farther than the pressing surface of the protection member, the first contact portion, and the second contact portion.

In the connector according to an embodiment of the present invention, when the first connector and the second connector are connected, the outer edge portion is inserted into an insertion portion formed in a casing of the external device before the first contact portion and the second contact portion of the first connector are connected to the first connection terminal and the second connection terminal of the second connector respectively.

In the connector according to an embodiment of the present invention, the grounding conductor includes two or three layers.

In the connector according to an embodiment of the present invention, the grounding conductor is electrically connected to the first elastic member and the second elastic member, and the first elastic member and the second elastic member are electrically connected.

In the connector according to an embodiment of the present invention, at least two each of the first contacts and the second contacts are provided, the two first contacts are disposed adjacent to each other, the two second contacts are disposed with the two first contacts interposed therebetween, and the second contact is wider than the first contact in a plane intersecting an arrangement direction in which the two first contacts and the two second contacts are arranged in a row.

The connector according to an embodiment of the present invention includes a metal plate disposed in the vicinity of the first contact and the second contact, and the metal plate is electrically connected to the grounding conductor.

In the connector according to an embodiment of the present invention, the metal plate is electrically connected to the grounding conductor via at least one of the first elastic member and the second elastic member.

The connector according to an embodiment of the present invention further includes at least two contact groups, in each of which the two first contacts disposed adjacent to each other, and the two second contacts disposed with the two first contacts interposed therebetween, are arranged in a row, one of the contact groups and the other contact group are arranged in a direction intersecting an arrangement direction in which the two first contacts and the two second contacts are arranged in a row, and the metal plate is disposed between one of the contact groups and the other contact group, one surface of the metal plate facing one of the contact groups, the other surface of the metal plate facing the other contact group.

In the connector according to an embodiment of the present invention, the metal plate is fixed to the base body, the protection member includes a through hole in which the metal plate is disposed and through which the metal plate protrudes in the direction opposite to the predetermined direction, and in the final coupled state with the second connector, the metal plate protrudes in the direction opposite to the predetermined direction through the through hole.

In the connector according to an embodiment of the present invention, the metal plate is connected to a grounding terminal of the second connector.

The connector according to an embodiment of the present invention includes the two metal plates, one of the metal plates is disposed on the protection member, the other metal plate is disposed on the base body, and the two metal plates are electrically connected to each other.

A connector according to an embodiment of the present invention includes: a first connector; and a second connector mounted on an external device, wherein the second connector includes: a first connection terminal that is electrically connected to a first contact portion of a first contact of the first connector by being pressed against the first contact portion; a second connection terminal that is electrically connected to a second contact portion of a second contact of the first connector by being pressed against the second contact portion; and a ground plate electrically connected to the second connection terminal.

In the connector according to an embodiment of the present invention, impedance between the first connection terminal and the ground plate is matched.

In the connector according to an embodiment of the present invention, impedance between the first connection terminal and the second connection terminal is matched.

The connector according to an embodiment of the present invention includes at least two each of the first connection terminals and the second connection terminals, the two first connection terminals are disposed adjacent to each other, the two second connection terminals are disposed with the two first connection terminals interposed therebetween, and the ground plate is disposed in a plane along an arrangement direction in which the two first connection terminals and the two second connection terminals are arranged in a row.

In the connector according to an embodiment of the present invention, the ground plate includes a first ground plate and a second ground plate, and the first connection terminal and the second connection terminal are disposed between the first ground plate and the second ground plate.

In the connector according to an embodiment of the present invention, the second connection terminal is wider than the first connection terminal in a plane intersecting the arrangement direction.

According to an embodiment the present invention, it is possible to provide a connector suitable for high-speed transmission, and to provide a connector that is compact and can increase the design freedom.

DETAILED DESCRIPTION OF EMBODIMENTS

Figure 1:
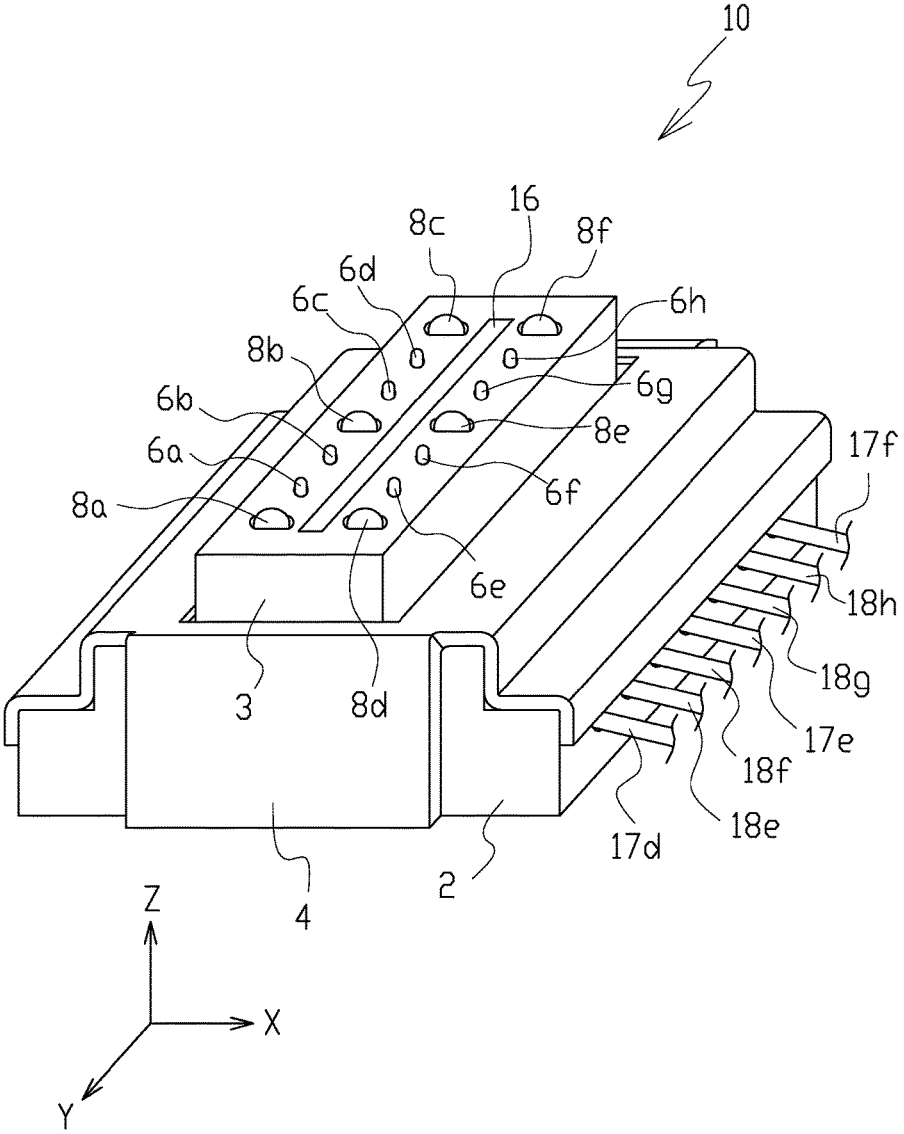
FIG. 1 is a perspective view showing an external appearance of a connector according to a first embodiment.

Hereinafter, a press-type connector will be described as an example with reference to the drawings. The press-type connector is electrically connected to a connection terminal of an external device such as a portable information terminal by pressing the connection terminal of the external device in a predetermined direction. FIG. 1 is a perspective view showing an external appearance of a connector according to a first embodiment. As shown in FIG. 1, the connector 10 according to the first embodiment includes a base body 2, a protection member 3, a shell 4, contacts 6*a*, 6*b*, 6*c*, 6*d*, 6*e*, 6*f*, 6*g* and 6*h*, and ground contacts 8*a*, 8*b*, 8*c*, 8*d*, 8*e* and 8*f*.

In the following description, the XYZ orthogonal coordinate system shown in FIG. 1 is set, and the positional relationship and the like of each member will be described with reference to this orthogonal coordinate system. The Y axis is set to be parallel to a direction in which the ground contact 8*a*, the contacts 6*a* and 6*b*, the ground contact 8*b*, the contacts 6*c* and 6*d*, and the ground contact 8*c* are arranged. The Z axis is set to be parallel to a direction in which an external device 100 (see FIG. 6) is pressed against the connector 10. The X axis is set in a direction orthogonal to the YZ plane. The respective directions are set as follows: the side of a second contact group 9*b* (see FIG. 4) is in the +X direction; the side of a first contact group 9*a* (see FIG. 4) is in the −X direction; the side of the ground contacts 8*a* and 8*d* is in the +Y direction; the side of the ground contact 8*c* and 8*f* is in the −Y direction; the direction in which the external device 100 is pressed against the connector 10 is set to the −Z direction; and the direction in which the external device 100 is separated from the connector 10 is set to the +Z direction.

Figure 2:
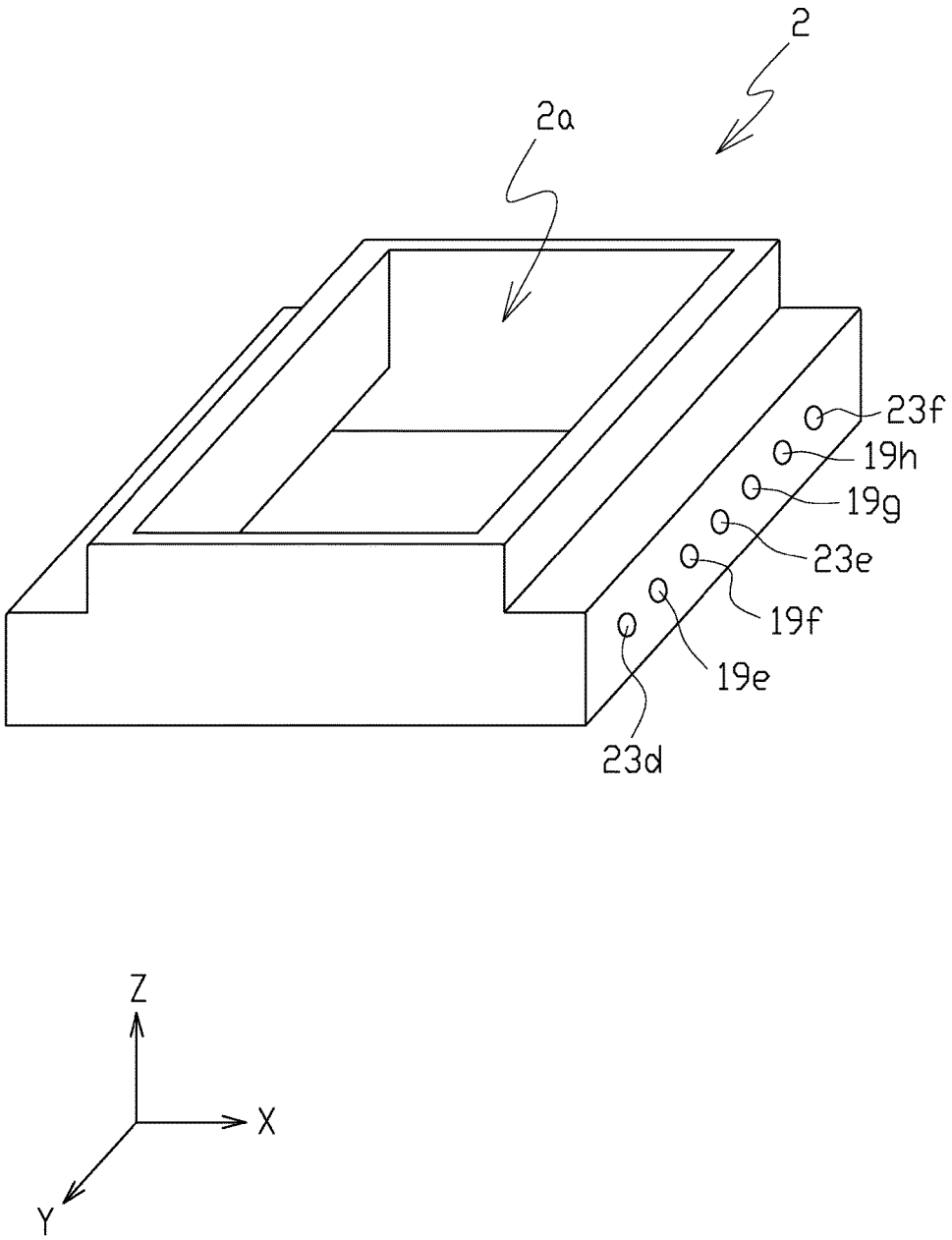
FIG. 2 is a view showing a configuration of a base body according to the first embodiment.

The base body 2 includes an insulative member, for example, resin, and accommodates the protection member 3 that accommodates the contacts 6*a* to 6*h* and the ground contacts 8*a* to 8*f*, as shown in FIG. 1. FIG. 2 is a view showing a configuration of the base body 2. As shown in FIG. 2, a rectangular first opening 2*a*, through which the protection member 3 protrudes in the +Z direction, is formed in the upper surface (+Z direction side) of the base body 2. As shown in FIG. 1, the protection member 3 is disposed in the first opening 2*a* while protruding from the upper surface of the base body 2.

In addition, insertion holes 23*d*, 19*e*, 19*f*, 23*e*, 19*g*, 19*h* and 23*f* are formed in a row along the Y direction in a surface at a lower part on the right side (+X direction side) of the base body 2. The insertion holes 19*e* to 19*h* are holes for inserting coaxial cables 18*e* to 18*h*, respectively (see FIG. 1). The insertion holes 23*d* to 23*f* are holes for inserting grounding coaxial cables 17*d* to 17*f*, respectively (see FIG. 1). Similarly, seven insertion holes (not shown) are formed in a row along the Y direction in a surface at a lower part on the left side (−X direction side) of the base body 2. Four of the seven insertion holes are holes for inserting a coaxial cable 18*a* (see FIG. 5) and three other coaxial cables (not shown). The other three insertion holes are holes for inserting a grounding coaxial cable 17*a* (see FIG. 10) and two other grounding coaxial cables (not shown).

Figure 3:
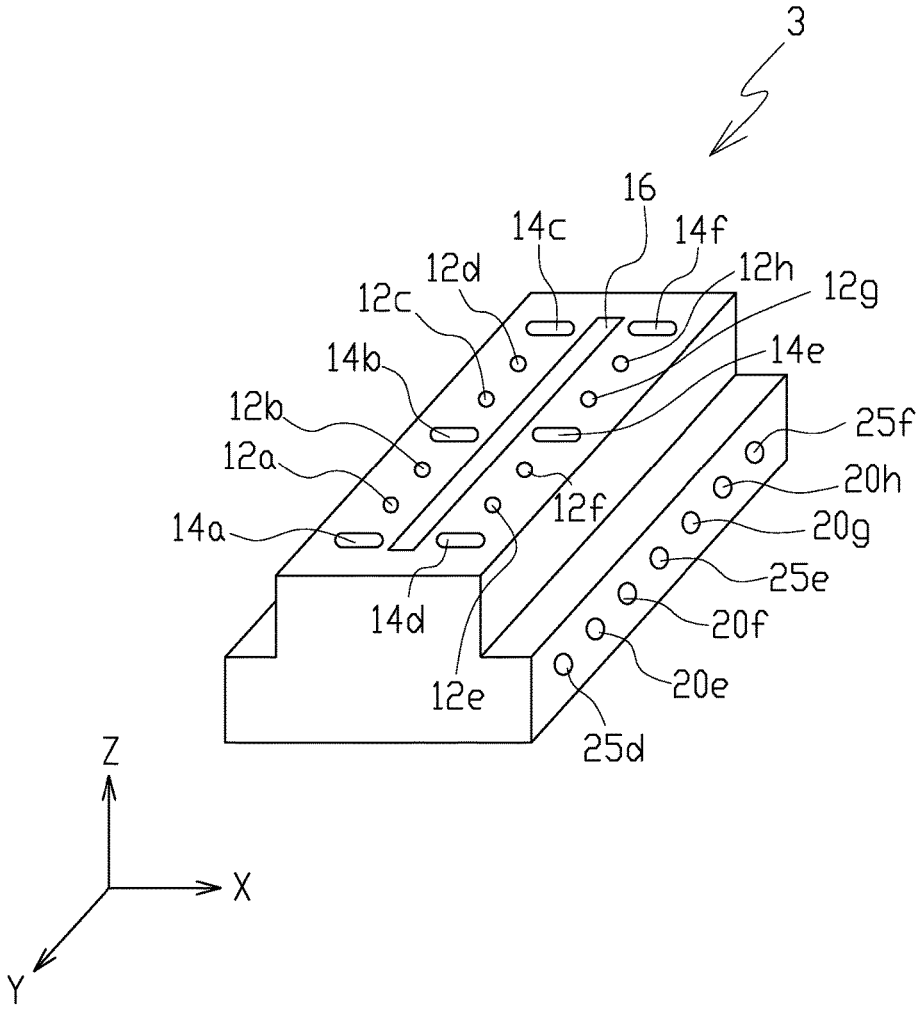
FIG. 3 is a view showing a configuration of a protection member according to the first embodiment.

The protection member 3 includes an insulative member, for example, resin. By covering the contacts 6*a* to 6*h* and the ground contacts 8*a* to 8*f* from the +Z direction side, the protection member 3 protects contact portions 5*a* to 5*h* (see FIG. 4) of the contacts 6*a* to 6*h* and ground contact portions 7*a* to 7*f* (see FIG. 4) of the ground contacts 8*a* to 8*f*. The protection member 3 is configured to be movable in the Z direction. FIG. 3 is a view showing a configuration of the protection member 3. As shown in FIG. 3, eight circular second openings 12*a* to 12*h*, six elliptical third openings 14*a* to 14*f*, and an elongated rectangular through hole 16 are formed in the upper surface (+Z direction side) of the protection member 3. The third opening 14*a*, the second openings 12*a* and 12*b*, the third opening 14*b*, the second openings 12*c* and 12*d*, and the third opening 14*c* are formed in a row along the Y direction on the −X direction side. In addition, the third opening 14*d*, the second openings 12*e* and 12*f*, the third opening 14*e*, the second openings 12*g* and 12*h*, and the third opening 14*f* are formed in a row along the Y direction on the +X direction side. The contact portions 5*a* to 5*h* of the contacts 6*a* to 6*h* protrude in the +Z direction through the second openings 12*a* to 12*h*, respectively. The ground contact portions 7*a* to 7*f* of the ground contacts 8*a* to 8*f* protrude in the +Z direction through the third openings 14*a* to 14*f*, respectively.

Figure 5:
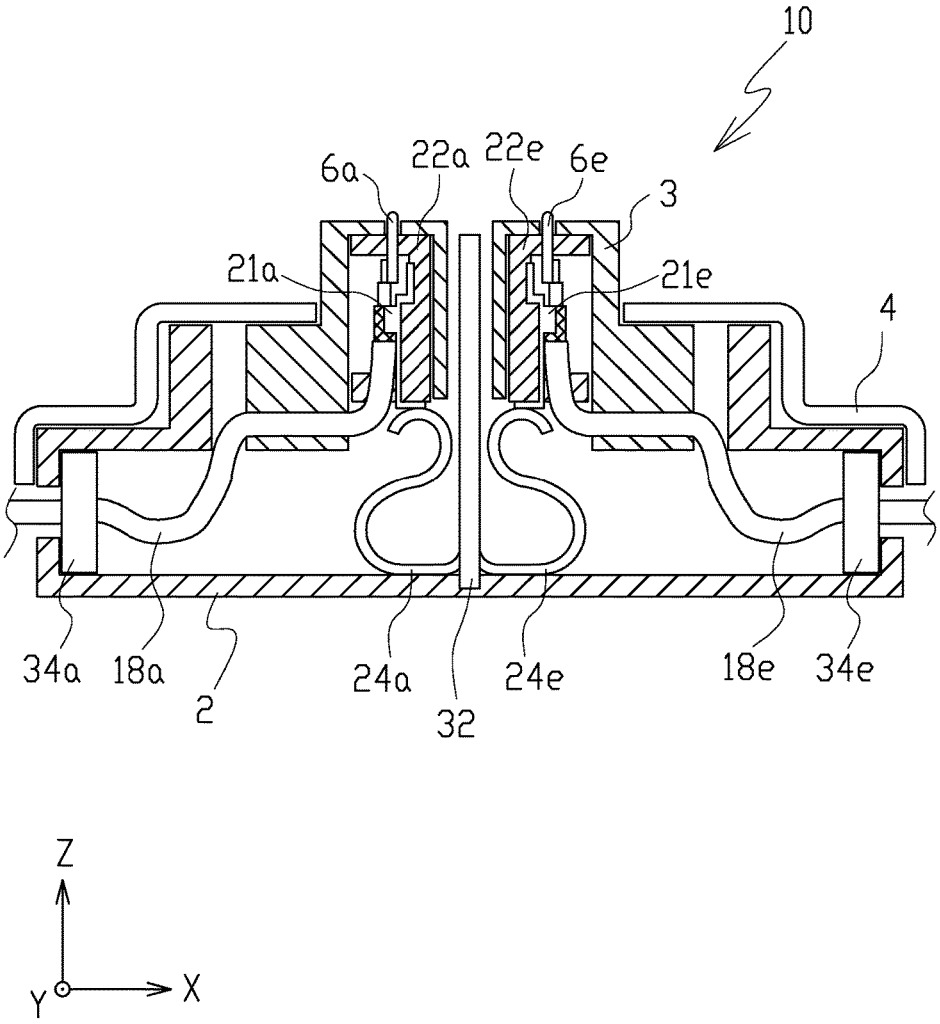
FIG. 5 is a view showing a cross section of the connector according to the first embodiment.

The through hole 16 is an elongated rectangular hole extending in the Y direction between the second openings 12*a* to 12*d* and the second openings 12*e* to 12*h*, and formed from the upper surface (+Z direction side) toward the lower surface (−Z direction side) of the protection member 3 (see FIG. 5). A metal plate 32 (see FIG. 5) described later is disposed in the through hole 16. When the protection member 3 moves in the −Z direction, the metal plate 32 protrudes in the +Z direction from the through hole 16.

In addition, insertion holes 25*d*, 20*e*, 20*f*, 25*e*, 20*g*, 20*h* and 25*f* are formed in a row along the Y direction in a surface at a lower part on the right side (+X direction side) of the protection member 3. The insertion holes 20*e* to 20*h* are holes for inserting the coaxial cables 18*e* to 18*h*, respectively. The insertion holes 25*d* to 25*f* are holes for inserting the grounding coaxial cables 17*d* to 17*f*, respectively. Similarly, seven insertion holes (not shown) are formed in a row along the Y direction in a surface at a lower part on the left side (−X direction side) of the protection member 3. Four of the seven insertion holes are holes for inserting the coaxial cable 18*a* (see FIG. 5) and three other coaxial cables (not shown). The other three insertion holes are holes for inserting the grounding coaxial cable 17*a* (see FIG. 10) and two other grounding coaxial cables (not shown). The shell 4 includes a conductive member, for example, metal, and covers the base body 2 as shown in FIG. 1.

Figure 4:
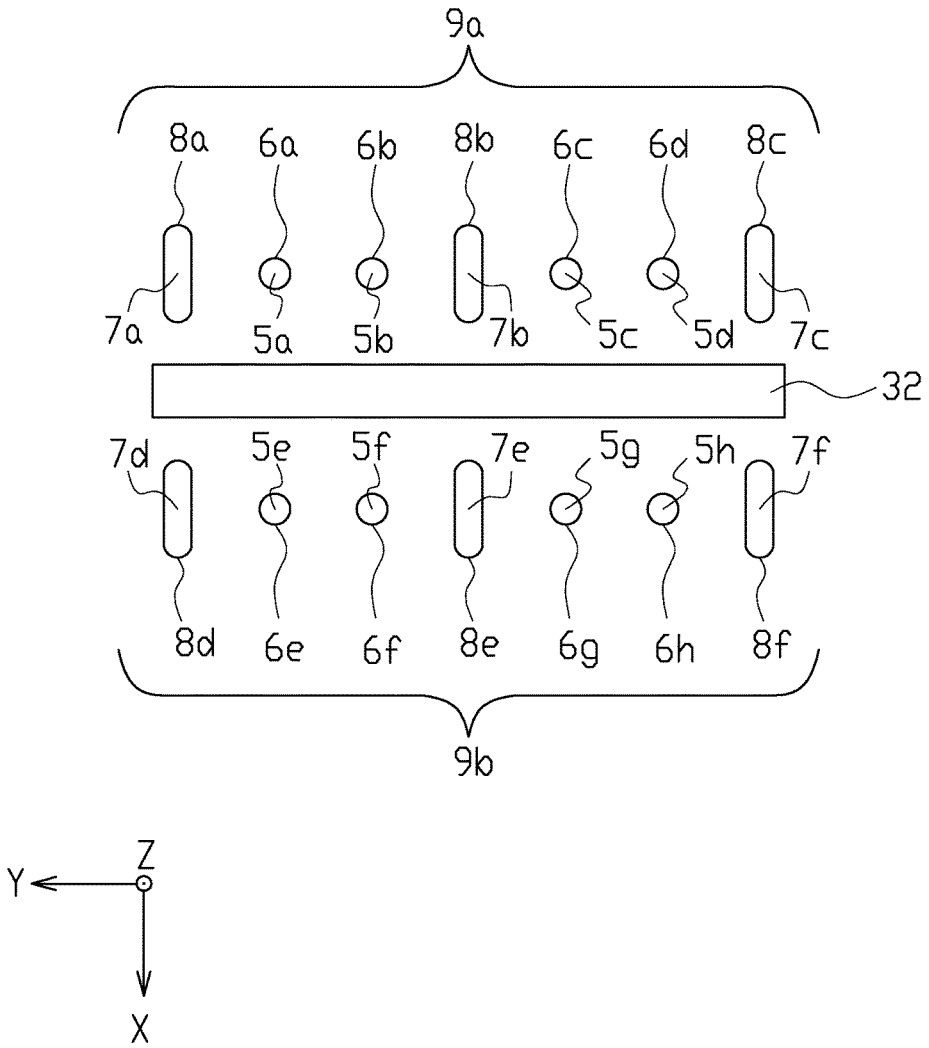
FIG. 4 is a view for describing arrangement positions of a contact, a ground contact, and a metal plate according to the first embodiment.

FIG. 4 is a view showing arrangement positions of the contacts 6*a* to 6*h*, the ground contacts 8*a* to 8*f*, and the metal plate 32. As shown in FIG. 4, the connector 10 is provided with the plurality of (eight in this embodiment) contacts 6*a* to 6*h*. The contact 6*e* includes the contact portion 5*e* to be connected to a connection terminal 102 (see FIG. 6) of the external device 100. Similarly, the contacts 6*a* to 6*d* and 6*f* to 6*h* include the contact portions 5*a* to 5*d* and 5*f* to 5*h*, respectively, to be connected to connection terminals (not shown) of the external device 100. The contacts 6*a* and 6*b* and the contacts 6*c* and 6*d* are disposed on the −X direction side and adjacent to each other along the Y direction. The contacts 6*e* and 6*f* and the contacts 6*g* and 6*h* are disposed on the +X direction side and adjacent to each other along the Y direction. When the external device 100 is pressed from the +Z direction side, the contact portions 5*a* to 5*h* come in contact with the connection terminal 102 and the like of the external device 100.

The connector 10 is provided with the plurality of (six in this embodiment) ground contacts 8*a* to 8*f*. The ground contacts 8*a* to 8*f* include the ground contact portions 7*a* to 7*f*, respectively, to be connected to ground terminals (not shown) of the external device 100. The ground contacts 8*a* and 8*b* are disposed with the two contacts 6*a* and 6*b* interposed therebetween. The ground contacts 8*b* and 8*c* are disposed with the two contacts 6*c* and 6*d* interposed therebetween. The ground contacts 8*d* and 8*e* are disposed with the two contacts 6*e* and 6*f* interposed therebetween. The ground contacts 8*e* and 8*f* are disposed with the two contacts 6*g* and 6*h* interposed therebetween. The ground contacts 8*a* to 8*f* are formed wider in the X direction than the contacts 6*a* to 6*h* on the ZX plane in order to enhance the functions thereof as the grounds. When the external device 100 is pressed from the +Z direction side, the ground contact portions 7*a* to 7*f* come in contact with the ground terminals (not shown) of the external device 100.

As shown in FIG. 4, the connector 10 includes the first contact group 9*a* in which the ground contact 8*a*, the contacts 6*a* and 6*b*, the ground contact 8*b*, the contacts 6*c* and 6*d*, and the ground contact 8*c* are arranged in a row in that order from the +Y direction to the −Y direction. The connector 10 further includes the second contact group 9*b* in which the ground contact 8*d*, the contacts 6*e* and 6*f*, the ground contact 8*e*, the contacts 6*g* and 6*h*, and the ground contact 8*f* are arranged in a row in that order from the +Y direction to the −Y direction. The first contact group 9*a* is disposed on the −X direction side and the second contact group 9*b* is disposed on the +X direction side.

Figure 6:
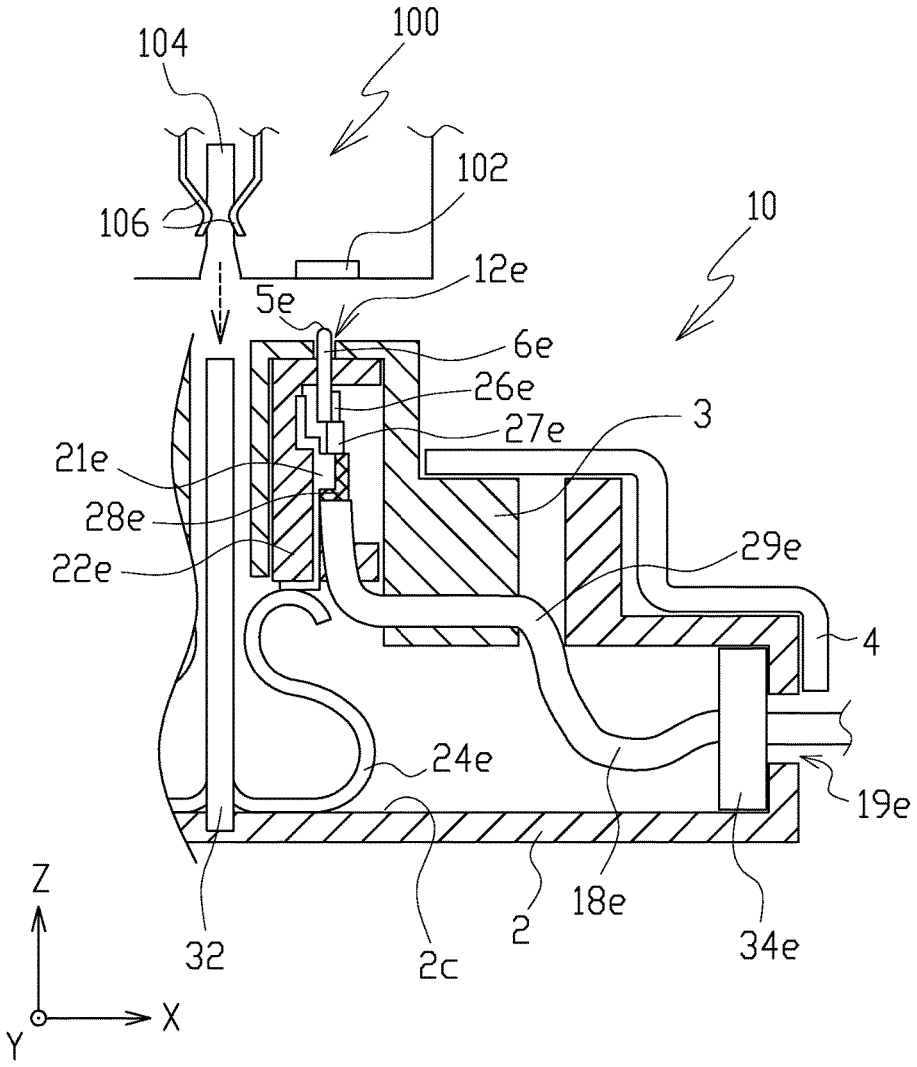
FIG. 6 is an enlarged view of the cross section of the connector according to the first embodiment.

FIG. 5 is a view of the ZX cross section between the contacts 6*a* and 6*e* and the ground contacts 8*a* and 8*d*, as viewed from the +Y direction side. FIG. 6 is an enlarged view of the cross section shown in FIG. 5 on the +X direction side. As shown in FIG. 6, a core wire 26*e* of the coaxial cable 18*e* is connected to the contact 6*e* by soldering, for example. The coaxial cable 18*e* includes the core wire 26*e*, an inner insulator 27*e* covering the core wire 26*e*, a shield member 28*e* including a conductor and covering the core wire 26*e* via the inner insulator 27*e*, and an outer insulator 29*e* covering the shield member 28*e*. The coaxial cable 18*e* is fixed in the insertion hole 20*e* (see FIG. 3) of the protection member 3 in a state where the coaxial cable 18*e* is deflected by a length corresponding to the moving distance of a holding member 22*e* described later in the Z direction, between the contact 6*e* and the insertion port, on the −X direction side, of the insertion hole 20*e* of the protection member 3. A fixing member 34*e* is attached to the coaxial cable 18*e*. The fixing member 34*e* is fixed to the base body 2 while blocking the insertion port of the insertion hole 19*e* on the −X direction side. The fixing member 34*e* is attached to the coaxial cable 18*e* and fixed to the base body 2 in a state where the coaxial cable 18*e* is deflected by a length corresponding to the moving distance of the protection member 3 in the Z direction, between the insertion port, on the +X direction side, of the insertion hole 20*e* of the protection member 3 and the fixing member 34*e*.

As shown in FIG. 6, a ground terminal 21*e*, the holding member 22*e* including an insulator, an elastic member 24*e* including a conductor, and the metal plate 32 are provided in an internal space formed by the base body 2 and the protection member 3.

Figure 7:
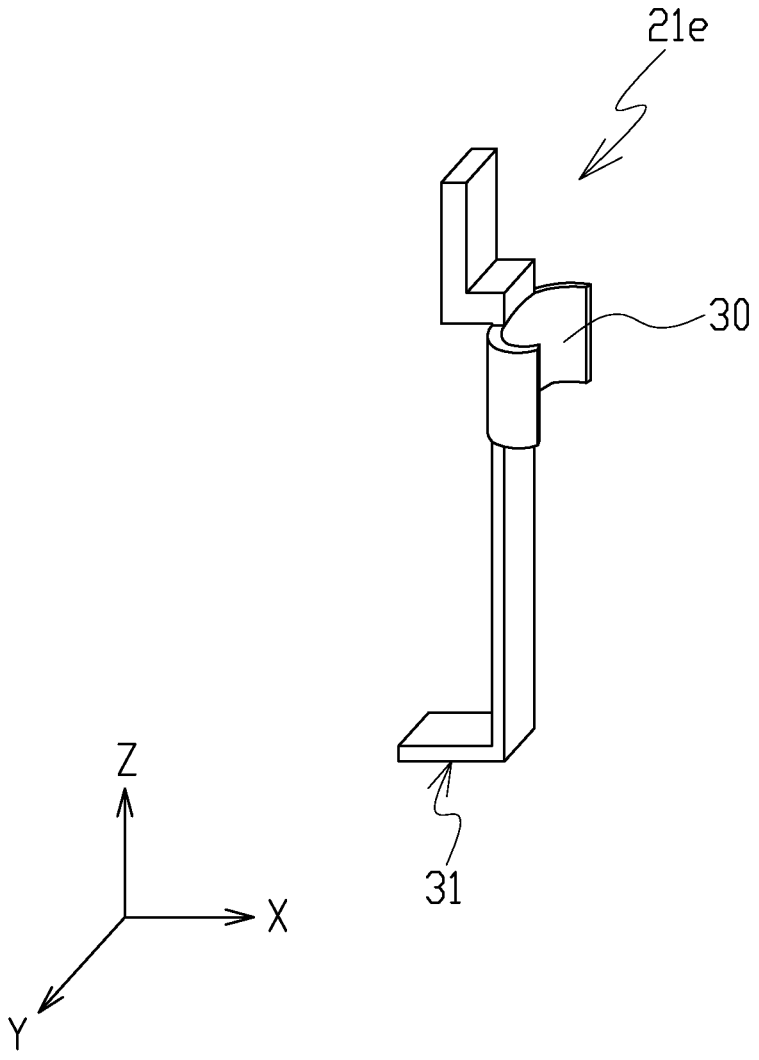
FIG. 7 is a view showing a configuration of a ground terminal according to the first embodiment.

FIG. 7 is a view showing a configuration of the ground terminal 21*e*. The ground terminal 21*e* is held by the holding member 22*e*, and a curved surface 30 on the +Z direction side of the ground terminal 21*e* grips the shield member 28*e* of the coaxial cable 18*e*. Furthermore, a lower surface 31 on the −Z direction side of the ground terminal 21*e* is constantly in contact with the elastic member 24*e*. That is, the shield member 28*e* of the coaxial cable 18*e* is electrically connected to the elastic member 24*e* via the ground terminal 21*e*.

Figure 8:
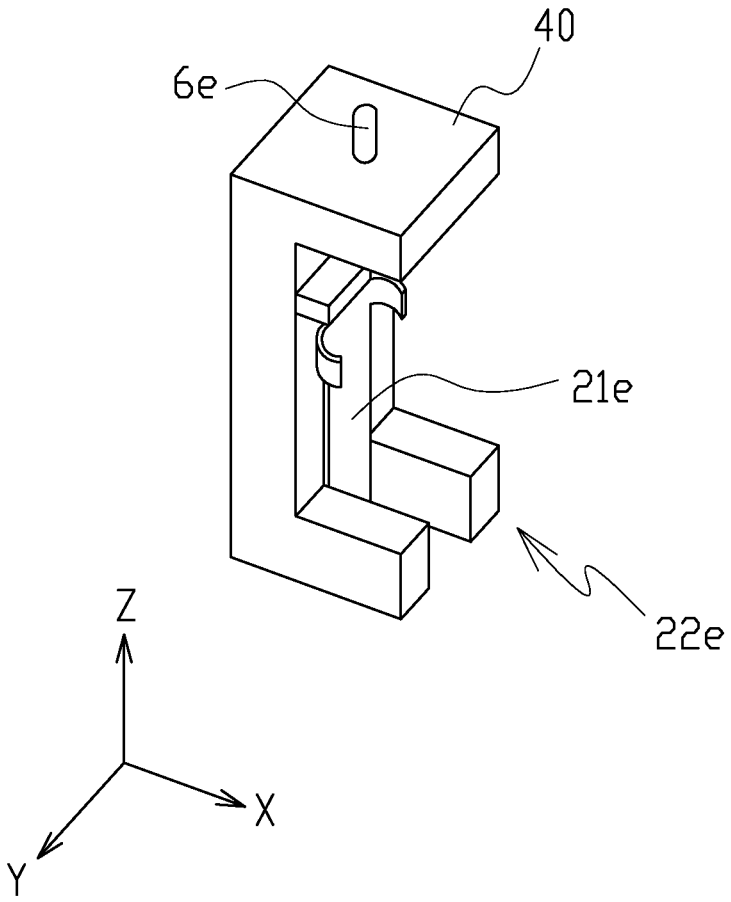
FIG. 8 is a view showing a configuration of a holding member according to the first embodiment.

FIG. 8 is a view showing configurations of the holding member 22*e*, the contact 6*e*, and the ground terminal 21*e*. The holding member 22*e* holds the contact 6*e* and the ground terminal 21*e*, and is movable in the Z direction. That is, the contact 6*e* moves in the Z direction along with the movement of the holding member 22*e*, thus also changing the position of the contact portion 5*e* of the contact 6*e* in the Z direction. The contact 6*e* and the holding member 22*e* can move in the +Z direction until an upper surface 40 of the holding member 22*e* is locked with the back surface of the protection member 3 around the second opening 12*e*, and can move in the −Z direction until the contact portion 5*e* is located on substantially the same plane as the upper surface of the protection member 3.

The elastic member 24*e* includes a conductive member, and is formed integrally with the metal plate 32. That is, the elastic member 24*e* is connected to the ground via the metal plate 32. Furthermore, a lower part of the elastic member 24*e* is held on a held surface 2*c* of the base body 2, and an upper part of the elastic member 24*e* is constantly in contact with the lower surface 31 of the ground terminal 21*e*. That is, the elastic member 24*e* is connected to the ground via the ground terminal 21*e*. The elastic member 24*e* is formed separately from the contact 6*e* and presses the contact 6*e* in the +Z direction via the ground terminal 21*e* and the holding member 22*e*.

Figure 9:
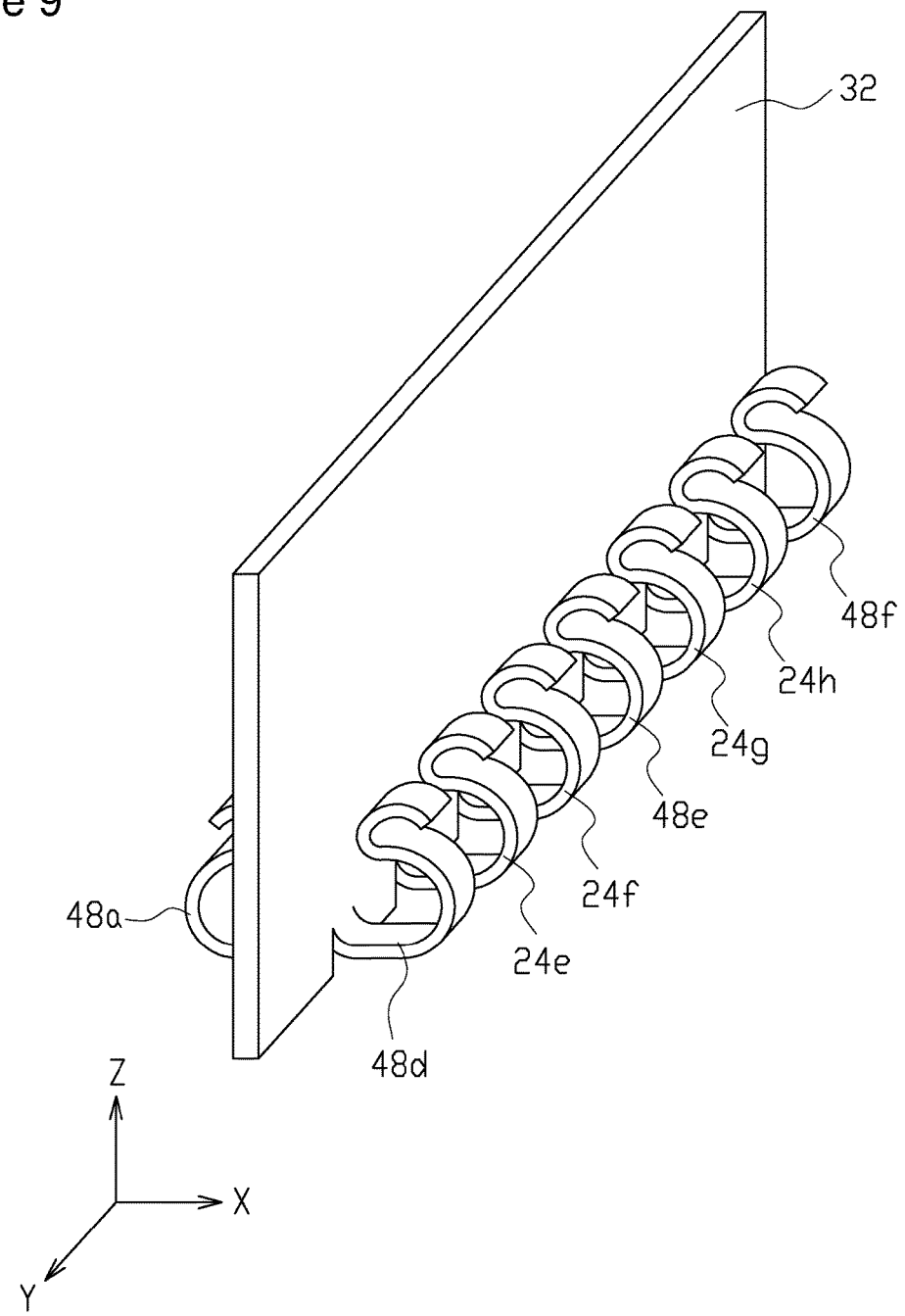
FIG. 9 is a view showing a configuration of the metal plate according to the first embodiment.

The metal plate 32 is disposed in the through hole 16 that is formed between the first contact group 9*a* and the second contact group 9*b* and at the central portion of the protection member 3. The −Z direction side of the metal plate 32 is fixed to the base body 2. FIG. 9 is a view showing a configuration of the metal plate 32. The surface of the metal plate 32 on the −X direction side faces the first contact group 9*a*, and the surface of the metal plate 32 on the +X direction side faces the second contact group 9*b*. The metal plate 32 shields the first contact group 9*a* and the second contact group 9*b* from each other. The metal plate 32 is formed integrally with elastic members 24*a* (see FIG. 5) and 24*e* to 24*h*, elastic members 48*a* and 48*d* to 48*f* to be described later, and five other elastic members (not shown). The elastic members 48*a* and 24*a*, and the five elastic members (not shown) are formed on the surface of the metal plate 32 on the −X direction side, and the elastic members 48*d* to 48*f* and 24*e* to 24*h* are formed on the surface of the metal plate 32 on the +X direction side. That is, the elastic members 24*a* and 24*e* to 24*h*, the elastic members 48*a* and 48*d* to 48*f* described later, and the five elastic members (not shown) are electrically connected via the metal plate 32.

Before the protection member 3 moves in the −Z direction, the metal plate 32 does not protrude from the through hole 16 but is embedded in the through hole 16. When the protection member 3 moves in the −Z direction, the metal plate 32 protrudes from the through hole 16. When the external device 100 presses the protection member 3 and the protection member 3 moves in the −Z direction, the metal plate 32 is inserted into a metal plate insertion portion 104 of the external device 100 and connected to a grounding terminal 106 including a conductor. Before the protection member 3 moves in the −Z direction, the metal plate 32 may either be located on substantially the same plane as the upper surface of the protection member 3 or protrude from the through hole 16.

The configurations of the contact 6*a*, the coaxial cable 18*a*, the fixing member 34*a*, the ground terminal 21*a*, the holding member 22*a*, and the elastic member 24*a* shown in FIG. 5 are respectively the same as those of the contact 6*e*, the coaxial cable 18*e*, the fixing member 34*e*, the ground terminal 21*e*, the holding member 22*e*, and the elastic member 24*e* in line symmetry with respect to the center line in the short-side direction of the connector 10. In addition, the connector 10 includes the contacts 6*b* to 6*d*, three coaxial cables (not shown) connected to the contacts 6*b* to 6*d* respectively, three fixing members (not shown) attached to the three coaxial cables (not shown), three ground terminals (not shown) respectively connected to the shield members of the three coaxial cables (not shown), three holding members (not shown) that hold the contacts 6*b* to 6*d* respectively, and three elastic members (not shown) that press the contacts 6*b* to 6*d* in the +Z direction respectively. These configurations are the same as those of the contact 6*a*, the coaxial cable 18*a*, the fixing member 34*a*, the ground terminal 21*a*, the holding member 22*a*, and the elastic member 24*a*. In addition, the connector 10 includes the contacts 6*f* to 6*h*, three coaxial cables (not shown) connected to the contacts 6*f* to 6*h* respectively, three fixing members (not shown) attached to the three coaxial cables (not shown), three ground terminals (not shown) respectively connected to the shield members of the three coaxial cables (not shown), three holding members (not shown) that hold the contacts 6*f* to 6*h* respectively, and elastic members 24*f* to 24*h* that press the contacts 6*f* to 6*h* in the +Z direction respectively. These configurations are the same as those of the contact 6*e*, the coaxial cable 18*e*, the fixing member 34*e*, the ground terminal 21*e*, the holding member 22*e*, and the elastic member 24*e*.

Figure 10:
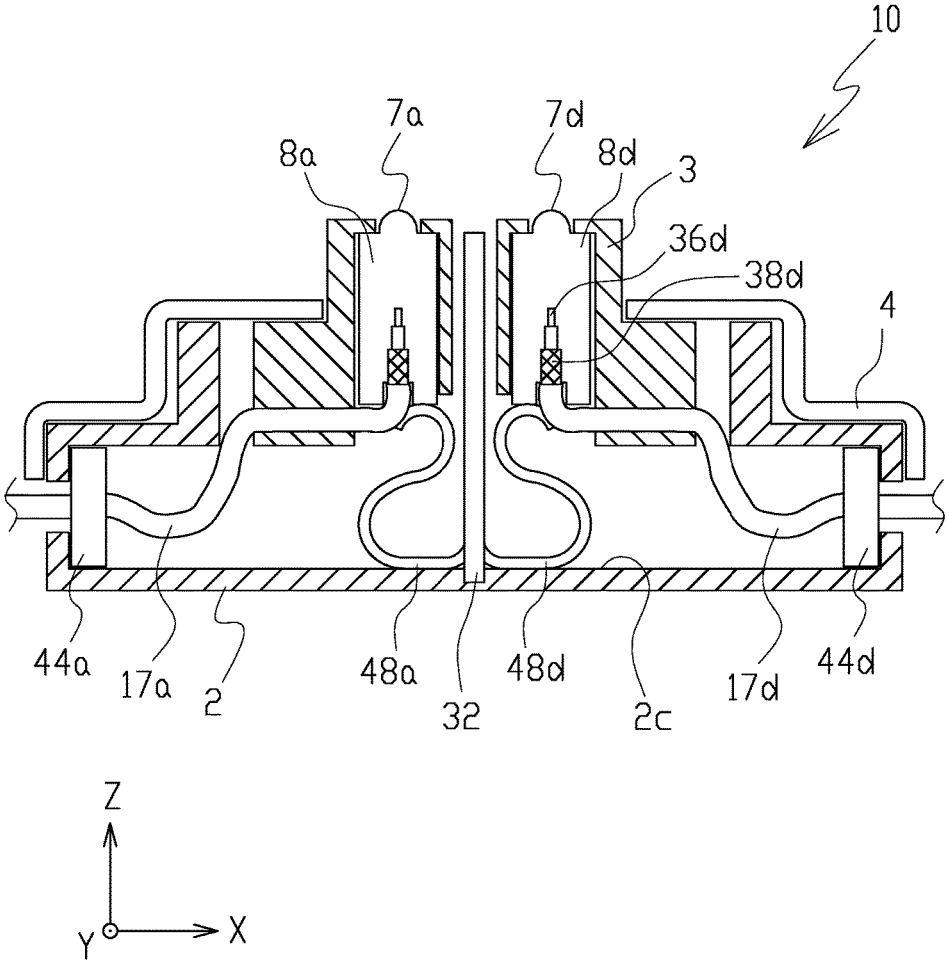
FIG. 10 is a view showing the cross section of the connector according to the first embodiment.
Figure 11:
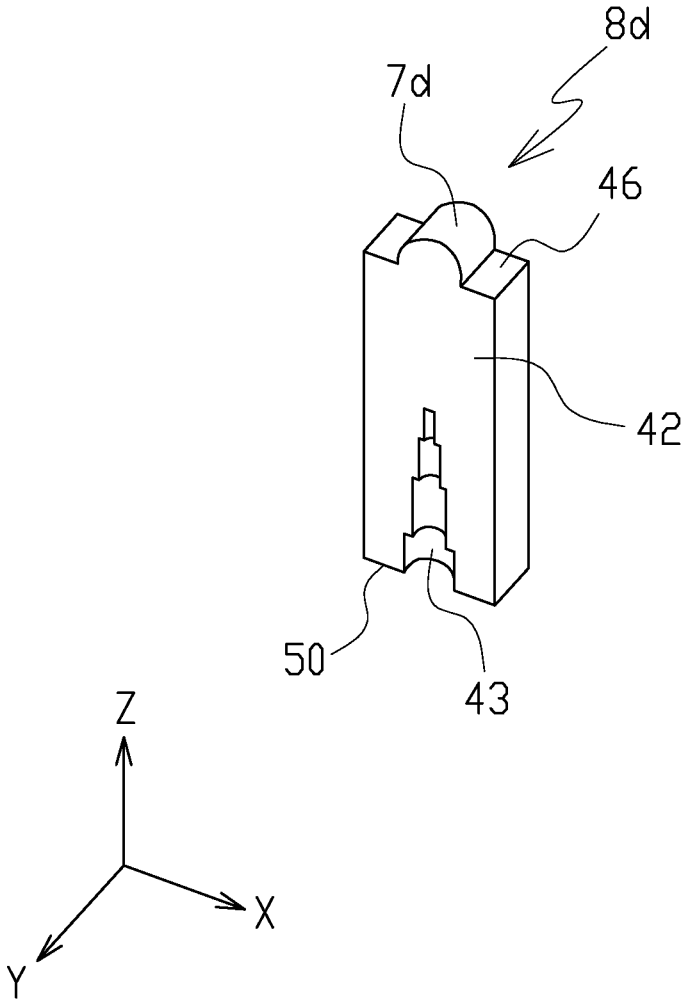
FIG. 11 is a view showing a configuration of the ground contact according to the first embodiment.

FIG. 10 is a view of the ZX cross section on the +Y direction side of the ground contacts 8*a* and 8*d*, as viewed from the +Y direction side. FIG. 11 is a view showing the configuration of the ground contact 8*d*. The ground contact 8*d* has a surface 42 that is disposed substantially parallel to the ZX plane, and the surface 42 is formed wider in the X direction than the contacts 6*a* to 6*h*. As shown in FIG. 11, a recess 43 for fitting the grounding coaxial cable 17*d* is formed in the surface 42 of the ground contact 8*d*. As shown in FIG. 10, a core wire 36*d* and a shield member 38*d* of the grounding coaxial cable 17*d* are connected to the ground contact 8*d* by soldering, for example. The configuration of the grounding coaxial cable 17*d* is the same as that of the coaxial cable 18*e*. The grounding coaxial cable 17*d* is fixed in the insertion hole 25*d* (see FIG. 3) of the protection member 3 in a state where the grounding coaxial cable 17*d* is deflected by a length corresponding to the moving distance of the ground contact 8*d* in the Z direction, between the ground contact 8*d* and the insertion port, on the −X direction side, of the insertion hole 25*d* of the protection member 3. A fixing member 44*d* is attached to the grounding coaxial cable 17*d*. The fixing member 44*d* is fixed to the base body 2 while blocking the insertion port of the insertion hole 23*d* on the −X direction side. The fixing member 44*d* is attached to the grounding coaxial cable 17*d* and fixed to the base body 2 in a state where the grounding coaxial cable 17*d* is deflected by a length corresponding to the moving distance of the protection member 3 in the Z direction, between the insertion port, on the +X direction side, of the insertion hole 25*d* of the protection member 3 and the fixing member 44*d*. The recess 43 may be formed in a surface of the ground contact 8*d* on the −Y direction side, in which case the grounding coaxial cable 17*d* is disposed in the recess formed in the surface on the −Y direction side.

The ground contact 8*d* is movable in the Z direction. The ground contact 8*d* can move in the +Z direction until an upper surface 46 of the ground contact 8*d* is locked with the back surface of the protection member 3 around the third opening 14*d*, and can move in the −Z direction until the ground contact portion 7*d* is located on substantially the same plane as the upper surface of the protection member 3.

As shown in FIG. 10, the elastic member 48*d* is provided in the internal space formed by the base body 2 and the protection member 3. The elastic member 48*d* includes a conductive member, and is formed integrally with the metal plate 32. A lower part of the elastic member 48*d* is held on the held surface 2*c* of the base body 2, and an upper part of the elastic member 48*d* is electrically connected to a lower surface 50 of the ground contact 8*d*. The elastic member 48*d* is formed separately from the ground contact 8*d* and presses the ground contact 8*d* in the +Z direction.

The configurations of the ground contact 8*a*, the grounding coaxial cable 17*a*, and the elastic member 48*a* shown in FIG. 10 are respectively the same as those of the ground contact 8*d*, the grounding coaxial cable 17*d*, and the elastic member 48*d* in line symmetry with respect to the center line in the short-side direction of the connector 10. The connector 10 further includes the ground contacts 8*b* and 8*c*, two coaxial cables (not shown) connected to the ground contacts 8*b* and 8*c* respectively, and two elastic members (not shown) that press the ground contacts 8*b* and 8*c* in the +Z direction respectively. These configurations are the same as those of the ground contact 8*a*, the grounding coaxial cable 17*a*, and the elastic member 48*a*. In addition, the connector 10 includes the ground contacts 8*e* and 8*f*, two coaxial cables (not shown) connected to the ground contacts 8*e* and 8*f* respectively, and elastic members 48*e* and 48*f* that press the ground contacts 8*e* and 8*f* in the +Z direction respectively. These configurations are the same as those of the ground contact 8*d*, the grounding coaxial cable 17*d*, and the elastic member 48*d*.

Next, displacement of the protection member 3 and the contact portion 5*e* in the process of pressing the external device 100 against the connector 10 according to the first embodiment will be described with reference to the drawings.

Before the external device 100 comes in contact with the protection member 3 and the contact portion 5*e*, as shown in FIG. 6, the upper surface (on the +Z direction side) of the protection member 3 is protruding from the upper surface (on the +Z direction side) of the base body 2 by a predetermined amount. Furthermore, the contact portion 5*e* is located at a position protruding from the second opening 12*e* of the protection member 3 by a predetermined amount. In addition, the metal plate 32 is embedded in the through hole 16 by a predetermined amount from the upper surface of the protection member 3. The protrusion amount of the contact portion 5*e* is the minimum amount of protrusion required to bring the connection terminal 102 of the external device 100 into contact with the contact portion 5*e* when the external device 100 is pressed against the connector 10.

Next, when the external device 100 is pressed against the connector 10, the connection terminal 102 of the external device 100 comes in contact with and is pressed against the contact portion 5*e*, and a pressing force in the −Z direction is applied to the contact portion 5*e*. Then, the contact portion 5*e* moves in the −Z direction, and the elastic member 24*e* is compressed in the Z direction. In addition, along with the movement of the contact portion 5*e*, the protection member 3 moves in the −Z direction and the metal plate 32 protrudes from the through hole 16.

Figure 12:
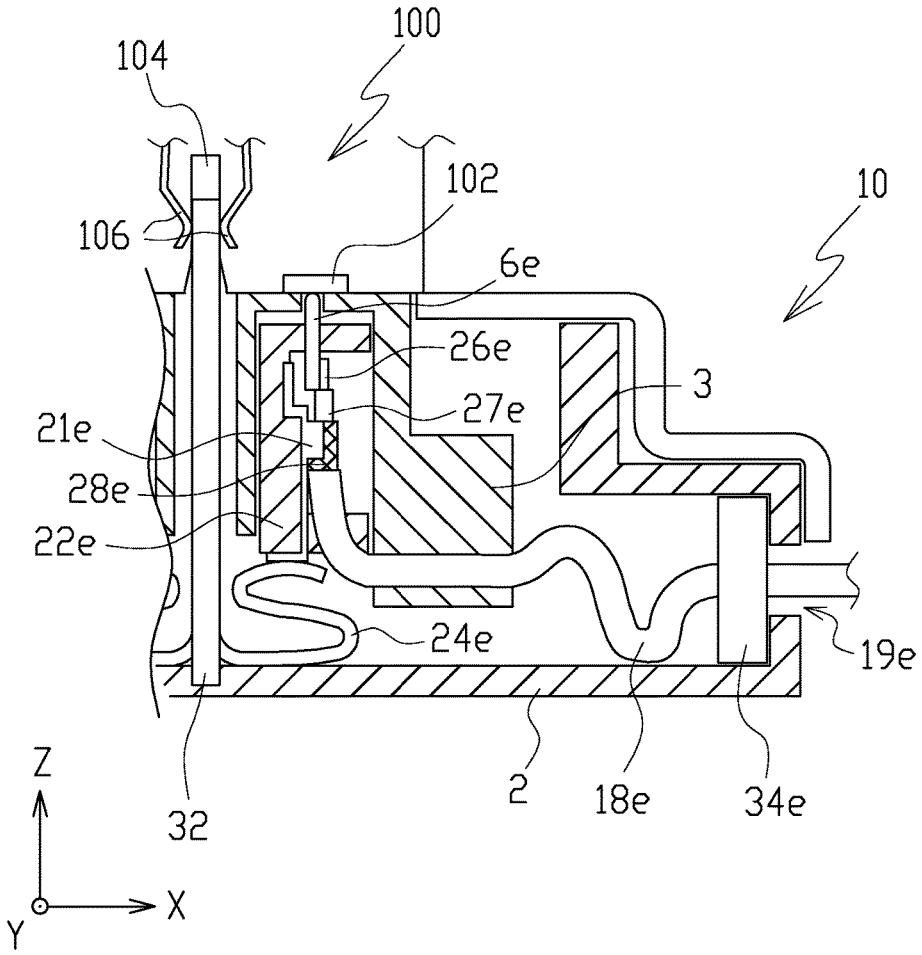
FIG. 12 is a view showing how the connector according to the first embodiment is connected to an external device.

When the external device 100 is further pressed against the connector 10, as shown in FIG. 12, the elastic member 24*e* is further compressed in the Z direction, and the protection member 3 moves in the −Z direction until the surface of the protection member 3 on the +Z direction side is on substantially the same plane as the surface of the base body 2 on the +Z direction side. Furthermore, as shown in FIG. 12, the contact portion 5*e* moves in the −Z direction until the apex of the contact portion 5*e* is on substantially the same plane as the surfaces of the protection member 3 and the base body 2 on the +Z direction side. That is, in the final coupled state with the external device 100, the apex of the contact portion 5*e*, the surface of the protection member 3 on the +Z direction side, and the surface of the base body 2 on the +Z direction side are located on substantially the same plane. In this final coupled state, the contact portion 5*e* is constantly urged upward (+Z direction) by the spring force of the compressed elastic member 24*e*, and the contact portion 5*e* comes in contact with the connection terminal 102 with a sufficient contact force. Therefore, the connector 10 and the external device 100 can be electrically connected to each other in a reliable manner. Furthermore, in the final coupled state, the metal plate 32 protrudes by a predetermined amount from the through hole 16, is inserted into the metal plate insertion portion 104 of the external device 100, and comes in contact with the grounding terminal 106.

In the connector 10 according to the first embodiment, the contacts 6*a* to 6*h* and the elastic members 24*a* and 24*e* to 24*h* are formed separately, not integrally. Therefore, the design freedom of the connector can be enhanced. In other words, in a terminal in which the contact and the elastic member are integrated, the size and shape of the terminal, and hence the size and shape of the connector are heavily restricted, thus lowering the design freedom. According to the first embodiment, however, since the contact and the elastic member are formed separately, the design freedom concerning the size and shape of the contact increases, and thus the design freedom concerning the size and shape of the connector increases. An increase in the design freedom in turn makes it possible to make the connector compact.

Furthermore, since the design freedom concerning the size and shape of the contact increases, the structure of the contact and a transmission path of the connector can be simplified, and impedance matching for high-speed transmission can be easily performed. That is, it is possible to simplify the cross section of the connector that affects the impedance (the plane perpendicular to the transmission path of the connector) and to reduce the kinds of the cross sections of the connector. Therefore, the impedance can be easily adjusted using a coaxial cable matching the target impedance.

In the connector 10 according to the first embodiment, the contacts 6*a* to 6*h* and the elastic members 24*a* and 24*e* to 24*h* are formed separately, not integrally. Therefore, the structure can be simplified compared with that of a terminal in which a contact and an elastic member are integrated. In addition, since the shield member 28*e* of the coaxial cable 18*e* connected to the contact 6*e* and the elastic member 24*e* are connected to the ground, the ground can be reinforced and high-speed transmission characteristics can be improved. In addition, since the ground contacts are disposed with the contacts adjacent to each other interposed therebetween, the ground can be reinforced and the high-speed transmission characteristics can be improved. Furthermore, since the elastic members 24*a*, 24*e* to 24*h*, 48*a* and 48*d* to 48*f*, the ground contacts 8*a* to 8*f*, and the metal plate 32 are electrically connected, the ground can be further reinforced and the high-speed transmission characteristics can be improved.

In the connector 10 according to the first embodiment, since the protection member 3 protects the contact portions 5*a* to 5*h*, it is possible to provide a connector which is inexpensive and difficult to break down. For example, since the contact portions 5*a* to 5*h* are protected by the protection member 3, even when a finger, a pen tip or the like touches the connector 10 by mistake, deformation of the contacts 6*a* to 6*h* due to contact with a finger, a pen tip or the like can be prevented. Furthermore, the contact portion 5*e* and the like can be brought into contact with the connection terminal 102 and the like with a sufficient pressing force in the final coupled state.

The plurality of contacts 6*a* to 6*h* is provided in the above-described first embodiment, but at least one contact would suffice.

In the first embodiment, two contact groups, i.e., the first contact group 9*a* and the second contact group 9*b* are provided, but three or more contact groups may be provided.

In addition, although the connector 10 according to the first embodiment includes one metal plate 32, the connector 10 may include two metal plates. In this case, one metal plate is disposed on the protection member 3 and the other metal plate is disposed on the base body 2. A part of the one metal plate is disposed so as to overlap the other metal plate, and the one metal plate and the other metal plate are electrically connected to each other. Even when the protection member 3 moves in the Z direction, the one metal plate remains overlapping the other metal plate.

Figure 13:
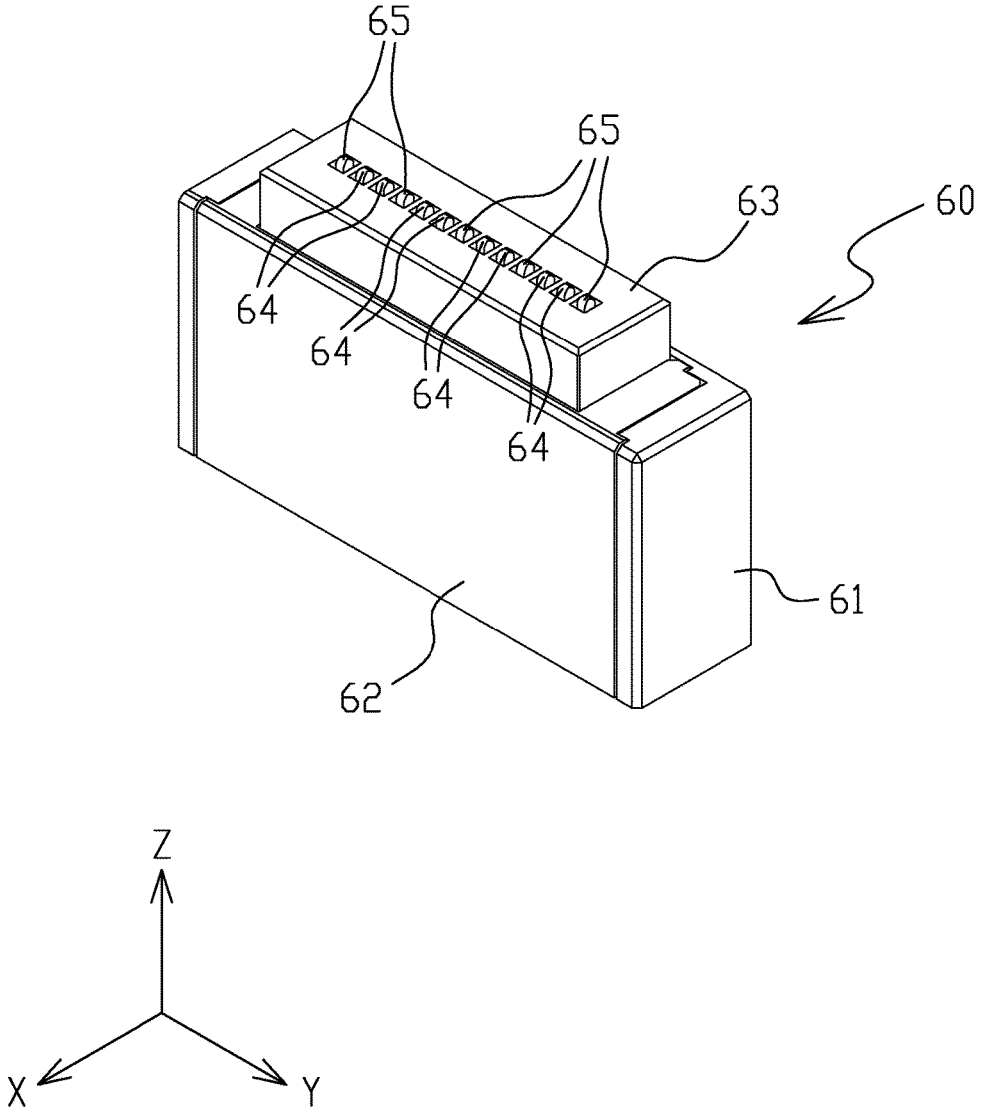
FIG. 13 is a perspective view showing an external appearance of a first connector included in a connector according to a second embodiment.
Figure 14:
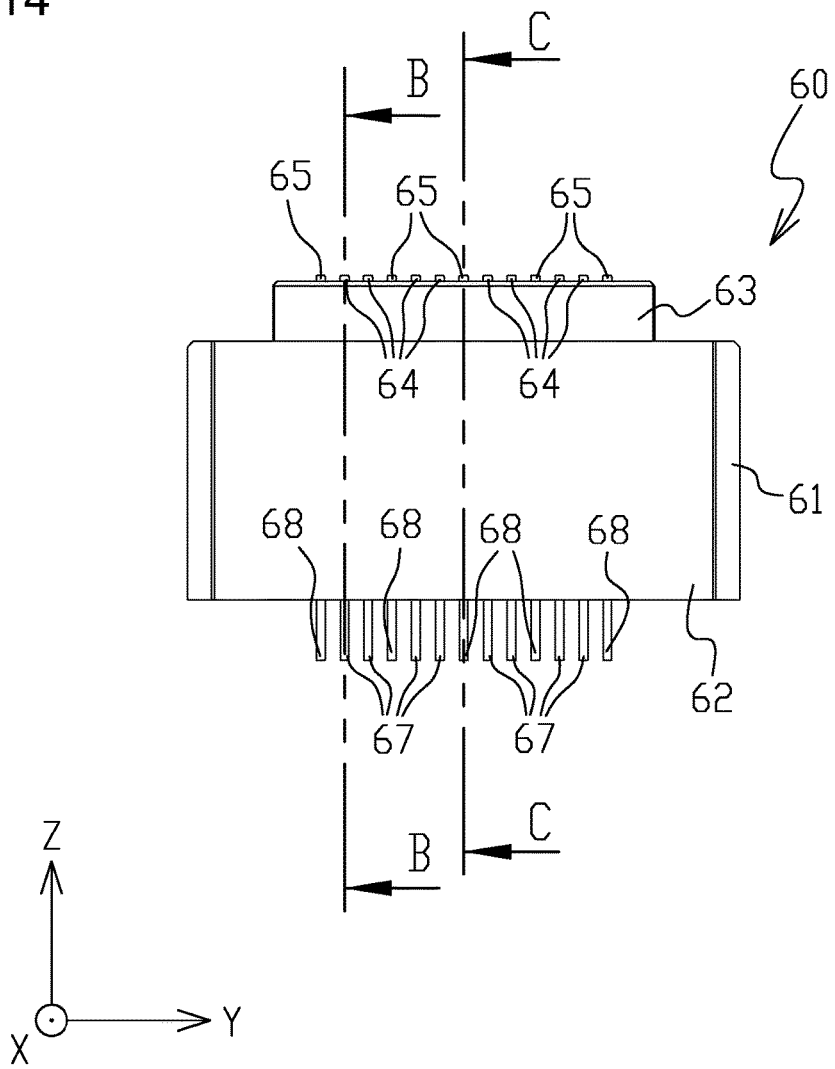
FIG. 14 is a front view showing the external appearance of the first connector included in the connector according to the second embodiment.
Figure 15:
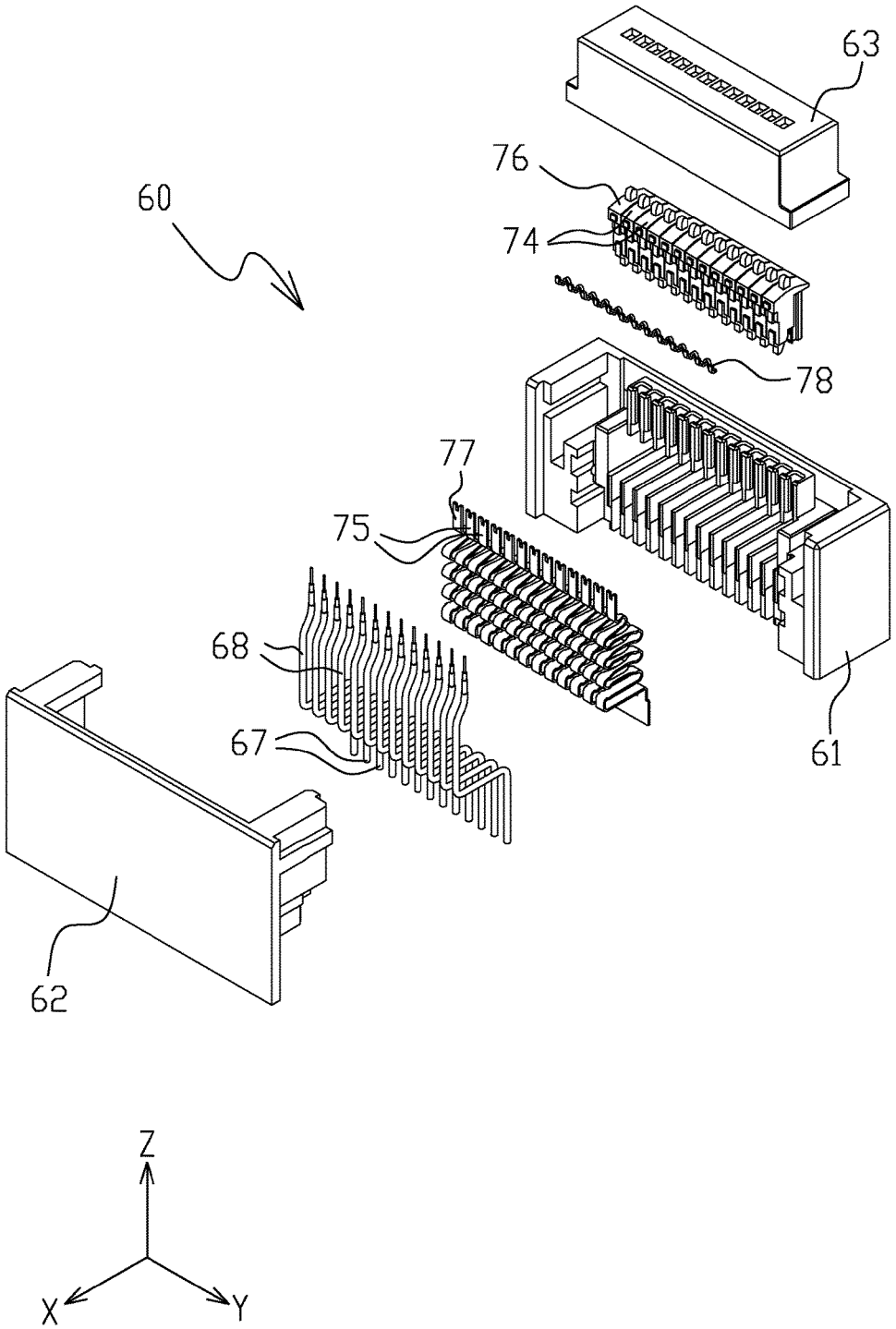
FIG. 15 is an exploded view showing a configuration of the first connector included in the connector according to the second embodiment.

Next, a connector according to a second embodiment will be described with reference to the drawings. The connector according to the second embodiment includes a first connector mounted on, for example, a peripheral device such as a keyboard, and a second connector mounted on an external device such as a portable information terminal. The connector according to the second embodiment is a press-type connector that is electrically connected to the first connector by pressing a connection terminal of the second connector in a predetermined direction. FIG. 13 is a perspective view showing an external appearance of the first connector included in the connector according to the second embodiment. FIG. 14 is a front view showing the external appearance of the first connector included in the connector according to the second embodiment. FIG. 15 is an exploded view showing a configuration of the first connector included in the connector according to the second embodiment. As shown in FIGS. 13 to 15, the first connector 60 according to the second embodiment includes a base body 61, a cover 62, a protection member 63, a plurality of (eight in the second embodiment) first contacts 64, a plurality of (five in the second embodiment) second contacts 65, a plurality of (eight in the second embodiment) first coaxial cables 67, and a plurality of (five in the second embodiment) second coaxial cables 68.

In the following description, the XYZ orthogonal coordinate system shown in FIG. 13 is set, and the positional relationship and the like of each member will be described with reference to this orthogonal coordinate system. The Y axis is set to be parallel to a direction in which the first contact 64 and the second contact 65 are arranged. The Z axis is set to be parallel to a direction in which a second connector 79 (see FIG. 23) is pressed against the first connector 60. The X axis is set in a direction orthogonal to the YZ plane.

The base body 61 includes an insulative member, for example, resin. As shown in FIGS. 13 and 14, the base body 61 accommodates the protection member 63, the first contacts 64, the second contacts 65, the first coaxial cables 67, and the second coaxial cables 68. A rectangular first opening is formed on the upper surface (+Z direction side) of the base body 61 by the cover 62 being attached to the base body 61. The protection member 63 protrudes in the +Z direction through the first opening.

The protection member 63 includes an insulative member, for example, resin. The protection member 63 protects first contact portions 64*a* (see FIG. 17) of the first contacts 64 and second contact portions 65*a* (see FIG. 17) of the second contacts 65 by covering the periphery of the first contacts 64 and the second contacts 65. The protection member 63 is configured to be movable in the ±Z direction with respect to the base body 61, and moves along with the movement of the second connector 79 (see FIG. 23). As shown in FIG. 13, before the second connector 79 comes in contact with the protection member 63, the protection member 63 is disposed while protruding from the upper surface of the base body 61.

Figure 16:
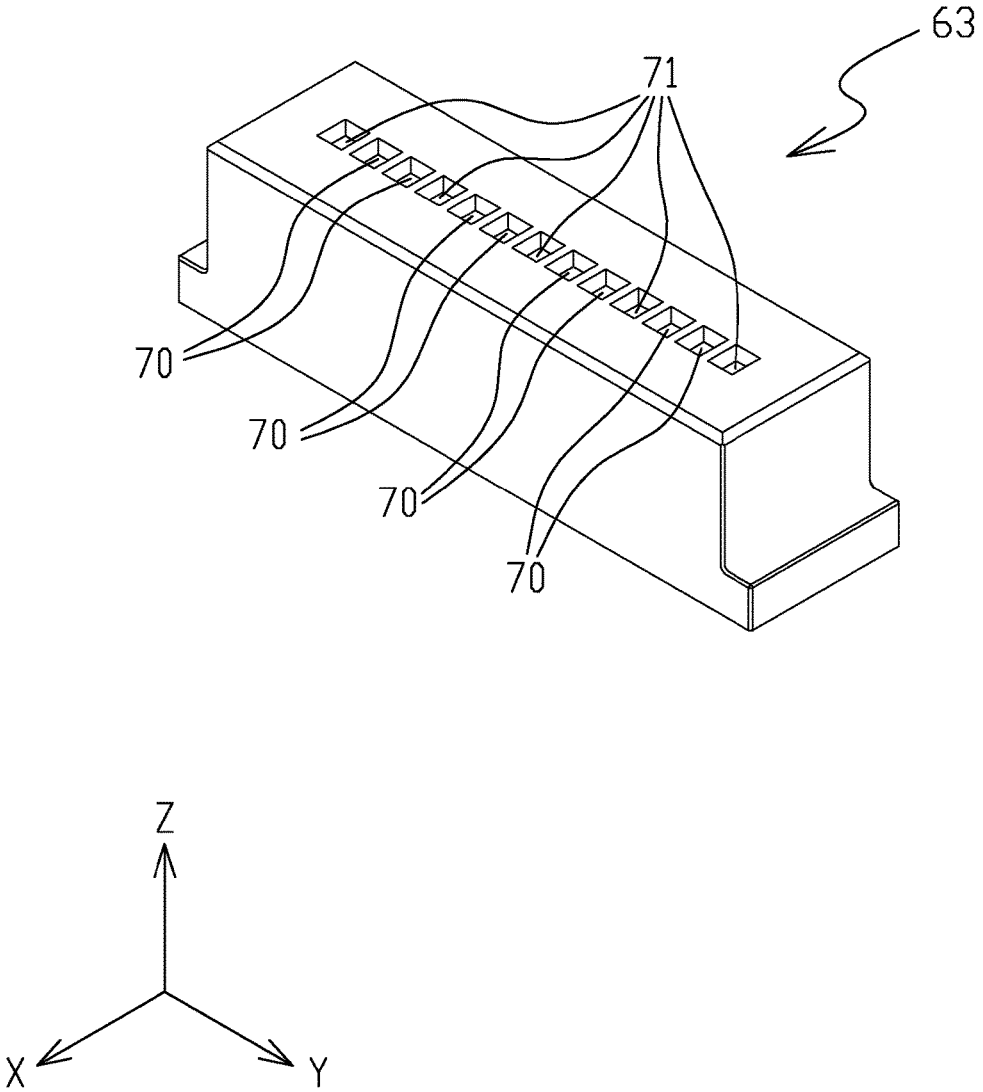
FIG. 16 is a view showing a configuration of a protection member according to the second embodiment.

FIG. 16 is a view showing a configuration of the protection member 63. On the upper surface (+Z direction side) of the protection member 63 (the surface against which the second connector 79 is pressed), as shown in FIG. 16, one third opening 71, two second openings 70, one third opening 71, two second openings 70, one third opening 71, two second openings 70, one third opening 71, two second openings 70, and one third opening 71 are formed in a row, along the Y direction, in that order from the −Y direction. The first contact portion 64*a* of the first contact 64 protrudes in the +Z direction through the second opening 70. The second contact portion 65*a* of the second contact 65 protrudes in the +Z direction through the third opening 71.

Figure 17:
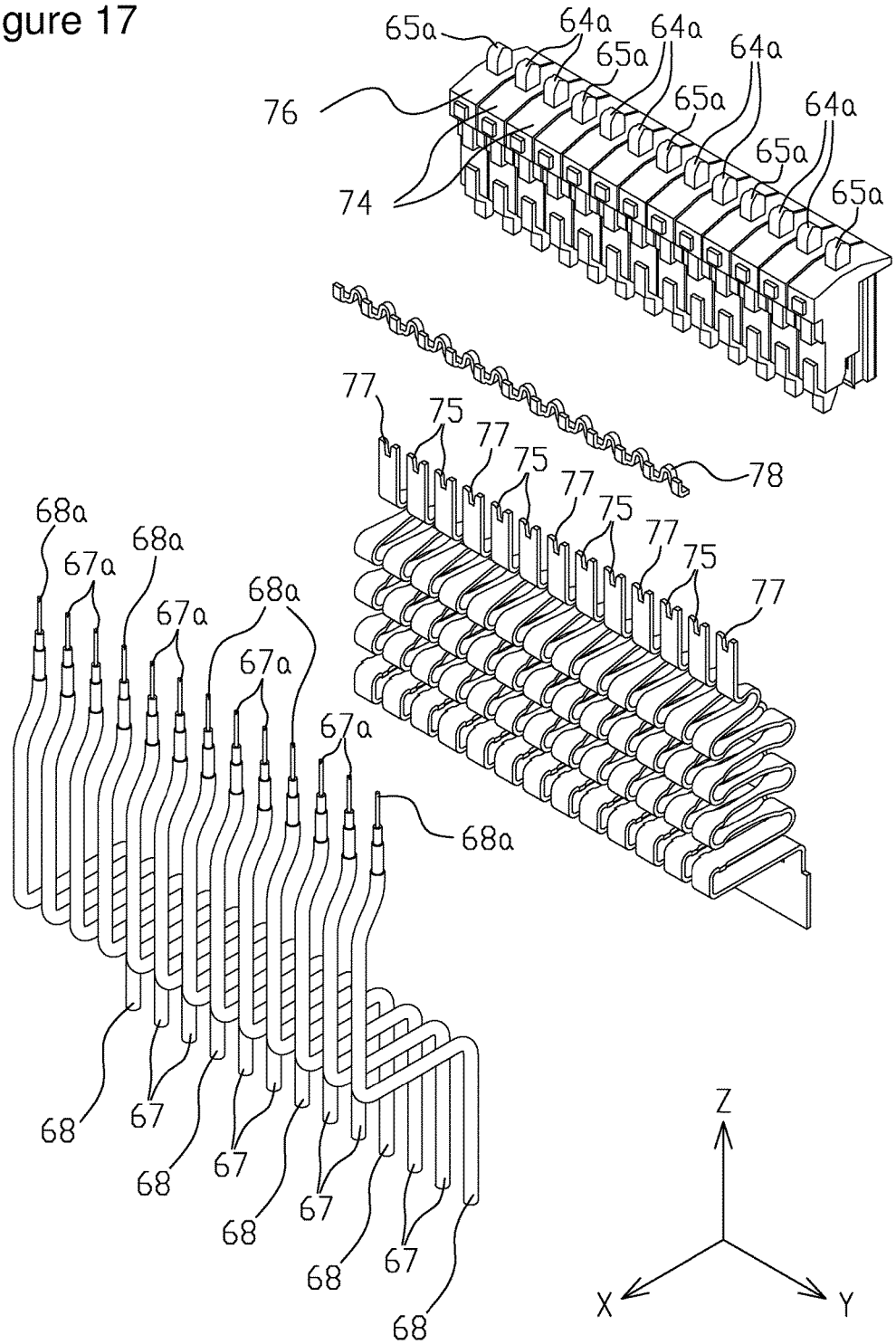
FIG. 17 is an exploded view showing configurations of members other than a base body, a cover, the protection member, a third contact, and an electric wire according to the second embodiment.
Figure 18:
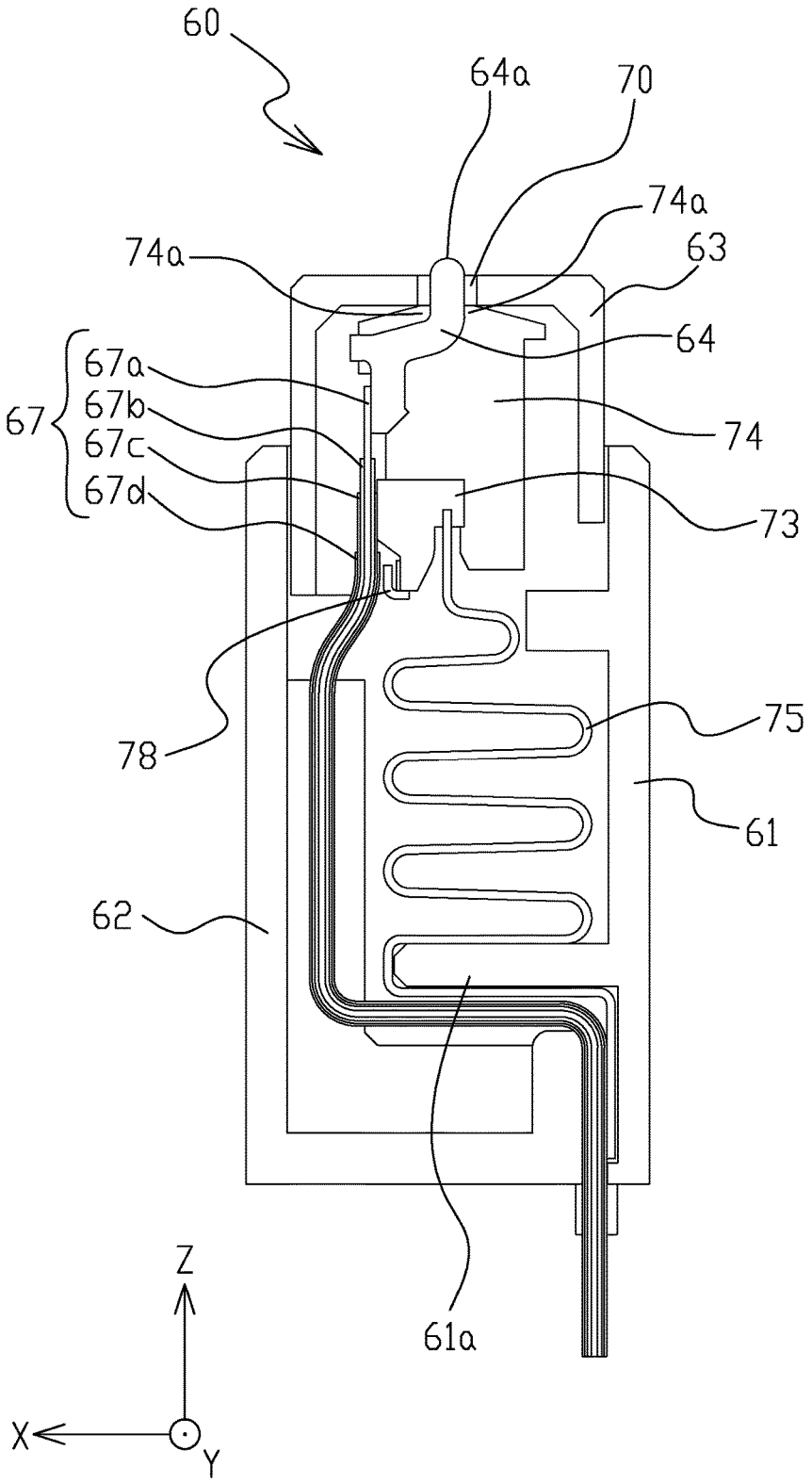
FIG. 18 is a cross-sectional view showing the configuration of the first connector included in the connector according to the second embodiment.

FIG. 17 is an exploded view showing configurations of members other than the base body 61, the cover 62, and the protection member 63 of the first connector 60 according to the second embodiment. FIG. 18 is a cross-sectional view taken along line B-B in FIG. 14. As shown in FIGS. 17 and 18, the first contact 64 includes the first contact portion 64*a* that is electrically connected to a first connection terminal 80 (see FIG. 23) of the second connector 79 when the first connection terminal 80 is pressed in the −Z direction. The first contact 64 has the same shape as a part of the second contact 65 (see FIG. 19) including the second contact portion 65*a*. Two first contacts 64 are disposed adjacent to each other along the Y direction, and four sets of two adjacent first contacts 64 are arranged along the Y direction.

As shown in FIG. 18, a first core wire 67*a* of the first coaxial cable 67 is electrically connected to the first contact 64 by soldering, for example. The first coaxial cable 67 includes the first core wire 67*a*, a first inner insulator 67*b* covering the first core wire 67*a*, a first shield member 67*c* including a conductor and covering the first core wire 67*a* via the first inner insulator 67*b*, and a first outer insulator 67*d* covering the first shield member 67*c*. The first inner insulator 67*b* electrically insulates the first core wire 67*a* from the first shield member 67*c*. The first shield member 67*c* functions as a grounding conductor (first grounding conductor) and is connected to the ground. In addition, the impedance between the first core wire 67*a* and the first shield member 67*c* is matched. The first coaxial cable 67 is fixed to the base body 61 while being deflected within the base body 61 by a length corresponding to the moving distance of a first holding member 74 to be described later in the Z direction and by a length corresponding to the moving distance of the protection member 63 in the Z direction.

Furthermore, as shown in FIG. 18, a ground terminal 73, the first holding member 74 including an insulator, and a first elastic member 75 including a conductor are provided in an internal space formed by the base body 61, the cover 62, and the protection member 63.

As shown in FIG. 18, the ground terminal 73 is disposed in the vicinity of the first contact 64 and held by the first holding member 74. In addition, the ground terminal 73 has the same shape as a part of the second contact 65 (see FIG. 19) including the lower surface of the second contact 65 (surface on the −Z direction side, serving as a part connected to a grounding connection member 78). The first shield member 67*c* of the first coaxial cable 67 is electrically connected to a surface of the ground terminal 73 on the +X direction side by soldering, for example. Furthermore, a tip portion of the first elastic member 75 on the +Z direction side is connected to a part of the ground terminal 73 on the −X direction side. That is, the first shield member 67*c* of the first coaxial cable 67 and the first elastic member 75 are electrically connected via the ground terminal 73.

As shown in FIG. 18, the first holding member 74 holds the first contact 64 and the ground terminal 73, and is movable in the ±Z direction. That is, the first contact 64 moves in the ±Z direction along with the movement of the first holding member 74, and thus the position of the first contact portion 64*a* of the first contact 64 in the Z direction also changes. The first contact 64 and the first holding member 74 can move in the +Z direction until the upper surface of the first holding member 74 on the +Z direction side is locked with the back surface of the protection member 63 around the second opening 70, and can move in the −Z direction until the first contact portion 64*a* is located on substantially the same plane as the upper surface of the protection member 63.

The first holding member 74 includes a pressing portion 74*a* that presses the protection member 63 upward (+Z direction). The pressing portion 74*a* presses the protection member 63 upward (+Z direction) by an elastic force of the first elastic member 75 before the second connector 79 is pressed (initial state). After the second connector 79 is pressed (final coupled state), the pressing portion 74*a* does not come in contact with or press the protection member 63. That is, in transition from the initial state to the final coupled state, the pressing portion 74*a* is initially brought into contact with and presses the protection member 63, and then gradually separates from the protection member 63 and ceases pressing the protection member 63.

The first elastic member 75 includes a conductive member, and as shown in FIG. 18, the tip portion of the first elastic member 75 on the +Z direction side is connected to a part of the ground terminal 73 on the −X direction side. The tip portion of the first elastic member 75 on the −Z direction side is held by a held portion 61*a* of the base body 61. The first elastic member 75 is formed separately from the first contact 64 and presses the first contact 64 and the protection member 63 in the +Z direction via the ground terminal 73 and the first holding member 74. The first elastic member 75 is connected to the ground.

Figure 19:
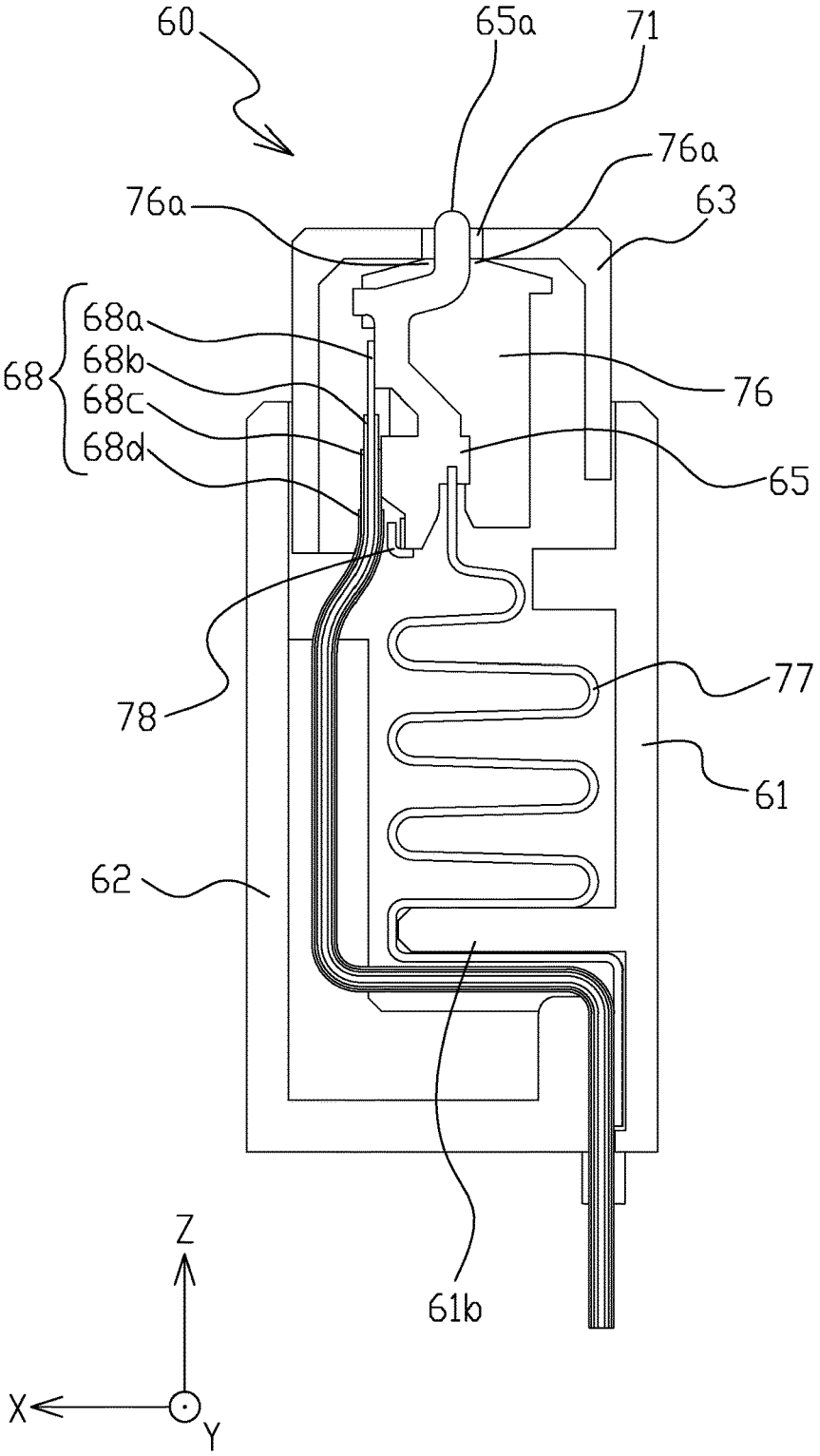
FIG. 19 is a cross-sectional view showing the configuration of the first connector included in the connector according to the second embodiment.

FIG. 19 is a cross-sectional view taken along line C-C in FIG. 14. As shown in FIGS. 17 and 19, the second contact 65 includes the second contact portion 65*a* that is electrically connected to a second connection terminal 81 (see FIG. 23) of the second connector 79 when the second connection terminal 81 is pressed in the −Z direction. The second contacts 65 are disposed with the two first contacts 64 adjacent to each other interposed therebetween, and the five second contacts 65 are arranged along the Y direction. The impedance between the first contact 64 and the second contact 65 is matched.

As shown in FIG. 19, a second core wire 68*a* and a second shield member 68*c* of the second coaxial cable 68 are electrically connected to the second contact 65 by soldering, for example. The second coaxial cable 68 includes the second core wire 68*a*, a second inner insulator 68*b* covering the second core wire 68*a*, the second shield member 68*c* including a conductor and covering the second core wire 68*a* via the second inner insulator 68*b*, and a second outer insulator 68*d* covering the second shield member 68*c*. The second inner insulator 68*b* electrically insulates the second core wire 68*a* from the second shield member 68*c*. The impedance between the second core wire 68*a* and the second shield member 68*c* is matched. The second core wire 68*a* and the second shield member 68*c* each function as a grounding conductor (second grounding conductor) and are connected to the ground. The second coaxial cable 68 is fixed to the base body 61 while being deflected within the base body 61 by a length corresponding to the moving distance of a second holding member 76 to be described later in the Z direction and by a length corresponding to the moving distance of the protection member 63 in the Z direction. The second coaxial cable 68 and the above-described first coaxial cable 67 function as wiring members.

As shown in FIG. 19, the second holding member 76 including an insulator and a second elastic member 77 including a conductor are provided in an internal space formed by the base body 61, the cover 62, and the protection member 63.

As shown in FIG. 19, the second holding member 76 holds the second contact 65 and is movable in the ±Z direction. That is, the second contact 65 moves in the ±Z direction along with the movement of the second holding member 76, and thus the position of the second contact portion 65*a* of the second contact 65 in the Z direction also changes. The second contact 65 and the second holding member 76 can move in the +Z direction until the upper surface of the second holding member 76 on the +Z direction side is locked with the back surface of the protection member 63 around the third opening 71, and can move in the −Z direction until the second contact portion 65*a* is located on substantially the same plane as the upper surface of the protection member 63.

The second holding member 76 includes a pressing portion 76*a* that presses the protection member 63 upward (+Z direction). The pressing portion 76*a* presses the protection member 63 upward (+Z direction) by an elastic force of the second elastic member 77 before the second connector 79 is pressed (initial state). After the second connector 79 is pressed (final coupled state), the pressing portion 76*a* does not come in contact with or press the protection member 63. That is, in transition from the initial state to the final coupled state, the pressing portion 76*a* is initially brought into contact with and presses the protection member 63, and then gradually separates from the protection member 63 and ceases pressing the protection member 63.

The second elastic member 77 includes a conductive member, and as shown in FIG. 19, the tip portion of the second elastic member 77 on the +Z direction side is connected to a part of the second contact 65 on the −X direction side. The tip portion of the second elastic member 77 on the −Z direction side is held by a held portion 61*b* of the base body 61. The second elastic member 77 is formed separately from the second contact 65, and presses the second contact 65 and the protection member 63 in the +Z direction. The second elastic member 77 is connected to the ground.

Figure 20:
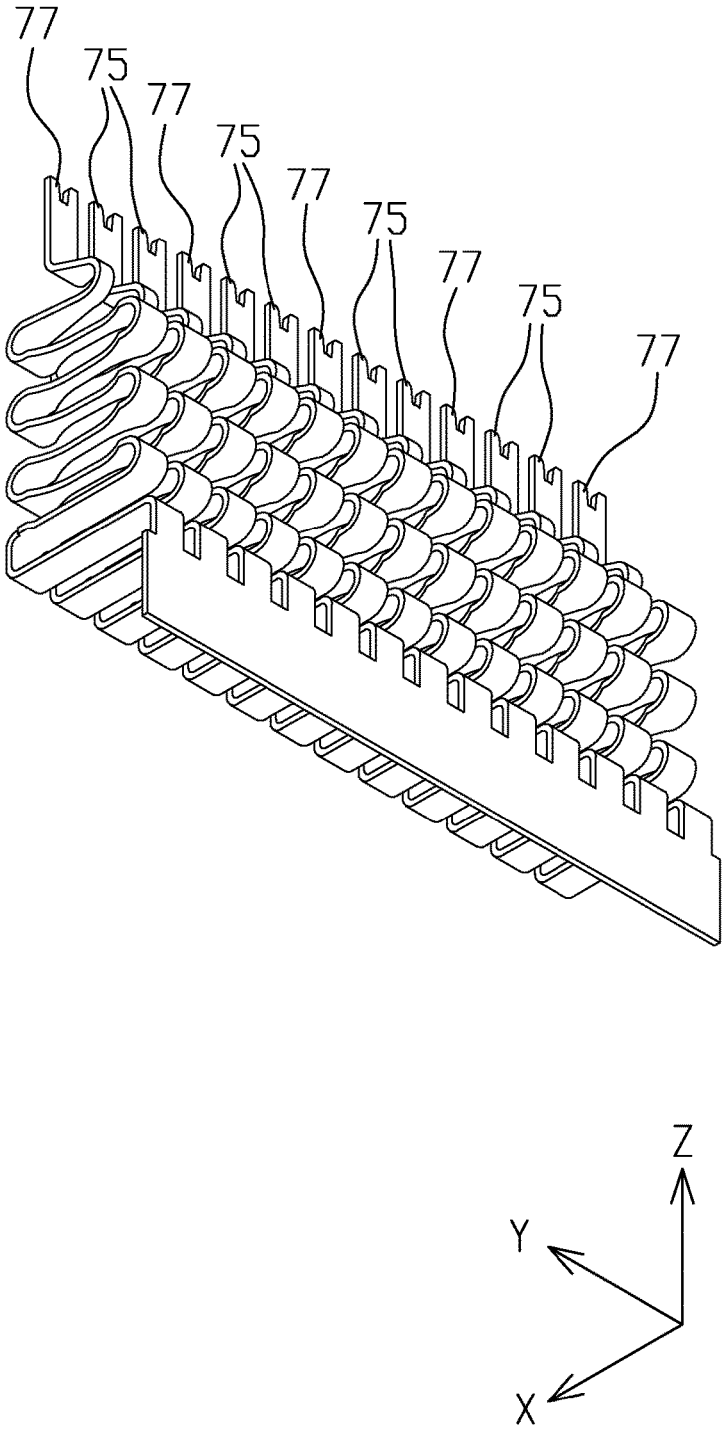
FIG. 20 is a view showing configurations of a first elastic member and a second elastic member according to the second embodiment.

FIG. 20 is a view showing the configurations of the first elastic member 75 and the second elastic member 77. As shown in FIG. 20, the plurality of first elastic members 75 and the plurality of second elastic members 77 are coupled on the −Z direction side. That is, each first elastic member 75 is electrically connected to the other first elastic members 75, and the first elastic members 75 and the second elastic members 77 are electrically connected to each other.

Figure 21:
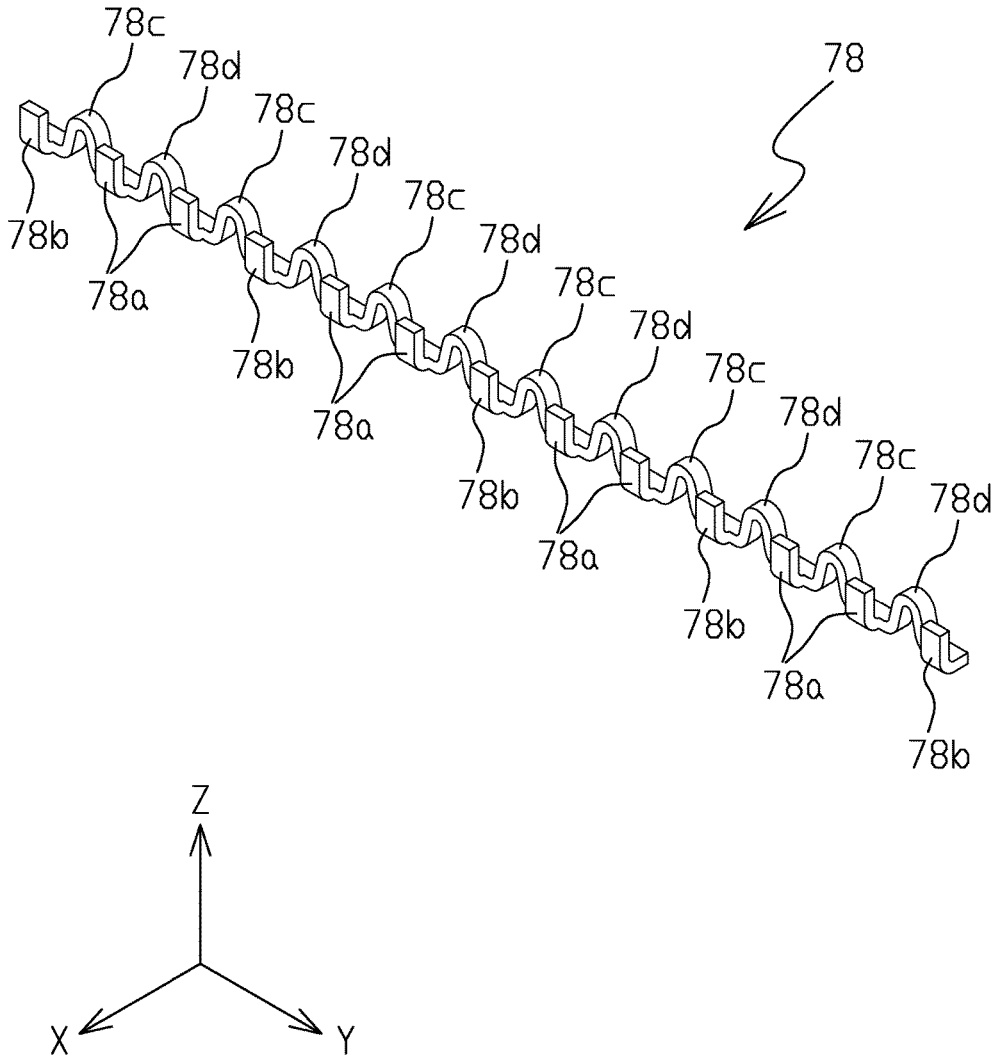
FIG. 21 is a view showing a configuration of a grounding connection member according to the second embodiment.

As shown in FIGS. 18 and 19, the grounding connection member 78 including a conductor is provided in the internal space formed by the base body 61, the cover 62, and the protection member 63. FIG. 21 is a view showing a configuration of the grounding connection member 78. As shown in FIG. 21, the grounding connection member 78 is formed of one flat plate, and includes eight first bent portions 78*a* bent in the shape of L, five second bent portions 78*b* bent in the shape of L, six first curved portions 78*c* curved in the shape of U, and six second curved portions 78*d* curved in the shape of U.

As shown in FIG. 18, the first bent portion 78*a* is connected to the lower surface (surface on the −Z direction side) of the ground terminal 73. As shown in FIG. 19, the second bent portion 78*b* is connected to the lower surface (surface on the −Z direction side, serving as a part connected to the grounding connection member 78) of the second contact 65.

Figure 22:
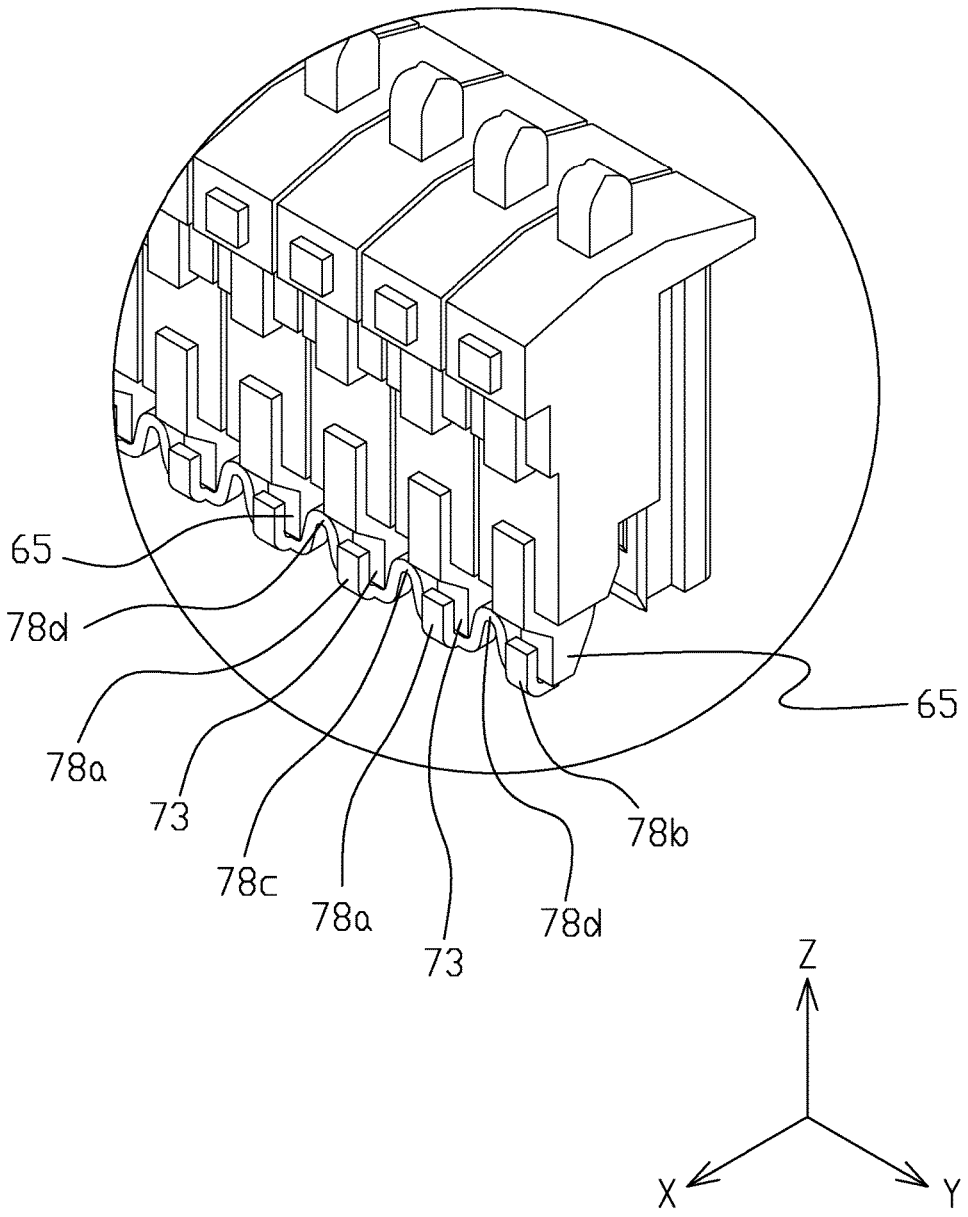
FIG. 22 is a view showing how the grounding connection member, a ground terminal, and a second contact according to the second embodiment are connected.

FIG. 22 is a view showing how the grounding connection member 78, the ground terminal 73, and the second contact 65 are connected. As shown in FIG. 22, the first curved portion 78*c* is connected to two adjacent ground terminals 73. Specifically, the first curved portion 78*c* is connected to a surface of one of the ground terminals 73 (the ground terminal 73 located on the +Y direction side of the first curved portion 78*c*) on the −Y direction side, and to a surface of the other ground terminal 73 (the ground terminal 73 located on the −Y direction side of the first curved portion 78*c*) on the +Y direction side. As shown in FIG. 22, the second curved portion 78*d* is connected to the adjacent ground terminal 73 and second contact 65. Specifically, the second curved portion 78*d* is connected to a surface of the ground terminal 73 on the −Y direction side and a surface of the second contact 65 on the +Y direction side, or to a surface of the ground terminal 73 on the +Y direction side and a surface of the second contact 65 on the −Y direction side.

That is, one of the ground terminals 73 and the other ground terminal 73 are electrically connected via the grounding connection member 78. As a result, the first shield member 67*c* connected to one of the ground terminals 73 and the first shield member 67*c* connected to the other ground terminal 73 are electrically connected to each other via the ground terminals 73 and the grounding connection member 78. In addition, the ground terminal 73 and the second contact 65 are electrically connected via the grounding connection member 78. Consequently, the first shield member 67*c* connected to the ground terminal 73, and the second core wire 68*a* and the second shield member 68*c* connected to the second contact 65 are electrically connected via the ground terminal 73, the second contact 65, and the grounding connection member 78. That is, the ground terminal 73 and the grounding connection member 78 function as connection members that electrically connect the first shield member 67*c*, the second core wire 68*a*, and the second shield member 68*c* to one another.

The first curved portion 78*c* and the second curved portion 78*d* of the grounding connection member 78 have flexibility (elasticity). Therefore, the grounding connection member 78 can follow the movement of the individual first holding members 74 (first contact portions 64*a*) in the Z direction and the movement of the individual second holding members 76 (second contact portions 65*a*) in the Z direction.

Figure 23:
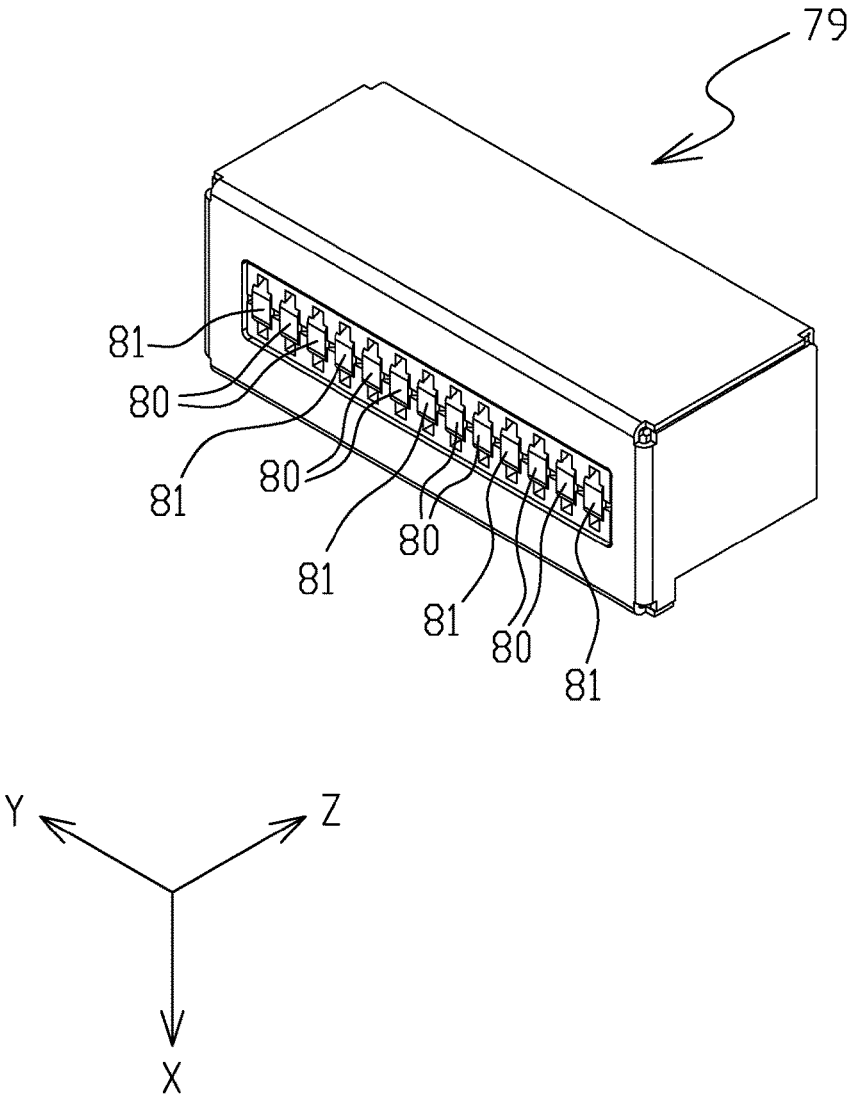
FIG. 23 is a view showing a configuration of a second connector included in the connector according to the second embodiment.
Figure 24:
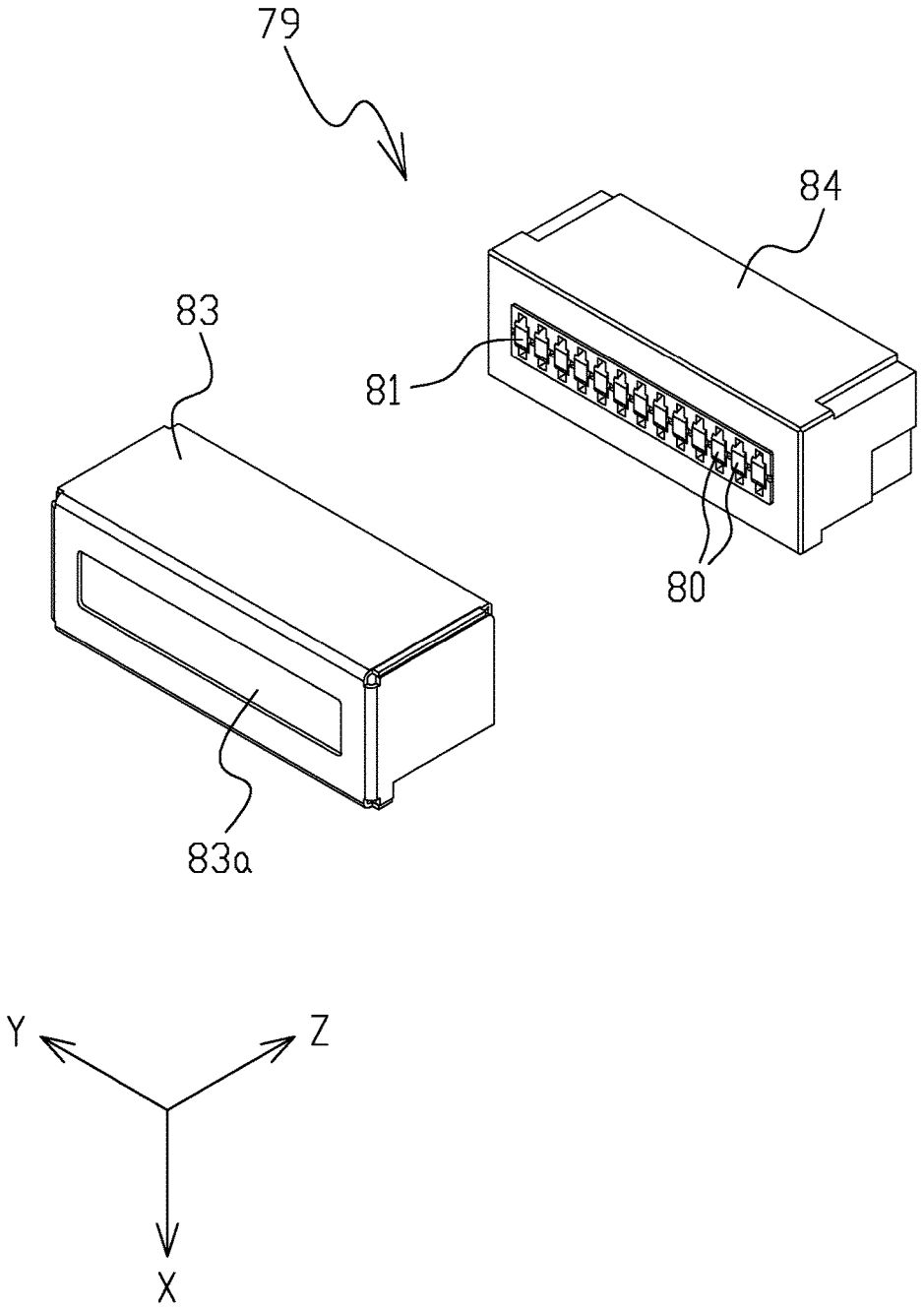
FIG. 24 is an exploded view showing the configuration of the second connector included in the connector according to the second embodiment.

Next, the second connector 79 included in the connector according to the second embodiment will be described. FIG. 23 is a perspective view showing an external appearance of the second connector 79 included in the connector according to the second embodiment. FIG. 24 is an exploded view showing a configuration of the second connector 79 included in the connector according to the second embodiment. As shown in FIGS. 23 and 24, the second connector 79 includes the first connection terminal 80, the second connection terminal 81, a housing 84, and a shell 83.

The first connection terminal 80 is electrically connected to the first contact 64 (see FIG. 13) of the first connector 60 when the second connector 79 is pressed against the first connector 60. The second connection terminal 81 is electrically connected to the second contact 65 (see FIG. 13) of the first connector 60 when the second connector 79 is pressed against the first connector 60. The first connection terminal 80 and the second connection terminal 81 are insert-molded in the housing 84.

The housing 84 includes an insulative member, for example, resin, and is covered with the shell 83. The shell 83 is formed of a conductive member, such as metal. As shown in FIG. 24, the shell 83 has an opening 83*a* through which the first connection terminal 80 and the second connection terminal 81 are exposed, and covers the housing 84 while exposing the first connection terminal 80 and the second connection terminal 81.

Next, displacement of the protection member 63 and the first contact portion 64*a* in the process of pressing the second connector 79 against the first connector 60 according to the second embodiment will be described with reference to the drawings. Since the displacement of the second contact portion 65*a* in the process of pressing the second connector 79 against the first connector 60 is substantially the same as the displacement of the first contact portion 64*a*, the description thereof will be omitted.

Before the second connector 79 comes in contact with the protection member 63, the first contact portion 64*a*, and the second contact portion 65*a* (initial state), as shown in FIG. 18, the first contact portion 64*a* is located at a position protruding from the second opening 70 of the protection member 63 by a predetermined amount. The protrusion amount of the first contact portion 64*a* is the minimum amount of protrusion required to bring the first connection terminal 80 of the second connector 79 into contact with the first contact portion 64*a* when the second connector 79 is pressed against the first connector 60. The upper surface (on the +Z direction side) of the protection member 63 is protruding from the upper surface (on the +Z direction side) of the base body 61 by a predetermined amount. The first elastic member 75 pushes up the first holding member 74 in the +Z direction, and the pressing portion 74*a* of the first holding member 74 presses the protection member 63 by the elastic force of the first elastic member 75.

Next, when the second connector 79 is pressed against the first connector 60, the first connection terminal 80 of the second connector 79 comes in contact with and presses the first contact portion 64*a*, and thus a pressing force in the −Z direction is applied to the first contact portion 64*a*. The first contact portion 64*a* starts moving in the −Z direction, and along with the start of the movement of the first contact portion 64*a*, the protection member 63 also starts moving in the −Z direction. The first elastic member 75 starts being compressed in the Z direction, and the pressing portion 74*a* of the first holding member 74 presses the protection member 63 by the elastic force of the first elastic member 75.

When the second connector 79 is further pressed against the first connector 60, the first contact portion 64*a* further moves in the −Z direction, and the protection member 63 stops moving in the −Z direction. The first elastic member 75 is further compressed in the Z direction, and the pressing portion 74*a* of the first holding member 74 presses the protection member 63 by the elastic force of the first elastic member 75.

When the second connector 79 is further pressed against the first connector 60, the protection member 63 does not move, and only the first contact portion 64*a* moves in the −Z direction. The first elastic member 75 is further compressed in the Z direction, but the protection member 63 does not move. Therefore, the pressing of the protection member 63 by the pressing portion 74*a* of the first holding member 74 can be gradually released.

Figure 25:
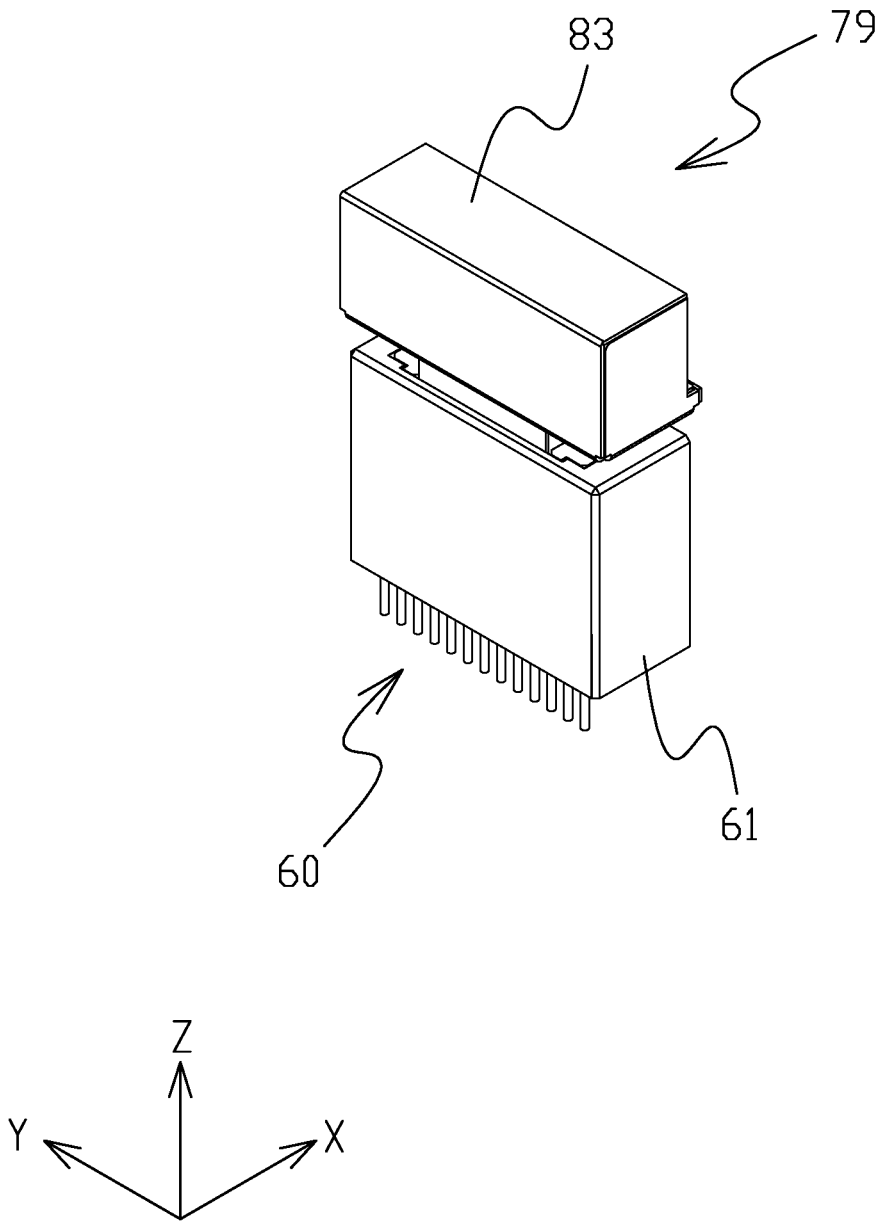
FIG. 25 is a view showing how the first connector and the second connector included in the connector according to the second embodiment are coupled.
Figure 26:
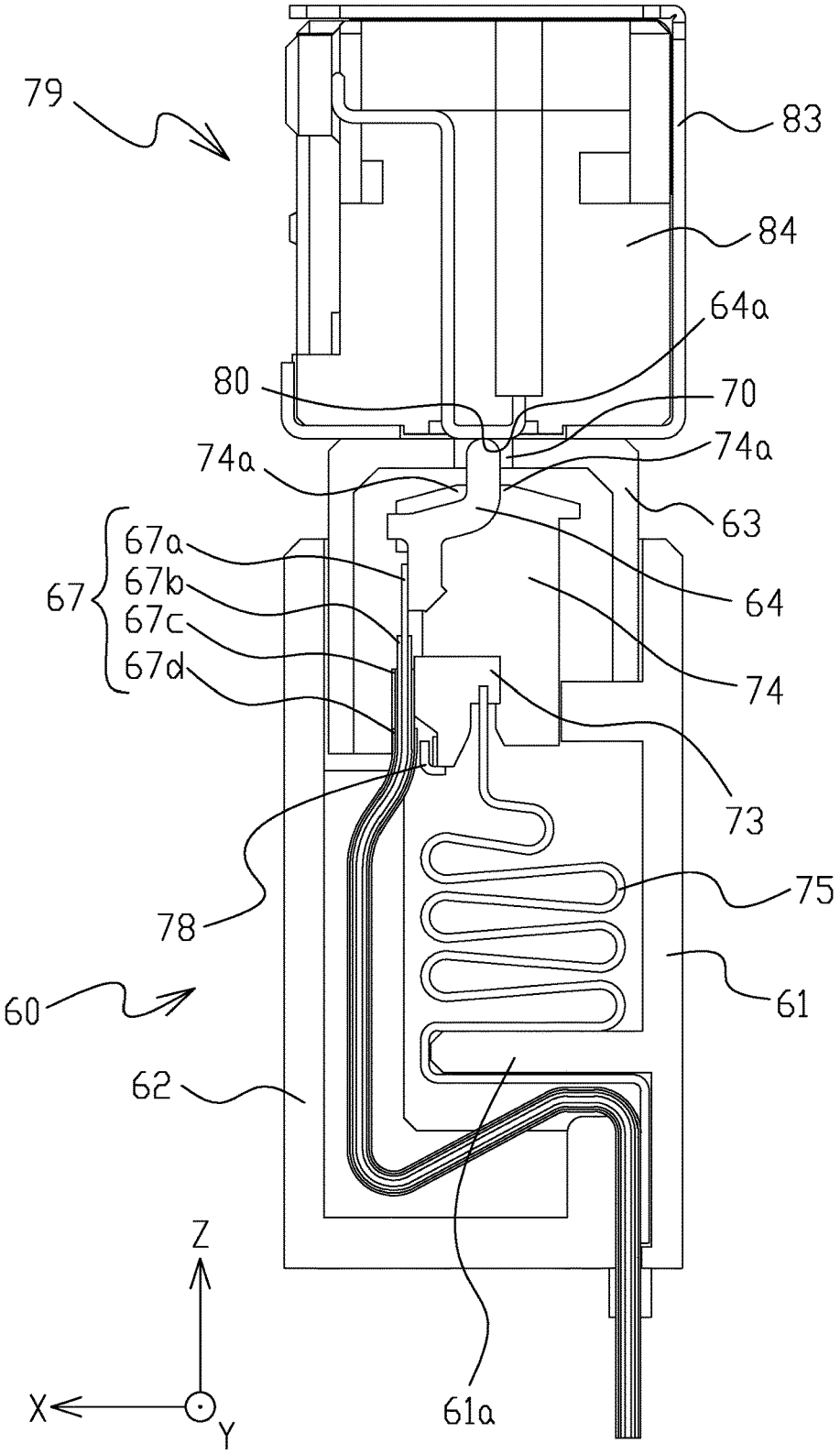
FIG. 26 is a cross-sectional view showing how the first connector and the second connector included in the connector according to the second embodiment are coupled.

FIG. 25 is an external perspective view showing how the first connector 60 and the second connector 79 are coupled, and FIG. 26 is a cross-sectional view thereof. As shown in FIGS. 25 and 26, when the second connector 79 is completely pressed against the first connector 60 (final coupled state), the position of the first contact portion 64*a* in the Z direction is on substantially the same plane as the surface of the protection member 63 on the +Z direction side (pressing surface against which the first connection terminal 80 and the second connection terminal 81 are pressed). The first elastic member 75 stops being compressed in the Z direction and pushes up the first holding member 74 in the +Z direction. The pressing portion 74*a* of the first holding member 74 separates from the back surface of the protection member 63 around the second opening 70 and does not press the protection member 63.

In the first connector 60 included in the connector according to the second embodiment, the first contact 64 and the first elastic member 75 (the second contact 65 and the second elastic member 77) are formed separately, not integrally. Therefore, the design freedom of the connector can be enhanced. In other words, in a terminal in which the contact and the elastic member are integrated, the size and shape of the terminal, and hence the size and shape of the connector are heavily restricted, thus lowering the design freedom. According to the second embodiment, however, since the contact and the elastic member are formed separately, the design freedom concerning the size and shape of the contact increases, and thus the design freedom concerning the size and shape of the connector increases. An increase in the design freedom in turn makes it possible to make the connector compact.

Furthermore, since the design freedom concerning the size and shape of the contact increases, the structure of the contact and a transmission path of the connector can be simplified, and impedance matching for high-speed transmission can be easily performed. That is, it is possible to simplify the cross section of the connector that affects the impedance (the plane perpendicular to the transmission path of the connector) and to reduce the kinds of the cross sections of the connector. Therefore, the impedance can be easily adjusted using a coaxial cable matching the target impedance.

In the first connector 60 included in the connector according to the second embodiment, the first contact 64 and the first elastic member 75 (the second contact 65 and the second elastic member 77) are formed separately, not integrally. Therefore, the structure can be simplified compared with that of a terminal in which a contact and an elastic member are integrated. The first shield member 67*c* of the first coaxial cable 67 connected to the first contact 64 and the second shield member 68*c* of the second coaxial cable 68 connected to the second contact 65 are connected to the ground via the ground terminal 73, the grounding connection member 78, and the second contact 65. Therefore, the ground can be reinforced and high-speed transmission characteristics can be improved. Since the adjacent first shield members 67*c* are electrically connected via the ground terminal 73 and the grounding connection member 78, the ground can be reinforced and high-speed transmission characteristics can be improved. Since the first shield member 67*c*, the second shield member 68*c*, the first elastic member 75, and the second elastic member 77 are electrically connected via the ground terminal 73 and the second contact 65, the ground can be reinforced and high-speed transmission characteristics can be improved. Since the second contacts 65 are disposed with the first contacts 64 adjacent to each other interposed therebetween, the ground can be reinforced and high-speed transmission characteristics can be improved.

In the first connector 60 included in the connector according to the second embodiment, the protection member 63 protects the first contact portion 64*a* and the second contact portion 65*a*. Therefore, it is possible to provide a connector that is inexpensive and difficult to break down. For example, since the first contact portion 64*a* and the second contact portion 65*a* are protected by the protection member 63, even when a finger, a pen tip or the like touches the first connector 60 by mistake, deformation of the first contact portion 64*a* and the second contact portion 65*a* due to contact with a finger, a pen tip or the like can be prevented. In addition, the first contact portion 64*a* and the second contact portion 65*a* can be brought into contact with the first connection terminal 80 and the second connection terminal 81 respectively with a sufficient pressing force in the final coupled state.

In the above-described second embodiment, there is provided the grounding connection member 78 that electrically connects the adjacent first shield members 67*c* and electrically connects the first shield member 67*c* and the second shield member 68*c*. However, it is also possible to provide a first connection member that electrically connects the adjacent first shield members 67*c* and a second connection member (separately from the first connection member) that electrically connects the first shield member 67*c* and the second shield member 68*c*.

Figure 27:
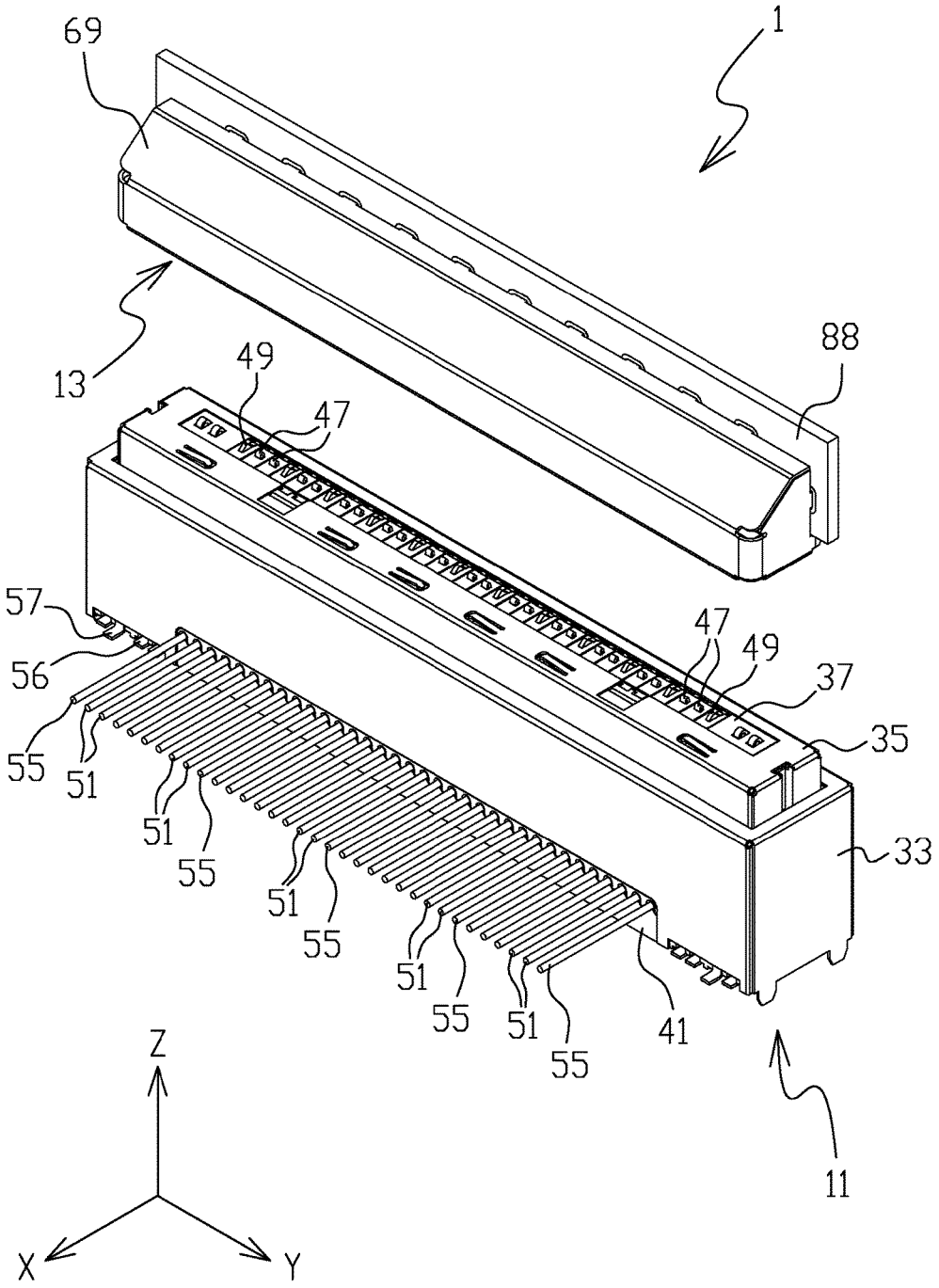
FIG. 27 is a perspective view showing an external appearance of a connector according to a third embodiment.

Next, a connector according to a third embodiment will be described with reference to the drawings. FIG. 27 is a perspective view showing an external appearance of the connector according to the third embodiment. As shown in FIG. 27, the connector 1 according to the third embodiment includes a first connector 11 mounted on, for example, a peripheral device such as a keyboard and a second connector 13 mounted on an external device such as a portable information terminal. The connector 1 is a press-type connector that is electrically connected to the first connector 11 when the second connector 13 is pressed in a predetermined direction (−Z direction to be described later). In the following description, the XYZ orthogonal coordinate system shown in FIG. 27 is set, and the positional relationship and the like of each member will be described with reference to this orthogonal coordinate system. The Y axis is set to be parallel to a direction in which a first contact 47 and a second contact 49 described later are arranged. The Z axis is set to be parallel to a direction of pressing the second connector 13 against the first connector 11. The X axis is set in a direction orthogonal to the YZ plane.

Figure 28:
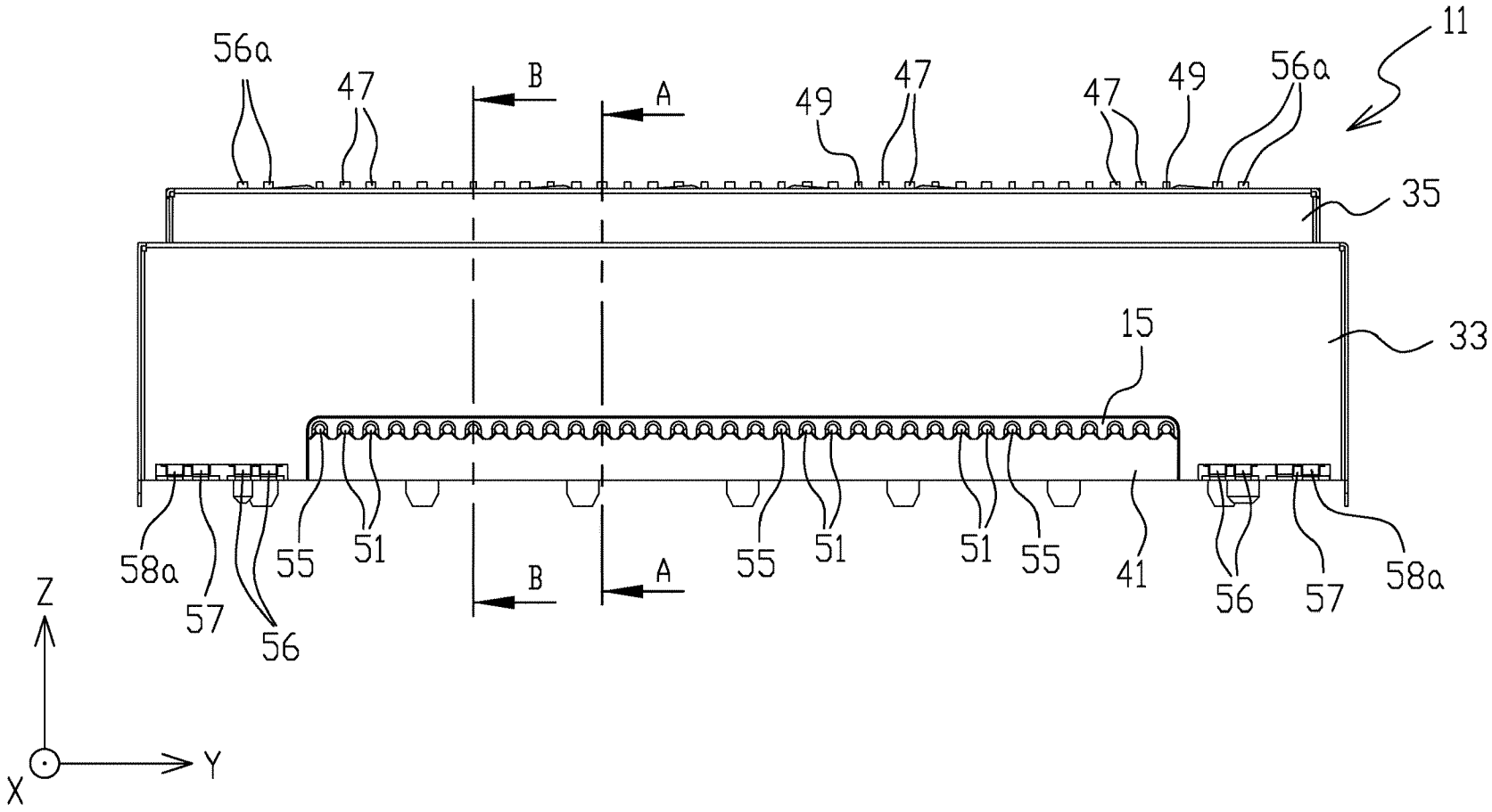
FIG. 28 is a front view showing an external appearance of a first connector included in the connector according to the third embodiment.
Figure 29:
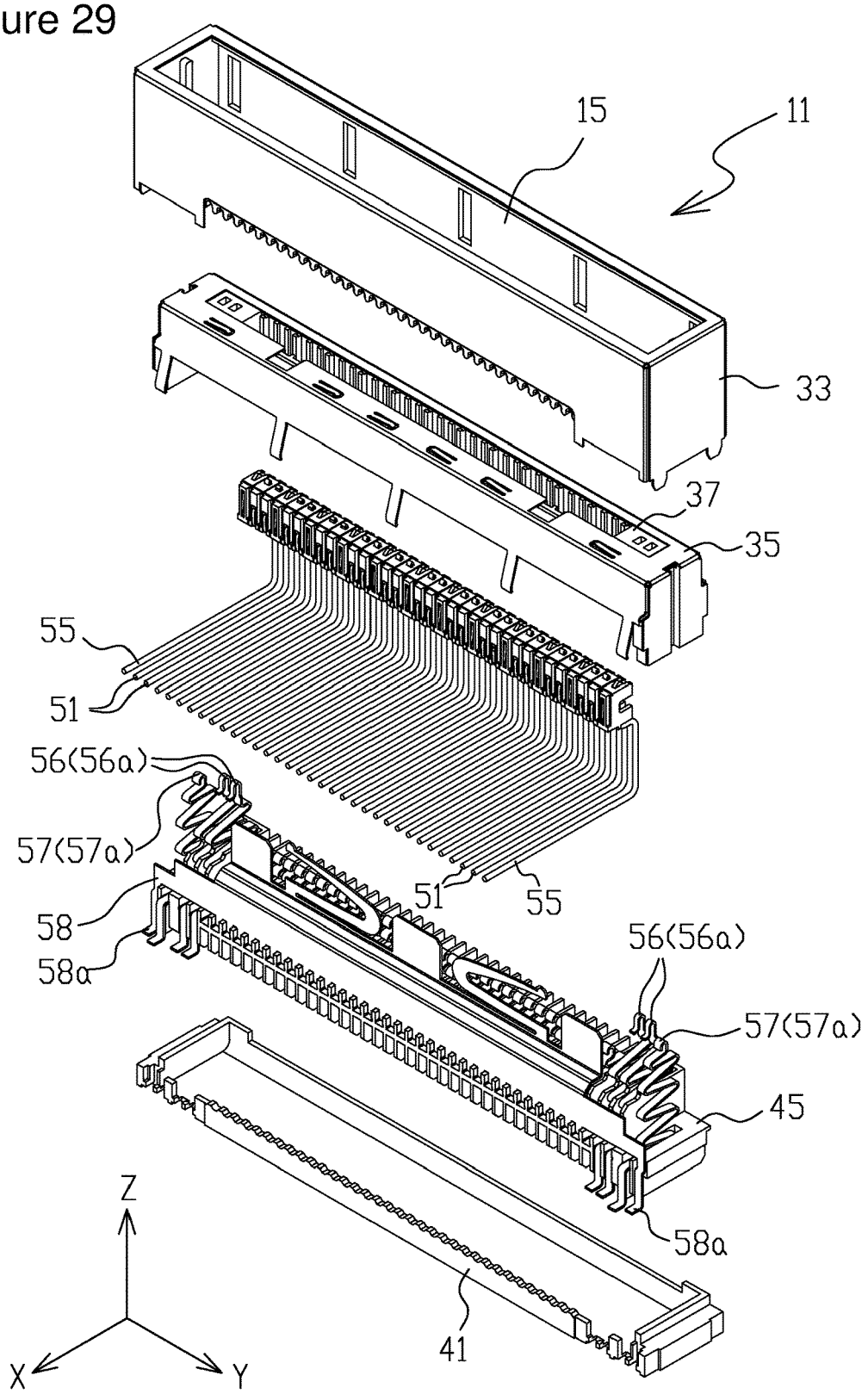
FIG. 29 is an exploded view showing a configuration of the first connector according to the third embodiment.

FIG. 28 is a front view showing an external appearance of the first connector 11. FIG. 29 is an exploded view showing a configuration of the first connector 11. As shown in FIGS. 28 and 29, the first connector 11 includes a first shell 33, a first base body 15, a second shell 35, a protection member 37, a plurality of (twenty-two in the third embodiment) first contacts 47, a plurality of (twelve in the third embodiment) second contacts 49, a plurality of (twenty-two in the third embodiment) first coaxial cables 51, a plurality of (twelve in the third embodiment) second coaxial cables 55, four third contacts 56, two fourth contacts 57, a second base body 45, a metal plate 58, and a cover 41.

Figure 30:
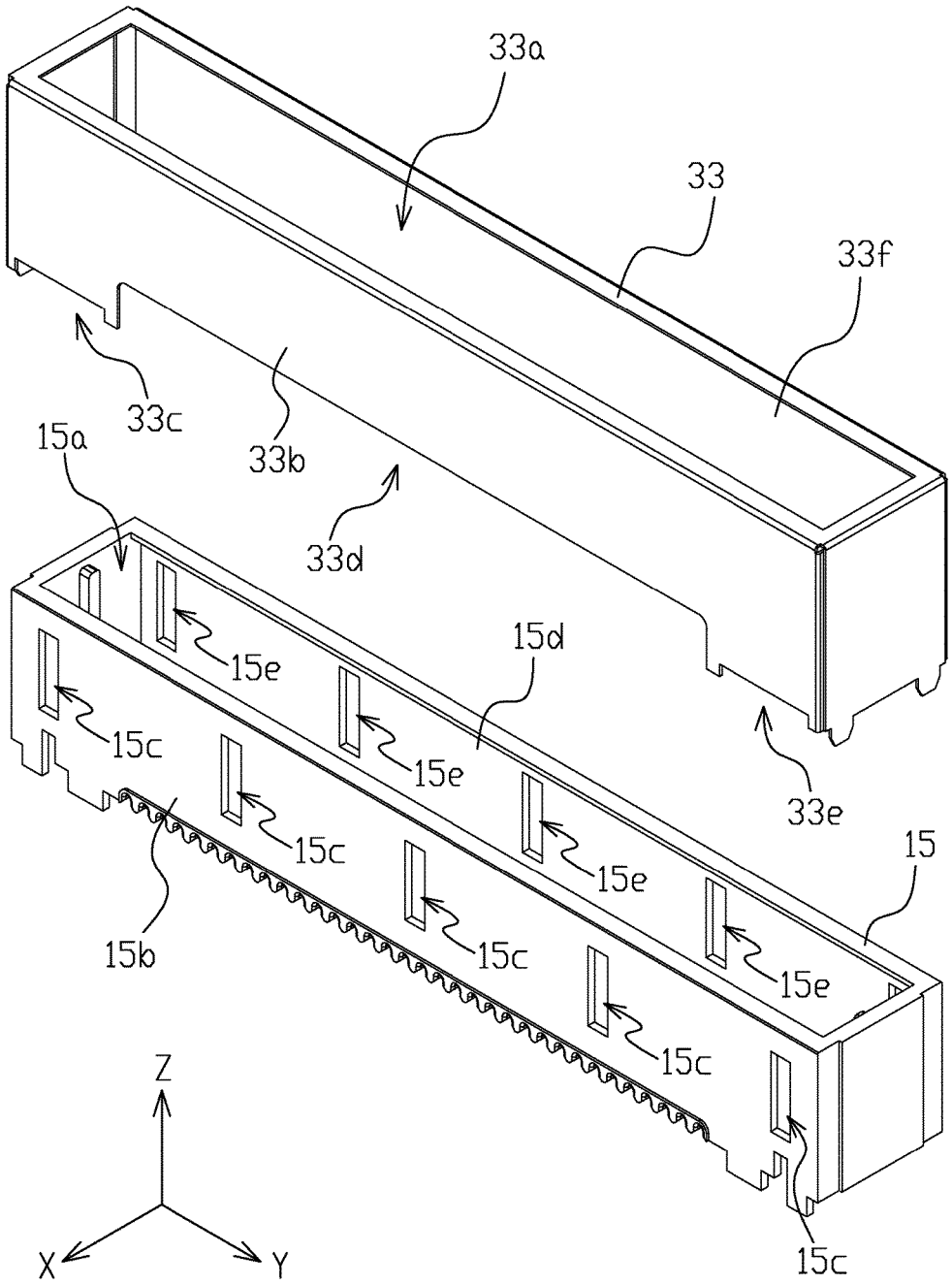
FIG. 30 is a view showing configurations of a first shell and a first base body included in the first connector according to the third embodiment.

FIG. 30 is a view showing configurations of the first shell 33 and the first base body 15. The first shell 33 includes a conductive member, for example, metal, and covers the outside of the first base body 15 as shown in FIGS. 28 and 29. As shown in FIG. 30, a rectangular opening 33*a* is provided in the surface of the first shell 33 on the +Z direction side. The second shell 35 and the protection member 37 protrude in the +Z direction through the opening 33*a* via a first opening 15*a* of the first base body 15 (see FIG. 30). Three openings 33*c*, 33*d*, and 33*e* are provided, on the −Z direction side, in a side surface 33*b* of the first shell 33 on the +X direction side. As shown in FIG. 27, the third contact 56, the fourth contact 57, and a terminal 58*a* extending from the metal plate 58 are exposed through each of the openings 33*c* and 33*e*. As shown in FIG. 27, the first coaxial cables 51 and the second coaxial cables 55 are led out from inside the first base body 15 to the outside of the first connector 11 through the opening 33*d*.

The first base body 15 includes an insulative member, for example, resin, and accommodates the protection member 37, the first contact 47, the second contact 49, the third contact 56, the fourth contact 57, the first coaxial cable 51, the second coaxial cable 55, and the metal plate 58. The rectangular first opening 15*a* is formed in the upper surface (+Z direction side) of the first base body 15. The second shell 35 and the protection member 37 protrude in the +Z direction through the first opening 15*a*. Five openings 15*c* are provided in a side surface 15*b* of the first base body 15 on the +X direction side, and five openings 15*e* are provided in a side surface 15*d* of the first base body 15 on the −X direction side. The openings 15*c* and 15*e* are rectangular openings having a longitudinal direction in the Z direction. Elastic bodies 35*d* (see FIG. 31) and elastic bodies (not shown) of the second shell 35 are disposed in the openings 15*c* and 15*e*. The side surface 15*b* of the first base body 15 on the +X direction side has an opening; by attaching the cover 41 to the first base body 15, an end portion of the third contact 56, an end portion of the fourth contact 57, and the terminal 58*a* extending from the metal plate 58 are fixed to and exposed through this opening. The side surface 15*b* of the first base body 15 on the +X direction side has another opening; by attaching the cover 41 to the first base body 15, the first coaxial cable 51 and the second coaxial cable 55 are fixed to this opening and led out from inside the first base body 15 to the outside of the first connector 11 through this opening.

Figure 31:
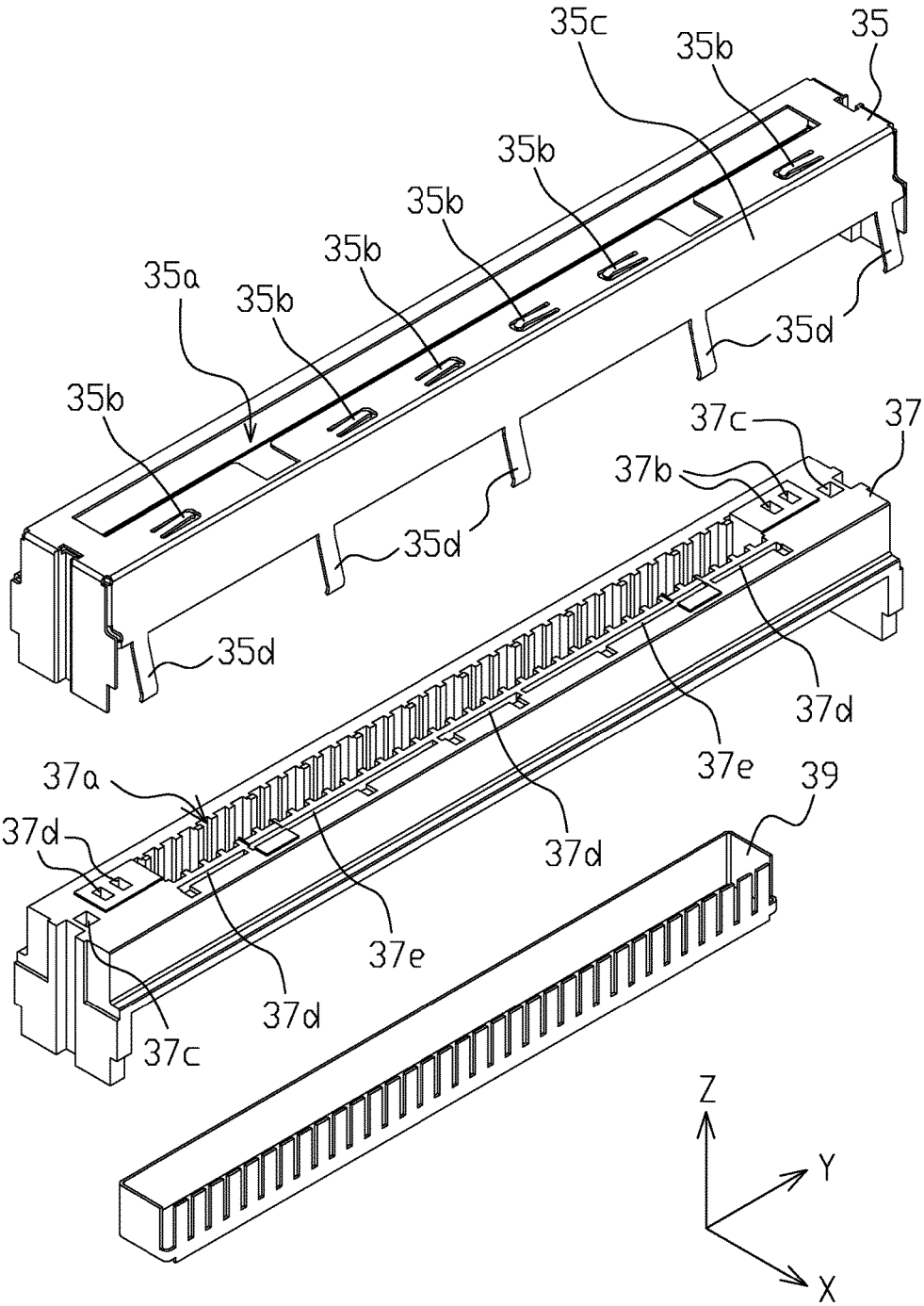
FIG. 31 is a view showing configurations of a second shell, a protection member, and a shorting jumper included in the first connector according to the third embodiment.

FIG. 31 is a view showing configurations of the second shell 35, the protection member 37, and a jumper plate 39 incorporated in the protection member 37. The second shell 35 includes a conductive member, for example, metal, and covers the outside of the protection member 37 as shown in FIGS. 28 and 29. The second shell 35 is configured to be movable, together with the protection member 37, in the ±Z direction with respect to the first base body 15 and the second base body 45. The second shell 35 moves along with the movement of the second connector 13 (see FIG. 27). Before the second connector 13 comes in contact with the second shell 35, as shown in FIG. 27, the second shell 35 is disposed while protruding from the upper surface of the first base body 15 (first shell 33).

As shown in FIG. 31, an opening 35*a* is provided in a surface of the second shell 35 on the +Z direction side (surface against which the second connector 13 is pressed). The first contact 47 and the second contact 49 protrude in the +Z direction through the opening 35*a* via an opening 37*a* (see FIG. 31) of the protection member 37, and the third contact 56 protrudes through the opening 35*a* via an opening 37*b* (see FIG. 31) of the protection member 37. Furthermore, the metal plate 58 is exposed through the opening 35*a* in the +Z direction via a through hole 37*e* (see FIG. 31) of the protection member 37.

As shown in FIG. 31, six elastic bodies 35*b* are provided on the surface of the second shell 35 on the +Z direction side (surface against which the second connector 13 is pressed). When the second connector 13 is pressed against the first connector 11 in the −Z direction, the elastic body 35*b* is electrically connected to the shell 69 of the second connector 13 by pushing up, in the +Z direction, a surface of the shell 69 of the second connector 13 on the −Z direction side (see FIG. 35). The five elastic bodies 35*d* extending in the −Z direction are provided on a side surface 35*c* of the second shell 35 on the +X direction side. Five elastic bodies (not shown) extending in the −Z direction are provided on a side surface of the second shell 35 on the −X direction side. The elastic body 35*d* is electrically connected to the first shell 33 by pressing the side surface 33*b* of the first shell 33 on the +X direction side in the +X direction by the elastic force via the opening 15*c* (see FIG. 30) of the first base body 15. Likewise, the elastic body (not shown) is electrically connected to the first shell 33 by pressing the side surface 33*f* (see FIG. 30) of the first shell 33 on the −X direction side in the −X direction by the elastic force via the opening 15*e* (see FIG. 30) of the first base body 15.

The protection member 37 includes an insulative member, for example, resin, and protects the first contact portion 47*a* of the first contact 47 (see FIG. 32), the second contact portion 49*a* of the second contact 49 (see FIG. 33), and the third contact portion 56*a* of the third contact 56 (see FIG. 28) by covering the periphery of the first contact 47, the second contact 49, and the third contact 56. The protection member 37 is configured to be movable, together with the second shell 35, in the ±Z direction with respect to the first base body 15 and the second base body 45, and moves along with the movement of the second connector 13 (see FIG. 27). Before the second connector 13 comes in contact with the protection member 37, as shown in FIG. 27, the protection member 37 is disposed while protruding from the upper surface of the first base body 15 (first shell 33).

As shown in FIG. 31, the opening 37*a* is provided in a surface of the protection member 37 on the +Z direction side (surface against which the second connector 13 is pressed). The first contact portion 47*a* of the first contact 47 and the second contact portion 49*a* of the second contact 49 protrude in the +Z direction through the opening 37*a*. As shown in FIG. 31, four openings 37*b* and two openings 37*c* are also provided in the surface of the protection member 37 on the +Z direction side. The third contact portion 56*a* of the third contact 56 protrudes in the +Z direction through the opening 37*b*, and the fourth contact portion 57*a* of the fourth contact 57 (refer to FIG. 29) protrudes in the +Z direction through the opening 37*c*. Furthermore, as shown in FIG. 31, three through holes 37*d* and two through holes 37*e* are provided in the surface of the protection member 37 on the +Z direction side. A first protruding portion 58*b* extending from the metal plate 58 (see FIG. 34) is disposed in, and protrudes in the +Z direction through, the through hole 37*d*. A second protruding portion 58*c* extending from the metal plate 58 (see FIG. 34) is disposed in, and protrudes in the +Z direction through, the through hole 37*e*.

Figure 32:
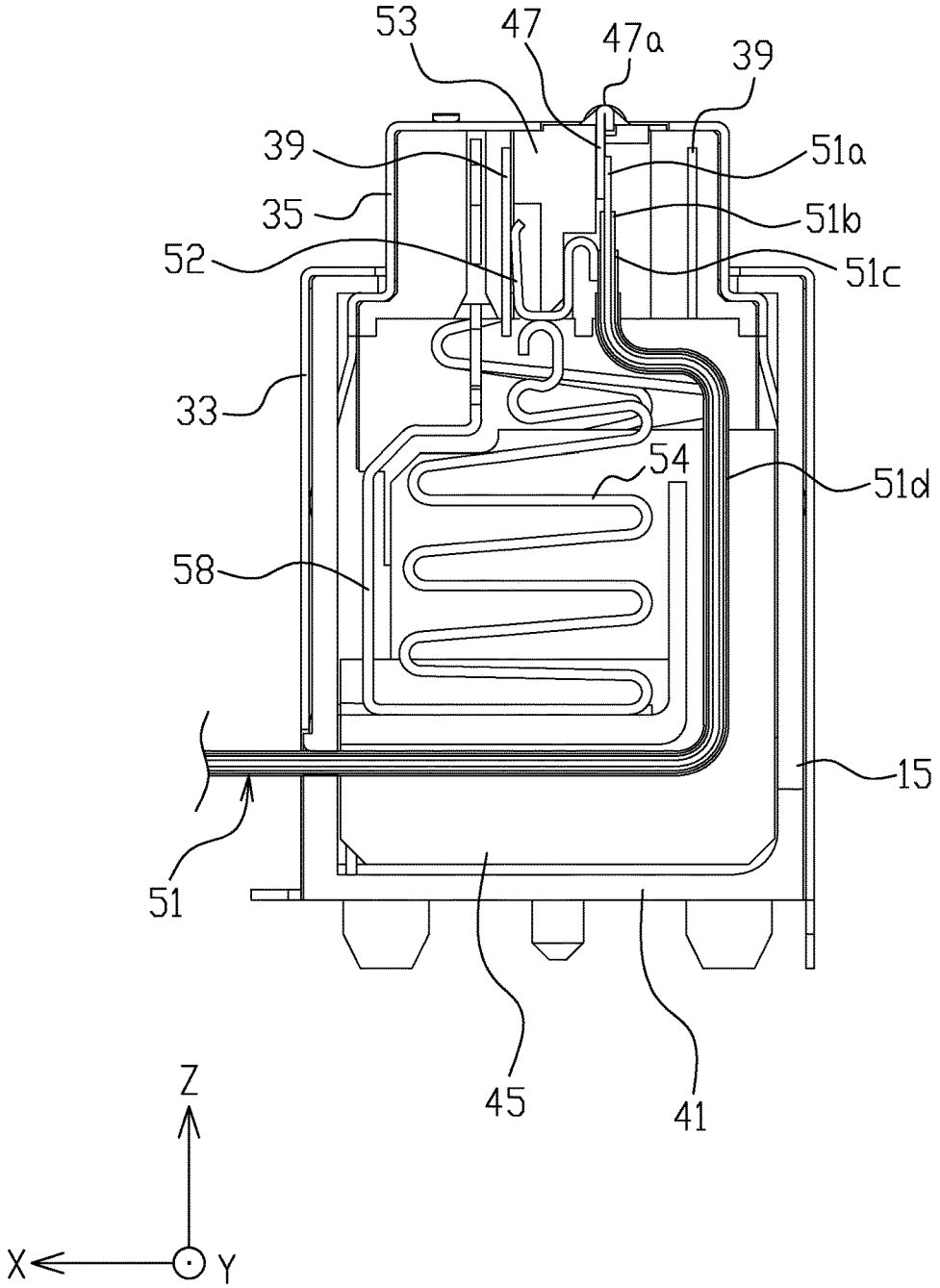
FIG. 32 is a cross-sectional view showing the configuration of the first connector according to the third embodiment.

FIG. 32 is a cross-sectional view taken along line A-A in FIG. 28. The jumper plate 39 includes a conductive member, for example, metal, and is incorporated in the protection member 37 as shown in FIG. 32. The jumper plate 39 has a shape that surrounds the periphery of the plurality of first contacts 47 and the plurality of second contacts 49. A side surface of the jumper plate 39 on the +X direction side is formed in a comb shape. As shown in FIG. 32, each of the comb teeth of the jumper plate 39 is electrically connected to a ground terminal 52 described later or the second contact 49 (see FIG. 33). That is, the ground terminals 52 are electrically connected to each other via the jumper plate 39, and the ground terminal 52 and the second contact 49 are electrically connected to each other via the jumper plate 39. The jumper plate 39 may have a shape other than that shown in FIG. 31, as long as the jumper plate 39 is electrically connected to the ground terminal 52 and the second contact 49.

As shown in FIG. 32, the first contact 47 includes the first contact portion 47*a* that is electrically connected to the first connection terminal 82 (see FIG. 35) of the second connector 13 when the first connection terminal 82 is pressed in the −Z direction. Two first contacts 47 are disposed adjacent to each other along the Y direction, and eleven pairs of two adjacent first contacts 47 are arranged along the Y direction. As shown in FIG. 32, a first core wire 51*a* of the first coaxial cable 51 is electrically connected to the first contact 47 by soldering, for example.

The first coaxial cable 51 includes the first core wire 51*a*, a first inner insulator 51*b* covering the first core wire 51*a*, a first shield member 51*c* including a conductor and covering the first core wire 51*a* via the first inner insulator 51*b*, and a first outer insulator 51*d* covering the first shield member 51*c*. The first inner insulator 51*b* electrically insulates the first core wire 51*a* from the first shield member 51*c*. The first shield member 51*c* functions as a grounding conductor (first grounding conductor) and is connected to the ground. The impedance between the first core wire 51*a* and the first shield member 51*c* is matched. The first coaxial cable 51 is fixed to the second base body 45 while being deflected within the second base body 45 by a length corresponding to the moving distance of a first holding member 53 to be described later in the Z direction and by a length corresponding to the moving distance of the protection member 37 in the Z direction.

Furthermore, as shown in FIG. 32, the ground terminal 52 including a conductor, the first holding member 53 including an insulator, and a first elastic member 54 including a conductor are provided in an internal space formed by the first base body 15, the second base body 45, and the protection member 37. As shown in FIG. 32, the ground terminal 52 is disposed in the vicinity of the first contact 47 and held by the first holding member 53. An end portion of the ground terminal 52 on the −X direction side is electrically connected to the first shield member 51*c* of the first coaxial cable 51. An end portion of the ground terminal 52 on the +X direction side is an elastic body, and presses one of the comb teeth of the jumper plate 39 in the +X direction by an elastic force. That is, the ground terminal 52 and the jumper plate 39 are electrically connected. Even if each of the first holding members 53 (first contact portions 47*a*) individually moves in the Z direction, the ground terminal 52 and the jumper plate 39 can remain connected by the elastic force of the elastic body included in the ground terminal 52. Instead of the elastic body of the ground terminal 52, the comb teeth of the jumper plate 39 may be made elastic, in which case the ground terminal 52 and the jumper plate 39 are electrically connected by pressing the ground terminal 52 by the elastic force of the comb teeth.

As shown in FIG. 32, the first holding member 53 holds the first contact 47 and the ground terminal 52, and is movable in the ±Z direction. That is, the first contact 47 moves in the ±Z direction along with the movement of the first holding member 53, and thus the position of the first contact portion 47*a* of the first contact 47 in the Z direction also changes. The first contact 47 and the first holding member 53 can move in the +Z direction until the upper surface of the first holding member 53 on the +Z direction side is locked with the back surface of the second shell 35 around the opening 35*a*, and can move in the −Z direction until the first contact portion 47*a* is located on substantially the same plane as the upper surface (+Z direction side) of the second shell 35 (protection member 37).

The first holding member 53 includes a pressing portion that presses the second shell 35 upward (+Z direction). The pressing portion of the first holding member 53 presses the second shell 35 upward (+Z direction) by an elastic force of the first elastic member 54 before the second connector 13 is pressed (initial state). After the second connector 13 is pressed (final coupled state), the pressing portion does not come in contact with or press the second shell 35. That is, in transition from the initial state to the final coupled state, the pressing portion of the first holding member 53 is initially brought into contact with and presses the second shell 35, and then gradually separates from the second shell 35 and ceases pressing the second shell 35.

The first elastic member 54 includes a conductive member, and as shown in FIG. 32, the tip portion of the first elastic member 54 on the +Z direction side is connected to the ground terminal 52. That is, the first shield member 51*c* of the first coaxial cable 51 and the first elastic member 54 are electrically connected via the ground terminal 52. An end portion of the first elastic member 54 on the −Z direction side is held by the second base body 45. As shown in FIGS. 29 and 32, the first elastic member 54 is formed integrally with the metal plate 58. In addition, the first elastic member 54 is formed separately from the first contact 47, and presses the first contact 47 and the protection member 37 in the +Z direction via the ground terminal 52 and the first holding member 53.

Figure 33:
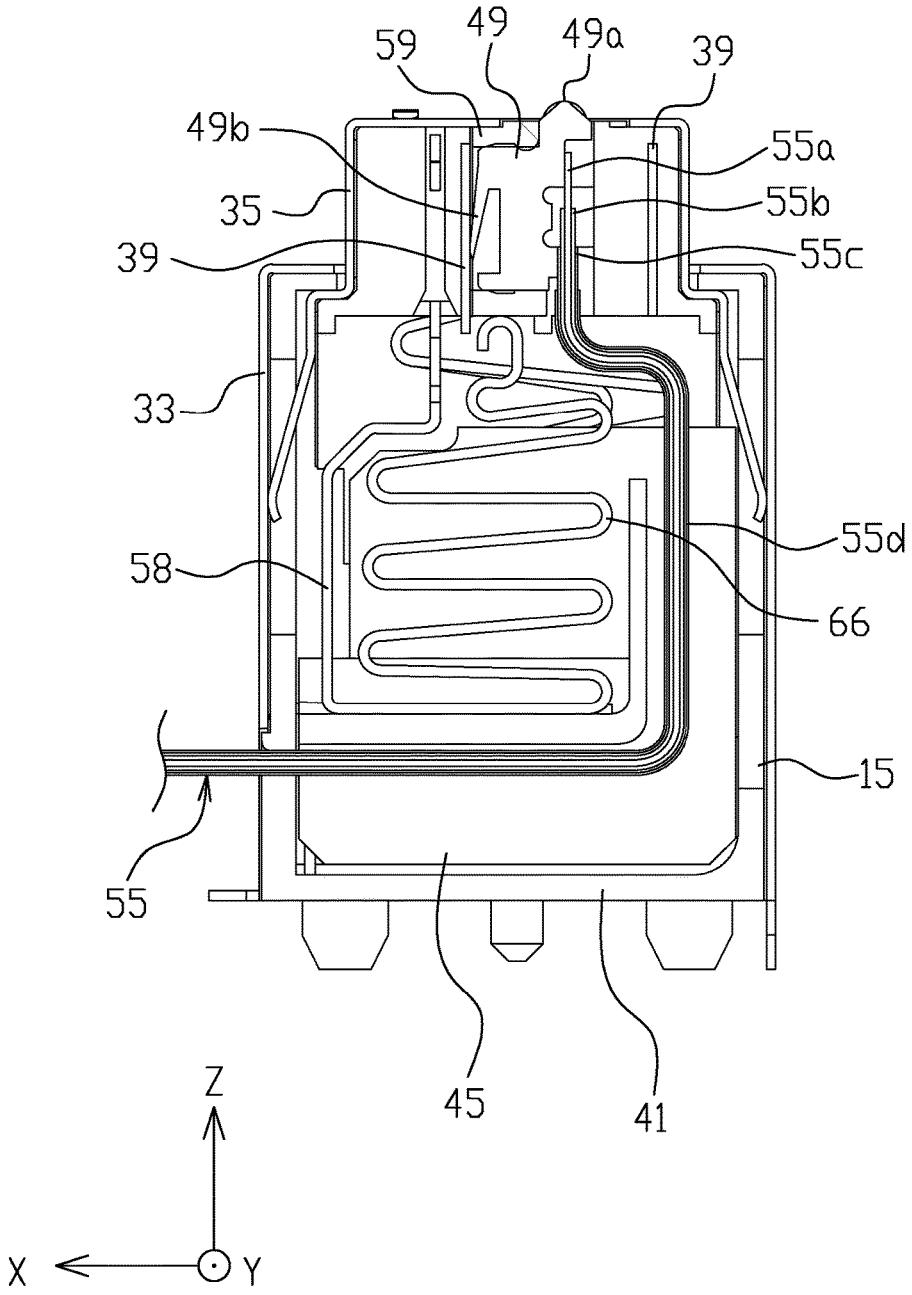
FIG. 33 is a cross-sectional view showing the configuration of the first connector according to the third embodiment.

FIG. 33 is a cross-sectional view taken along line B-B in FIG. 28. As shown in FIG. 33, the second contact 49 includes the second contact portion 49*a* that is electrically connected to the second connection terminal 86 (see FIG. 35) of the second connector 13 when the second connection terminal 86 is pressed in the −Z direction. The second contacts 49 are disposed with the two first contacts 47 adjacent to each other interposed therebetween, and the twelve second contacts 49 are arranged along the Y direction. The impedance between the first contact 47 and the second contact 49 is matched.

As shown in FIG. 33, a second core wire 55*a* and a second shield member 55*c* of the second coaxial cable 55 are electrically connected to the second contact 49 by soldering, for example. The second coaxial cable 55 includes the second core wire 55*a*, a second inner insulator 55*b* covering the second core wire 55*a*, the second shield member 55*c* including a conductor and covering the second core wire 55*a* via the second inner insulator 55*b*, and a second outer insulator 55*d* covering the second shield member 55*c*. The second inner insulator 55*b* electrically insulates the second core wire 55*a* from the second shield member 55*c*. The impedance between the second core wire 55*a* and the second shield member 55*c* is matched. The second core wire 55*a* and the second shield member 55*c* each function as a grounding conductor (second grounding conductor) and are connected to the ground. The second coaxial cable 55 is fixed to the second base body 45 while being deflected within the second base body 45 by a length corresponding to the moving distance of a second holding member 59 to be described later in the Z direction and by a length corresponding to the moving distance of the protection member 37 in the Z direction. The second coaxial cable 55 and the above-described first coaxial cable 51 function as wiring members.

The second contact 49 includes an elastic body 49*b* on the +X direction side, and the elastic body 49*b* presses one of the comb teeth of the jumper plate 39 in the +X direction by an elastic force. In other words, the second contact 49 and the jumper plate 39 are electrically connected, and thus the ground terminal 52 and the second contact 49 are electrically connected by being pressed against the jumper plate 39. The second contact 49 and the jumper plate 39 are connected by the elastic force of the elastic body 49*b*. Therefore, even when each of the second holding members 59 (second contact portions 49*a*) individually moves in the Z direction, the second contact 49 and the jumper plate 39 can remain connected. Instead of the elastic body 49*b*, the comb teeth of the jumper plate 39 may be made elastic, in which case the second contact 49 and the jumper plate 39 are electrically connected by pressing the second contact 49 by the elastic force of the comb teeth.

Furthermore, as shown in FIG. 33, the second holding member 59 including an insulator and a second elastic member 66 including a conductor are provided in the internal space formed by the first base body 15, the second base body 45, and the protection member 37. As shown in FIG. 33, the second holding member 59 holds the second contact 49 and is movable in the ±Z direction. That is, the second contact 49 moves in the ±Z direction along with the movement of the second holding member 59, and thus the position of the second contact portion 49*a* of the second contact 49 in the Z direction also changes. The second contact 49 and the second holding member 59 can move in the +Z direction until the upper surface of the second holding member 59 on the +Z direction side is locked with the back surface of the second shell 35 around the opening 35*a*, and can move in the −Z direction until the second contact portion 49*a* is located on substantially the same plane as the upper surface (+Z direction side) of the second shell 35 (protection member 37).

The second holding member 59 includes a pressing portion that presses the second shell 35 upward (+Z direction). The pressing portion of the second holding member 59 presses the second shell 35 upward (+Z direction) by an elastic force of the second elastic member 66 before the second connector 13 is pressed (initial state). After the second connector 13 is pressed (final coupled state), the pressing portion does not come in contact with or press the second shell 35. That is, in transition from the initial state to the final coupled state, the pressing portion of the second holding member 59 is initially brought into contact with and presses the second shell 35, and then gradually separates from the second shell 35 and ceases pressing the second shell 35.

The second elastic member 66 includes a conductive member. As shown in FIG. 33, the tip portion of the second elastic member 66 on the +Z direction side is in contact with the second holding member 59, and pushes up the second holding member 59 in the +Z direction. As shown in FIGS. 29 and 33, the second elastic member 66 is formed integrally with the metal plate 58. That is, the first elastic member 54 and the second elastic member 66 are electrically connected via the metal plate 58. An end portion of the second elastic member 66 on the −Z direction side is held by the second base body 45. The second elastic member 66 is formed separately from the second contact 49, and presses the second contact 49 and the protection member 37 in the +Z direction. The tip portion of the second elastic member 66 on the +Z direction side may come in contact with the second contact 49. In this case, the second shield member 55*c* of the second coaxial cable 55 and the second elastic member 66 are electrically connected via the second contact 49, and thus the metal plate 58 is electrically connected to the second shield member 55*c* via the second elastic member 66 and the second contact 49.

Figure 34:
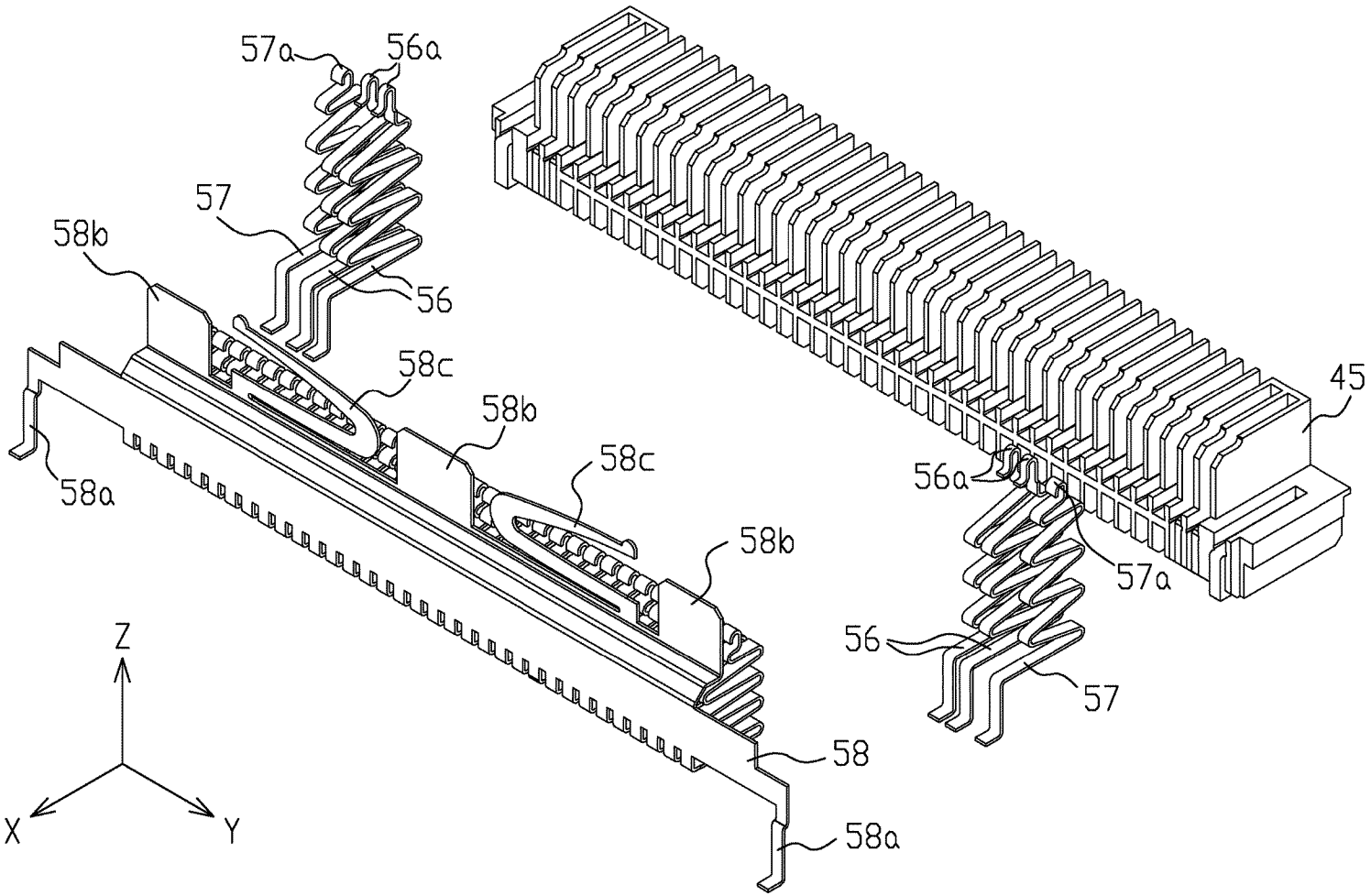
FIG. 34 is a view showing configurations of a second base body, a third contact, a fourth contact, and a metal plate included in the first connector according to the third embodiment.

FIG. 34 is a view showing the configurations of the second base body 45, the third contact 56, the fourth contact 57, and the metal plate 58. As shown in FIG. 34, a plurality of (twenty-two in the third embodiment) first elastic members 54 and a plurality of (twelve in the third embodiment) second elastic members 66 are formed integrally with the metal plate 58. That is, the plurality of first elastic members 54 and the plurality of second elastic members 66 are electrically connected via the metal plate 58.

The metal plate 58 is disposed in the vicinity of the first contact 47 and the second contact 49 and is fixed to the second base body 45. The metal plate 58 is formed integrally with the first elastic member 54 and the second elastic member 66, as described above. Therefore, the metal plate 58 is electrically connected to the first shield member 51*c* of the first coaxial cable 51 via the first elastic member 54 and the ground terminal 52. As shown in FIG. 34, the metal plate 58 is provided with two terminals 58*a* extending in the −Z direction. The terminals 58*a* are connected to the ground. The metal plate 58 is further provided with three flat-shaped first protruding portions 58*b* extending in the +Z direction and two U-shaped second protruding portions 58*c* extending in the +Z direction. When the second connector 13 is pressed against the first connector 11 in the −Z direction, the first protruding portion 58*b* is connected to the second shell 35 through the through hole 37*d* of the protection member 37. When the second connector 13 is pressed against the first connector 11 in the −Z direction, a tip portion of the second protruding portion 58*c* is connected to a grounding terminal 85*a* (see FIG. 35) of a ground plate 85 included in the second connector 13 through the through hole 37*e* of the protection member 37 and the opening 35*a* of the second shell 35.

As shown in FIG. 34, two third contacts 56 are disposed on the −Y direction side, and another two of them on the +Y direction side. The third contact portion 56*a* is provided at an end portion of the third contact 56 on the +Z direction side, and is connected to a third connection terminal 87 (see FIG. 35) of the second connector 13. The third contact 56 is movable in the ±Z direction, and the position of the third contact portion 56*a* in the Z direction also changes along with the movement of the third contact 56. The third contact 56 can move in the +Z direction until the tip portion of the third contact 56 on the +Z direction side is locked with the back surface of the protection member 37 around the opening 37*b*, and can move in the −Z direction until the third contact portion 56*a* is located on substantially the same plane as the upper surface of the second shell 35 (protection member 37). An end portion of the third contact 56 on the −Z direction side is led out through an opening formed by attaching the cover 41 to the first base body 15.

As shown in FIG. 34, one fourth contact 57 is disposed on the −Y direction side, and another one on the +Y direction side. The fourth contact portion 57*a* is provided at an end portion of the fourth contact 57 on the +Z direction side, and is connected to the second shell 35. The fourth contact 57 is movable in the ±Z direction, and the position of the fourth contact portion 57*a* in the Z direction also changes along with the movement of the fourth contact 57. An end portion of the fourth contact 57 on the −Z direction side is led out through an opening formed by attaching the cover 41 to the first base body 15.

Figure 35:
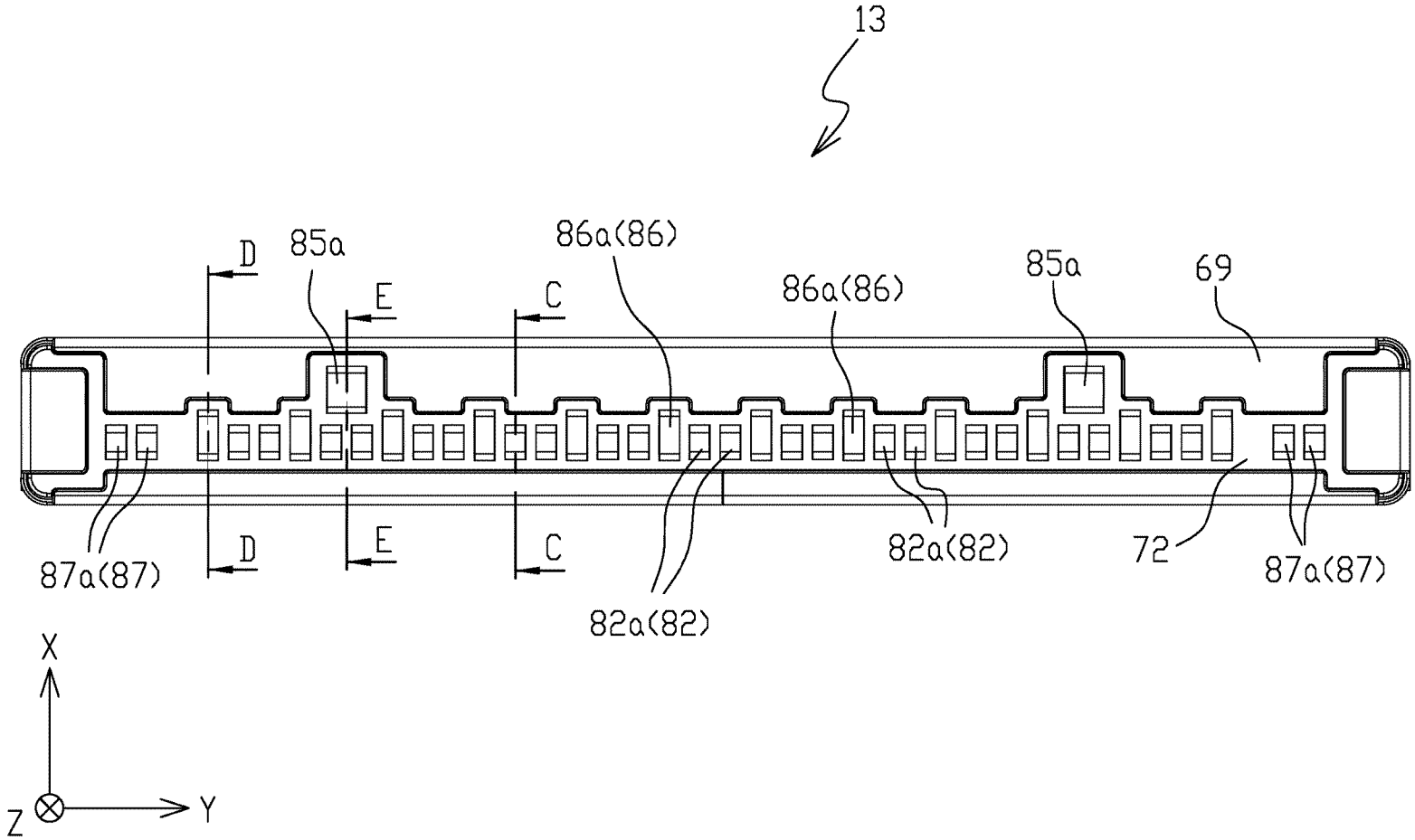
FIG. 35 is a bottom view showing an external appearance of a second connector included in the connector according to the third embodiment.
Figure 36:
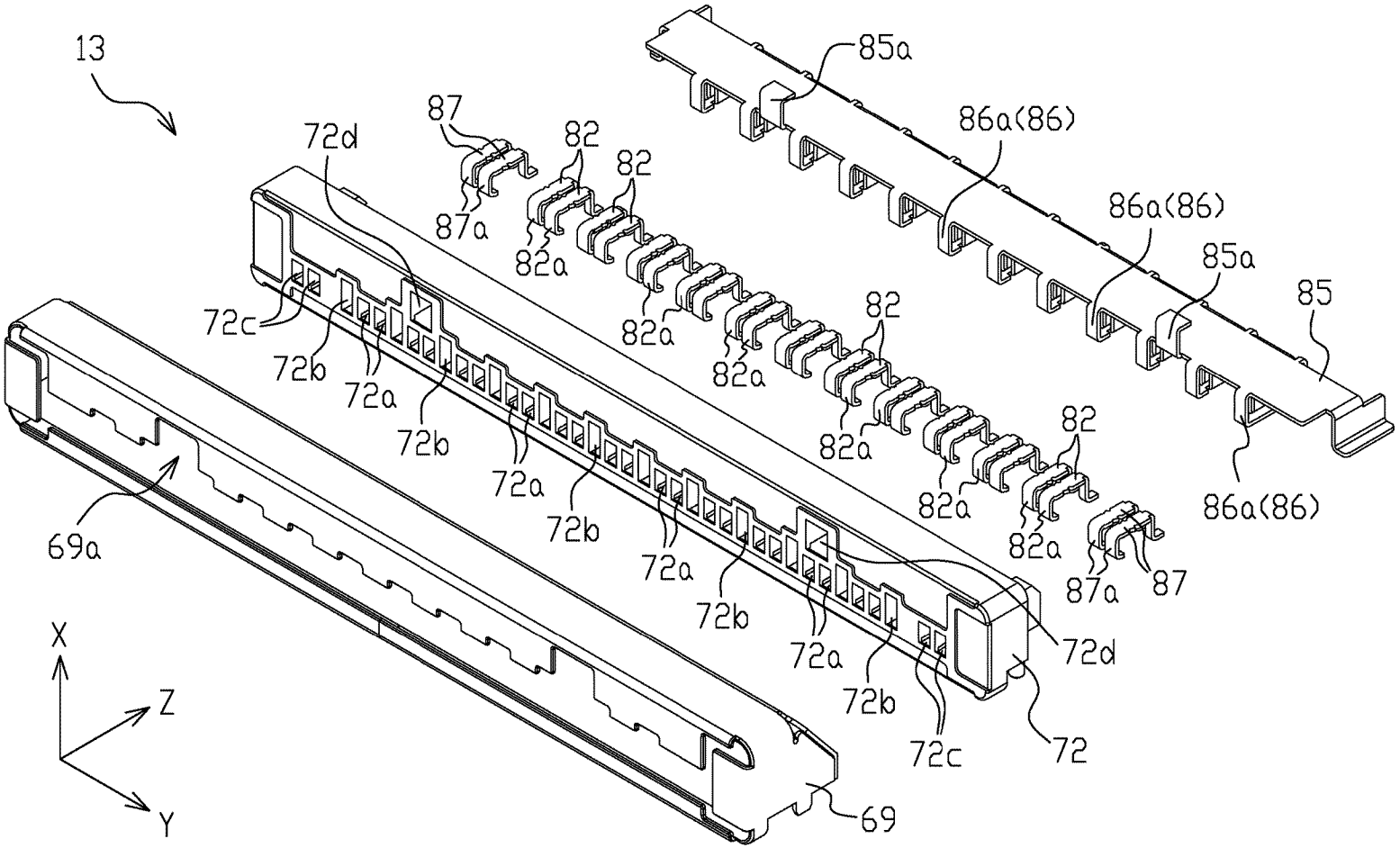
FIG. 36 is an exploded view showing a configuration of the second connector according to the third embodiment.
Figure 37:
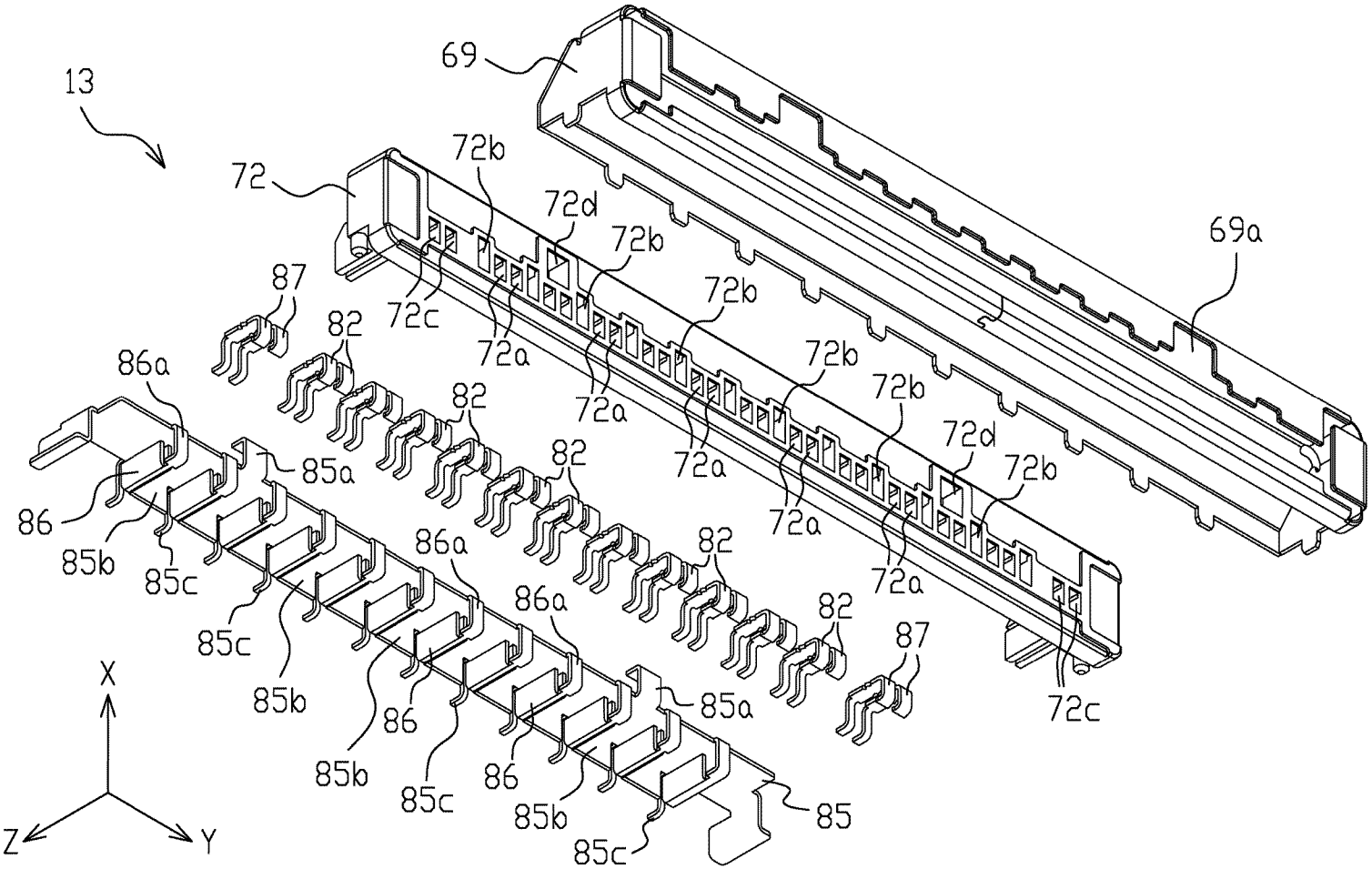
FIG. 37 is an exploded view showing the configuration of the second connector according to the third embodiment.

Next, the second connector 13 included in the connector 1 according to the third embodiment will be described. FIG. 35 is a bottom view showing the external appearance of the second connector 13. FIGS. 36 and 37 are exploded views showing the configuration of the second connector 13. As shown in FIG. 27, the second connector 13 is mounted on a printed circuit 88. As shown in FIGS. 35 to 37, the second connector 13 includes the shell 69, a housing 72, a plurality of (twenty-two in the third embodiment) first connection terminals 82, a plurality of (twelve in the third embodiment) second connection terminals 86, four third connection terminals 87, and the ground plate 85. The shell 69 is formed of a conductive member such as metal and covers the housing 72. As shown in FIG. 36, the shell 69 has an opening 69*a*. A first connection surface 82*a* of the first connection terminal 82, a second connection surface 86*a* of the second connection terminal 86 (see FIG. 35), a third connection surface 87*a* of the third connection terminal 87, and the grounding terminal 85*a* of the ground plate 85 are exposed through the opening 69*a*.

The housing 72 includes an insulative member, for example, resin, and is covered with the shell 69. The housing 72 includes twenty-two openings 72*a* for exposing the first connection surfaces 82*a* of the first connection terminals 82, twelve openings 72*b* for exposing the second connection surfaces 86*a* of the second connection terminals 86, four openings 72*c* for exposing the third connection surfaces 87*a* of the third connection terminals 87, and two openings 72*d* for exposing the grounding terminals 85*a* of the ground plate 85.

Figure 38:
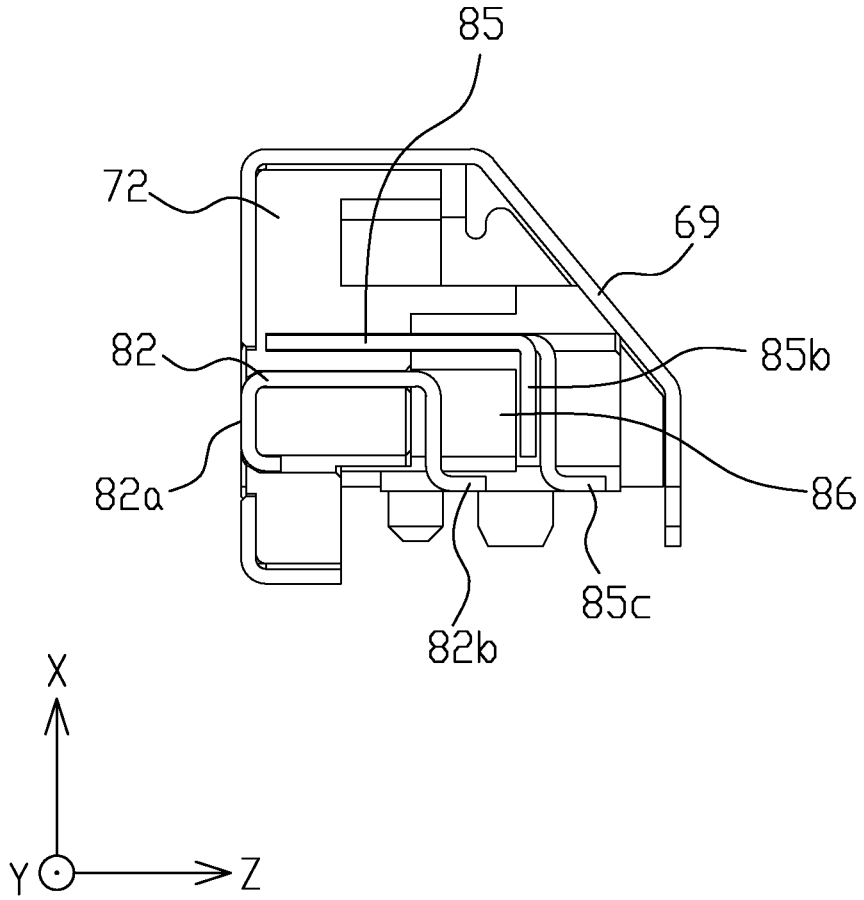
FIG. 38 is a cross-sectional view showing the configuration of the second connector according to the third embodiment.

FIG. 38 is a cross-sectional view taken along line C-C in FIG. 35. As shown in FIG. 38, the first connection terminal 82 includes the first connection surface 82*a* at one end thereof, and is incorporated in the housing 72 while exposing the first connection surface 82*a* in the −Z direction through the opening 72*a* of the housing 72 and the opening 69*a* of the shell 69. When the second connector 13 is pressed against the first connector 11, the first connection surface 82*a* of the first connection terminal 82 is electrically connected to the first contact portion 47*a* (see FIG. 32) of the first contact 47 included in the first connector 11 by being pressed against the first contact portion 47*a*. The other end portion 82*b* of the first connection terminal 82 is mounted on the printed circuit 88. Two first connection terminals 82 are disposed adjacent to each other along the Y direction, and eleven pairs of two adjacent first connection terminals 82 are arranged along the Y direction.

Figure 39:
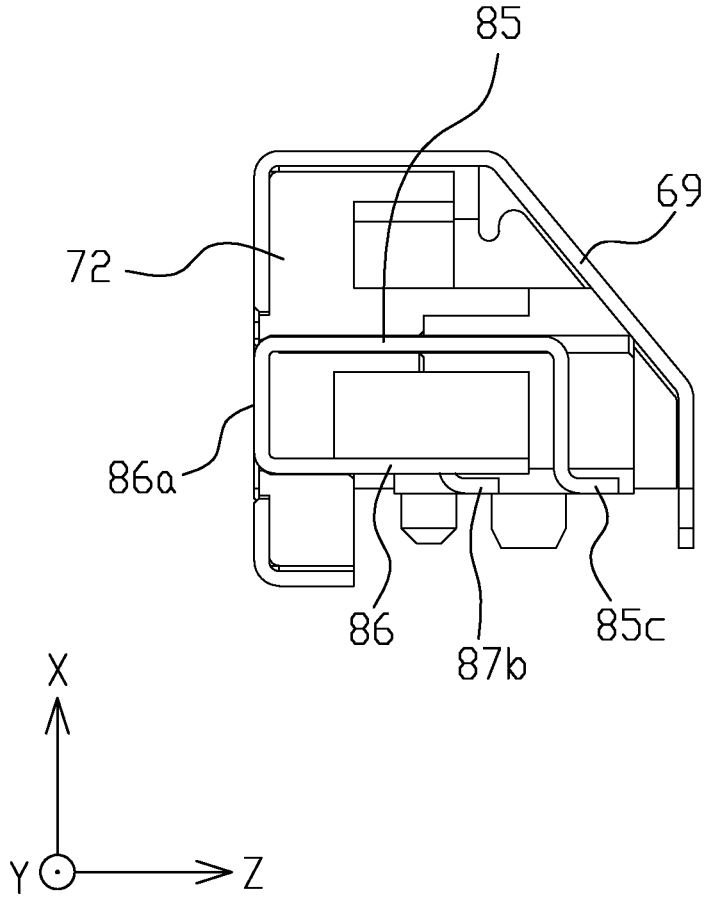
FIG. 39 is a cross-sectional view showing the configuration of the second connector according to the third embodiment.

FIG. 39 is a cross-sectional view taken along line D-D in FIG. 35. The second connection terminal 86 is formed integrally with the ground plate 85. Specifically, the second connection terminal 86 is formed by bending the end portion of the ground plate 85 on the −Z direction side. That is, the second connection terminal 86 is electrically connected to the ground plate 85. The second connection terminal 86 may be formed separately from the ground plate 85 as long as it is electrically connected to the ground plate 85. The second connection terminal 86 includes the second connection surface 86*a*, and is incorporated in the housing 72 while exposing the second connection surface 86*a* in the −Z direction through the opening 72*b* of the housing 72 and the opening 69*a* of the shell 69. When the second connector 13 is pressed against the first connector 11, the second connection surface 86*a* of the second connection terminal 86 is electrically connected to the second contact portion 49*a* (see FIG. 33) of the second contact 49 included in the first connector 11 by being pressed against the second contact portion 49*a*. The second connection terminals 86 are disposed with the two first connection terminals 82 adjacent to each other interposed therebetween, and the twelve second connection terminals 86 are arranged along the Y direction. The impedance between the first connection terminal 82 and the second connection terminal 86 is matched.

The third connection terminal 87 includes the third connection surface 87*a* at one end portion thereof, and is incorporated in the housing 72 while exposing the third connection surface 87*a* in the −Z direction through the opening 72*c* of the housing 72 and the opening 69*a* of the shell 69. When the second connector 13 is pressed against the first connector 11, the third connection surface 87*a* of the third connection terminal 87 is electrically connected to the third contact portion 56*a* (see FIG. 34) of the third contact 56 included in the first connector 11 by being pressed against the third contact portion 56*a*. The other end portion 87*b* (see FIG. 39) of the third connection terminal 87 is mounted on the printed circuit 88. As shown in FIG. 35, two third connection terminals 87 are disposed on the −Y direction side, and another two of them on the +Y direction side.

The ground plate 85 includes a conductive member, for example, metal, and is disposed in the vicinity of the plurality of first connection terminals 82. More specifically, the ground plate 85 is disposed on the +X direction side of the plurality of first connection terminals 82, and in a plane (YZ plane in the third embodiment) along an arrangement direction in which the plurality of first connection terminals 82 and the plurality of second connection terminals 86 are arranged in a row (Y direction). The ground plate 85 includes the twelve second connection terminals 86 formed by being bent in the −X direction from the end portion on the −Z direction side. In addition, the ground plate 85 includes the two grounding terminals 85*a* formed by being bent in the +X direction from the end portion on the −Z direction side, eleven bent portions 85*b* formed by being bent in the −X direction from the end portion on the +Z direction side, and twelve grounding terminals 85*c* formed by being bent in the −X direction from the end portion on the +Z direction side. The ground plate 85 is disposed in the vicinity of the plurality of first connection terminals 82, and is incorporated in the housing 72 while exposing the second connection surface 86*a* of the second connection terminal 86 in the −Z direction through the opening 72*b* of the housing 72 and the opening 69*a* of the shell 69, and exposing the grounding terminal 85*a* in the −Z direction through the opening 72*d* of the housing 72 and the opening 69*a* of the shell 69. The impedance between the first connection terminal 82 and the ground plate 85 is matched.

Figure 40:
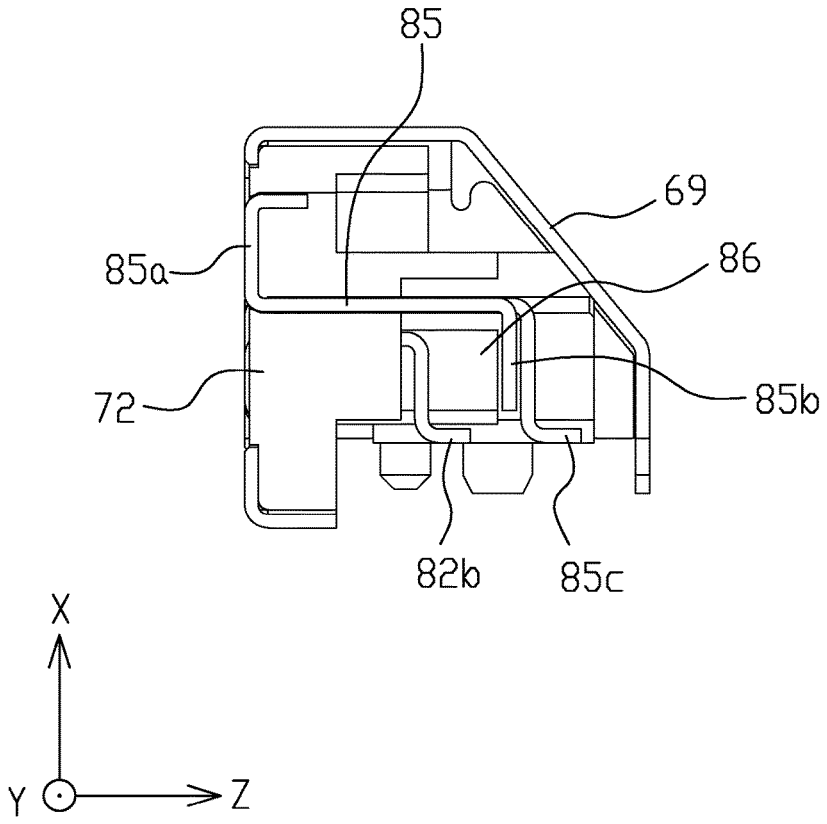
FIG. 40 is a cross-sectional view showing the configuration of the second connector according to the third embodiment.

FIG. 40 is a cross-sectional view taken along line E-E in FIG. 35. The grounding terminal 85*a* is exposed in the −Z direction through the opening 72*d* of the housing 72 and the opening 69*a* of the shell 69. When the second connector 13 is pressed against the first connector 11, the grounding terminal 85*a* is electrically connected to the second protruding portion 58*c* (see FIG. 34) of the metal plate 58 included in the first connector 11 by being pressed against the second protruding portion 58*c*. The grounding terminal 85*c* is mounted on the printed circuit 88.

Next, displacement of the protection member 37 and the first contact portion 47*a* in the process of pressing the second connector 13 against the first connector 11 according to the third embodiment will be described. Since the displacement of the second contact portion 49*a* in the process of pressing the second connector 13 against the first connector 11 is substantially the same as the displacement of the first contact portion 47*a*, the description thereof will be omitted.

Before the second connector 13 comes in contact with the second shell 35, the protection member 37, the first contact portion 47*a*, and the second contact portion 49*a* (initial state), as shown in FIG. 32, the first contact portion 47*a* is located at a position protruding from the opening 35*a* of the second shell 35 by a predetermined amount. The protrusion amount of the first contact portion 47*a* is the minimum amount of protrusion required to bring the first connection terminal 82 (first connection surface 82*a*) of the second connector 13 into contact with the first contact portion 47*a* when the second connector 13 is pressed against the first connector 11. The upper surface (on the +Z direction side) of the protection member 37 is protruding from the upper surface (on the +Z direction side) of the first base body 15 by a predetermined amount.

Next, when the second connector 13 is pressed against the first connector 11, the first connection terminal 82 (first connection surface 82*a*) of the second connector 13 comes in contact with and presses the first contact portion 47*a*, and thus a pressing force in the −Z direction is applied to the first contact portion 47*a*. The first contact portion 47*a* starts moving in the −Z direction, and along with the start of the movement of the first contact portion 47*a*, the second shell 35 and the protection member 37 also start moving in the −Z direction.

Figure 41:
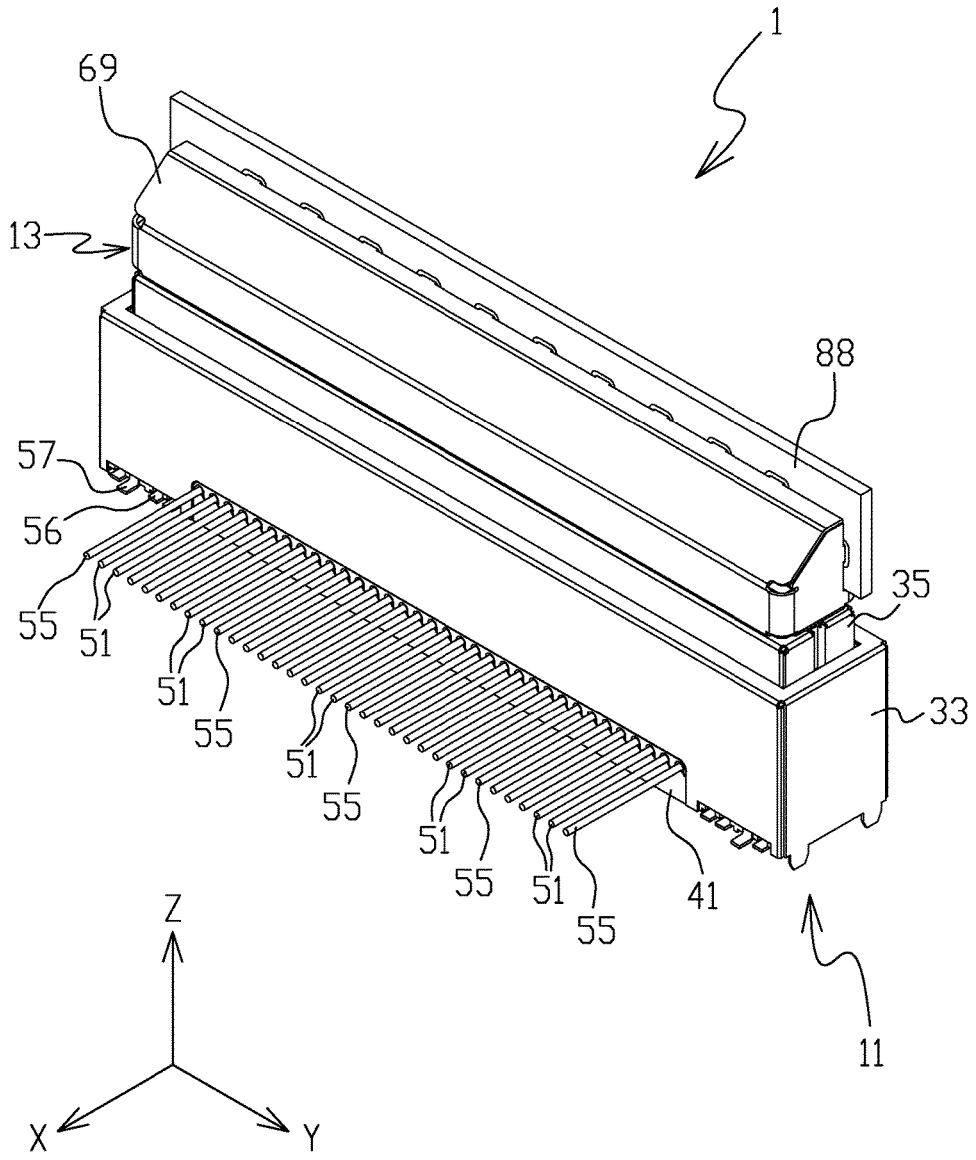
FIG. 41 is a cross-sectional view showing how the first connector and the second connector included in the connector according to the third embodiment are coupled.

When the second connector 13 is further pressed against the first connector 11, the first contact portion 47*a* further moves in the −Z direction, and the second shell 35 and the protection member 37 stop moving in the −Z direction. When the second connector 13 is further pressed against the first connector 11, the second shell 35 and the protection member 37 do not move, and only the first contact portion 47*a* moves in the −Z direction. FIG. 41 is an external perspective view showing how the first connector 11 and the second connector 13 are coupled. As shown in FIG. 41, when the second connector 13 is completely pressed against the first connector 11 (final coupled state), the position of the first contact portion 47*a* in the Z direction is on substantially the same plane as the surface of the second shell 35 on the +Z direction side (pressing surface against which the first connection terminal 82 and the second connection terminal 86 are pressed).

In the first connector 11 included in the connector 1 according to the third embodiment, the first contact 47 and the first elastic member 54 (the second contact 49 and the second elastic member 66) are formed separately, not integrally. Therefore, the design freedom of the connector can be enhanced. In other words, in a terminal in which the contact and the elastic member are integrated, the size and shape of the terminal, and hence the size and shape of the connector are heavily restricted, thus lowering the design freedom. According to the third embodiment, however, since the contact and the elastic member are formed separately, the structure can be simplified compared to that of a terminal in which the contact and the elastic member are integrated, the design freedom concerning the size and shape of the contact increases, and thus the design freedom concerning the size and shape of the connector increases. An increase in the design freedom in turn makes it possible to make the connector compact.

Furthermore, since the design freedom concerning the size and shape of the contact increases, the structure of the contact and a transmission path of the connector can be simplified, and impedance matching for high-speed transmission can be easily performed. That is, it is possible to simplify the cross section of the connector that affects the impedance (the plane perpendicular to the transmission path of the connector) and to reduce the kinds of the cross sections of the connector. Therefore, the impedance can be easily adjusted using a coaxial cable matching the target impedance.

In the first connector 11 included in the connector 1 according to the third embodiment, the protection member 37 protects the first contact portion 47*a*, the second contact portion 49*a*, and the third contact portion 56*a*. Therefore, it is possible to provide a connector that is inexpensive and difficult to break down. For example, since the first contact portion 47*a*, the second contact portion 49*a*, and the third contact portion 56*a* are protected by the protection member 37, even when a finger, a pen tip or the like touches the first connector 11 by mistake, deformation of the first contact portion 47*a*, the second contact portion 49*a*, and the third contact portion 56*a* due to contact with a finger, a pen tip or the like can be prevented. In addition, the first contact portion 47*a*, the second contact portion 49*a*, and the third contact portion 56*a* can be brought into contact with the first connection terminal 82, the second connection terminal 86, and the third connection terminal 87 respectively with a sufficient pressing force in the final coupled state.

In the first connector 11 included in the connector 1 according to the third embodiment, the first shield member 51*c* of the first coaxial cable 51, the jumper plate 39, and the first elastic member 54 are electrically connected via the ground terminal 52. The second core wire 55*a* of the second coaxial cable 55, the second shield member 55*c* of the second coaxial cable 55, and the jumper plate 39 are electrically connected via the second contact 49. The twenty-two ground terminals 52 and the twelve second contacts 49 are all electrically connected via the jumper plate 39. In addition, the twenty-two first elastic members 54 and the twelve second elastic members 66 are all electrically connected via the metal plate 58. Furthermore, the metal plate 58 is electrically connected to the second shell 35, and the second shell 35 is electrically connected to the first shell 33. In the final coupled state between the first connector 11 and the second connector 13, the metal plate 58 is electrically connected to the ground plate 85 of the second connector 13, and the second shell 35 is electrically connected to the shell 69 of the second connector 13. Therefore, it is possible to further reinforce the ground, and to improve the high-speed transmission characteristics. Since the second contacts 49 are disposed with the first contacts 47 adjacent to each other interposed therebetween, the ground can be reinforced and the high-speed transmission characteristics can be improved.

In the second connector 13 included in the connector 1 according to the third embodiment, the two adjacent first connection terminals 82 are disposed in the space formed by the ground plate 85, the bent portion 85*b* of the ground plate 85, and the second connection terminal 86. The impedance between the first connection terminal 82 and the ground plate 85 is matched, and the impedance between the first connection terminal 82 and the second connection terminal 86 is also matched. In addition, the ground plate 85 and the second connection terminal 86 are electrically connected. Furthermore, in the final coupled state between the first connector 11 and the second connector 13, the ground plate 85 is electrically connected to the metal plate 58 of the first connector 11, and the shell 69 is electrically connected to the second shell 35 of the first connector 11. Therefore, it is possible to further reinforce the ground, and to improve the high-speed transmission characteristics. Since the wide second connection terminals 86 are disposed with the first connection terminals 82 adjacent to each other interposed therebetween, the ground can be reinforced and the high-speed transmission characteristics can be improved.

In the second connector 13 according to the third embodiment described above, one ground plate 85 is provided, but two or more ground plates may be provided. When two ground plates (a first ground plate and a second ground plate) are provided, the first ground plate is disposed on the +X direction side of the plurality of first connection terminals 82, and the second ground plate on the −X direction side of the plurality of first connection terminals 82. That is, the plurality of first connection terminals 82 and the plurality of second connection terminals 86 are disposed (arranged in a row) between the first ground plate and the second ground plate. In this case, since the impedance among the first connection terminal 82, the first ground plate, and the second ground plate is matched, the ground can be further reinforced and the high-speed transmission characteristics can be improved.

It is also possible to employ a configuration in which the two adjacent first connection terminals 82 are surrounded by the plurality of ground plates and the plurality of second connection terminals 86. For example, the two adjacent first connection terminals 82 are surrounded using the above-described first and second ground plates and the second connection terminal 86 that is wider than the first connection terminal 82 on a plane intersecting the Y direction (plane along the ZX plane). In this case, the impedance between the first connection terminal 82 and the second connection terminal 86 is matched, and the impedance among the first connection terminal 82, the first ground plate, and the second ground plate is matched. Therefore, it is possible to further reinforce the ground, and to improve the high-speed transmission characteristics.

In the second connector 13 according to the third embodiment described above, the ground plate 85 and the second connection terminal 86 are integrally formed, but the ground plate 85 and the second connection terminal 86 may be formed separately instead.

Next, a connector according to a fourth embodiment will be described with reference to the drawings. The connector according to the fourth embodiment includes a first connector mounted on, for example, a peripheral device such as a keyboard, and a second connector mounted on an external device such as a portable information terminal. The connector according to the fourth embodiment is a press-type connector that is electrically connected to the first connector by pressing a connection terminal of the second connector in a predetermined direction. In the first connector and the second connector according to the fourth embodiment, the same components as those of the first connector 60 shown in FIG. 13 and the second connector 79 shown in FIG. 23 are denoted by the same reference numerals, and illustration and description thereof will be omitted. In the following description, an XYZ orthogonal coordinate system similar to those in FIGS. 13 and 23 is set, and the positional relationship and the like of each part will be described with reference to this orthogonal coordinate system.

Figure 42:
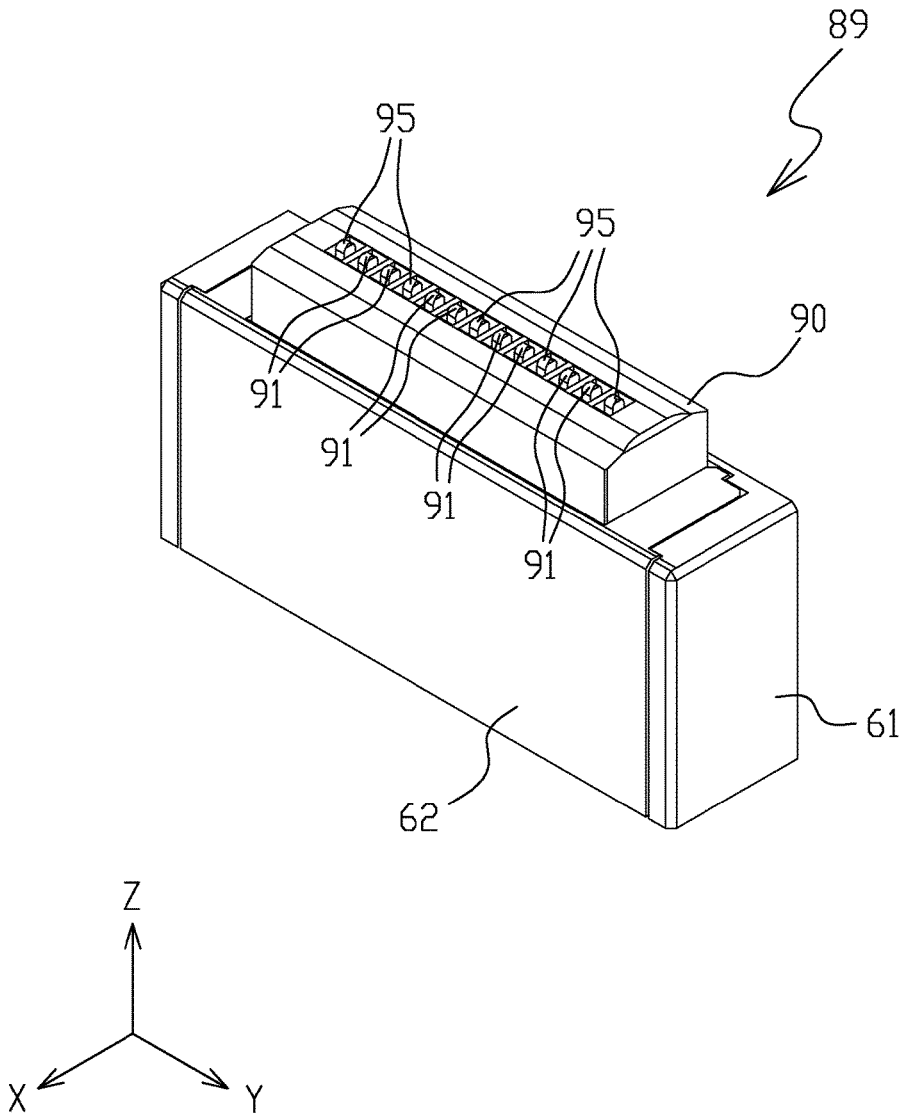
FIG. 42 is a perspective view showing an external appearance of a first connector according to a fourth embodiment.
Figure 43:
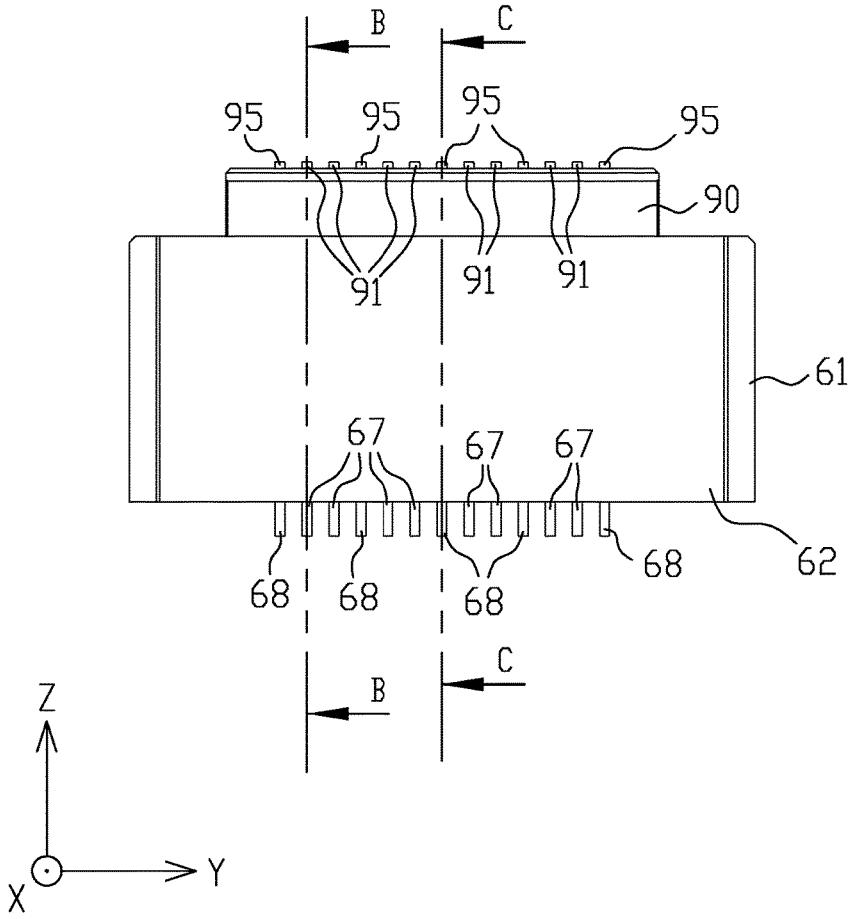
FIG. 43 is a front view showing the external appearance of the first connector according to the fourth embodiment.
Figure 44:
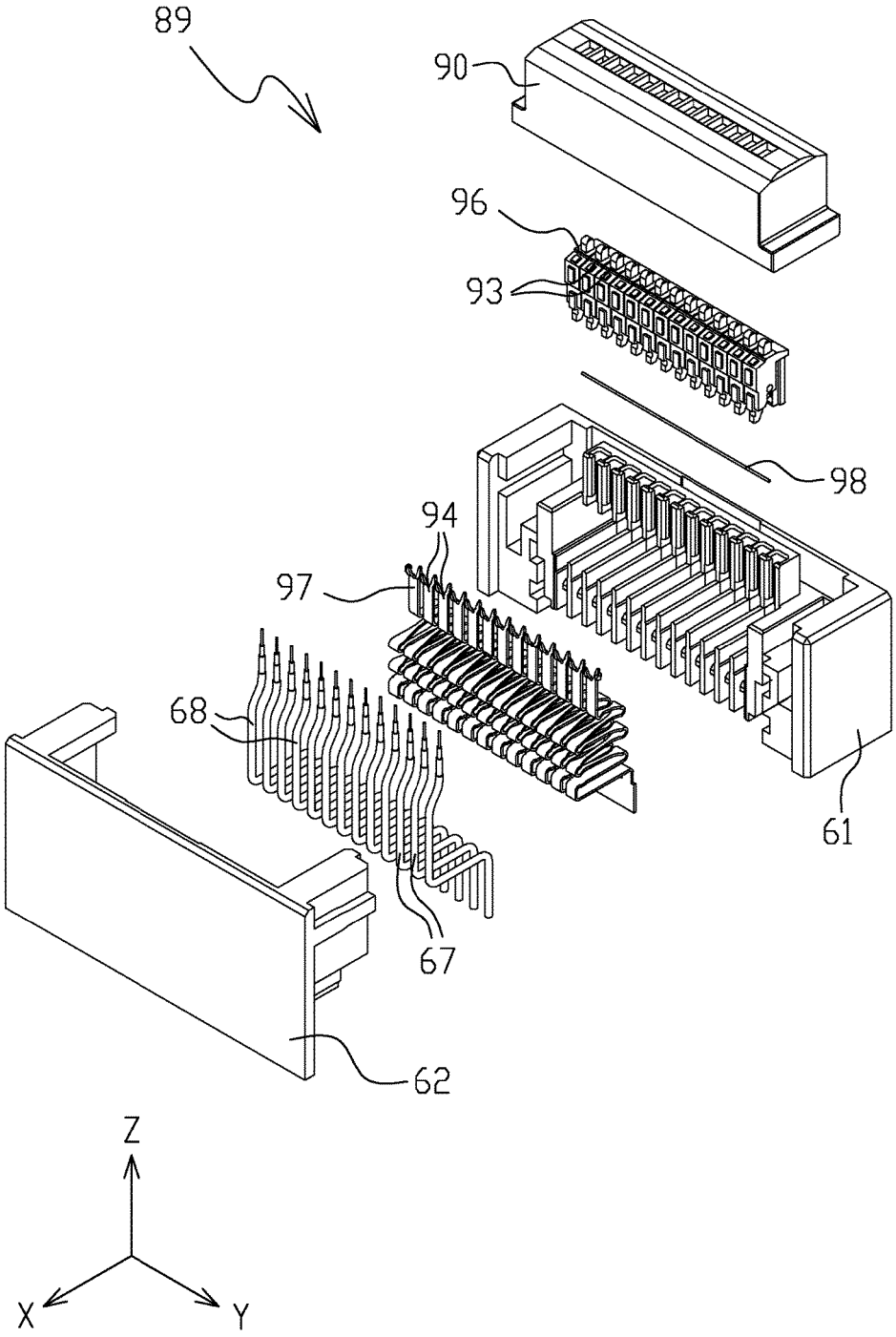
FIG. 44 is an exploded view showing a configuration of the first connector according to the fourth embodiment.

FIG. 42 is a perspective view showing an external appearance of the first connector according to the fourth embodiment. FIG. 43 is a front view showing the external appearance of the first connector according to the fourth embodiment. FIG. 44 is an exploded view showing a configuration of the first connector according to the fourth embodiment. As shown in FIGS. 42 to 44, the first connector 89 according to the fourth embodiment includes a base body 61, a cover 62, a protection member 90, a plurality of (eight in the fourth embodiment) first contacts 91, a plurality of (five in the fourth embodiment) second contacts 95, a plurality of (eight in the fourth embodiment) first coaxial cables 67, and a plurality of (five in the fourth embodiment) second coaxial cables 68.

Figure 45:
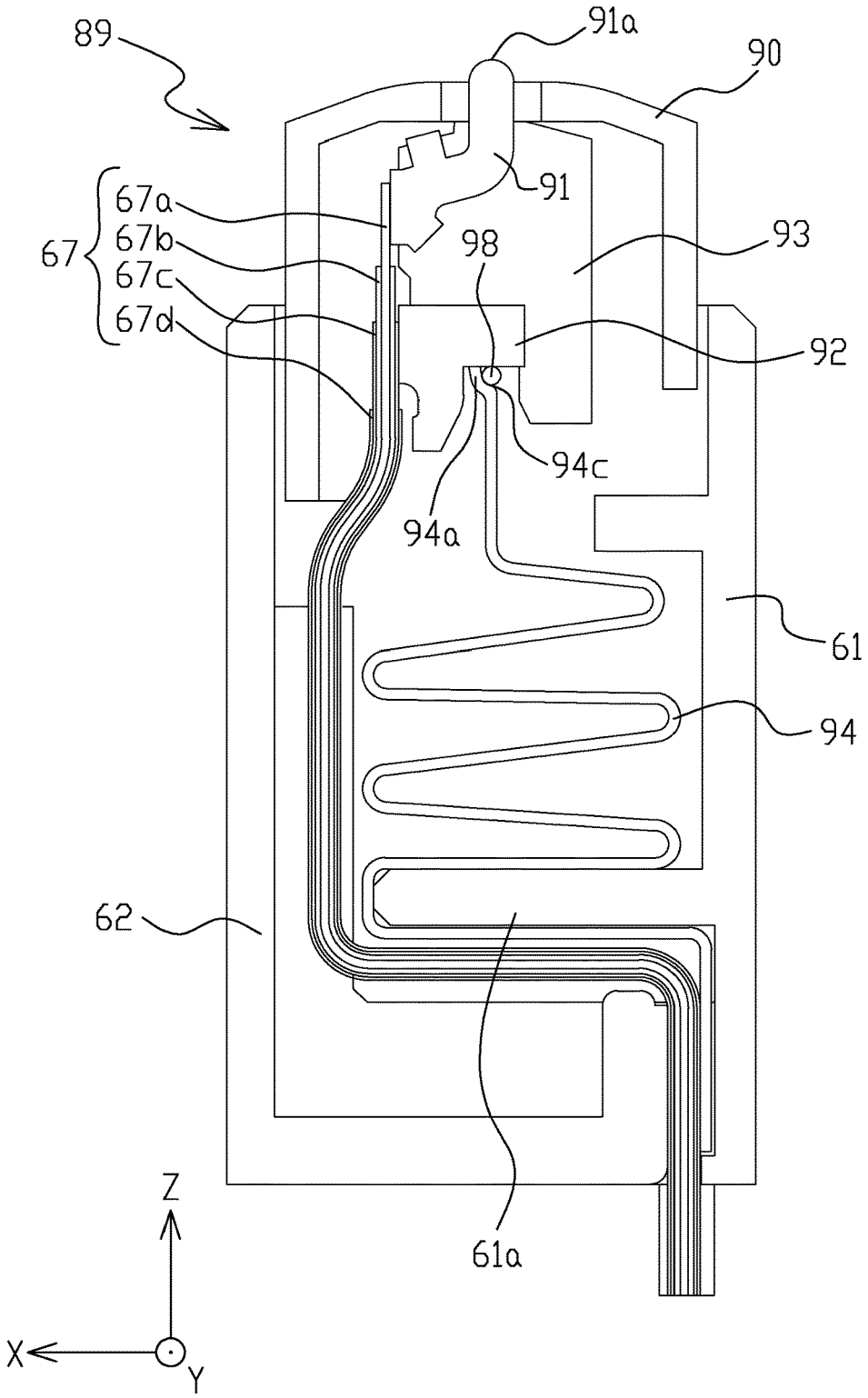
FIG. 45 is a cross-sectional view showing the configuration of the first connector according to the fourth embodiment.

As shown in FIGS. 42 to 44, the protection member 90 has a different shape from the protection member 63 shown in FIG. 16, but the other configuration of the protection member 90 is the same as that of the protection member 63. FIG. 45 is a cross-sectional view taken along line B-B in FIG. 43. As shown in FIG. 45, the first contact 91 includes a first contact portion 91*a* that is electrically connected to the first connection terminal 80 (see FIG. 23) of the second connector 79 when the first connection terminal 80 is pressed in the −Z direction. As shown in FIG. 45, the first contact 91 has a different shape from the first contact 64 shown in FIG. 18, but the other configuration of the first contact 91 is the same as that of the first contact 64.

As shown in FIG. 45, a ground terminal 92, a first holding member 93, and a first elastic member 94 are provided in an internal space formed by the base body 61, the cover 62, and the protection member 90. As shown in FIG. 45, the ground terminal 92, the first holding member 93, and the first elastic member 94 have different shapes from the ground terminal 73, the first holding member 74, and the first elastic member 75 shown in FIG. 18, respectively. However, the other configurations of the ground terminal 92, the first holding member 93, and the first elastic member 94 are the same as those of the ground terminal 73, the first holding member 74, and the first elastic member 75, respectively.

Figure 46:
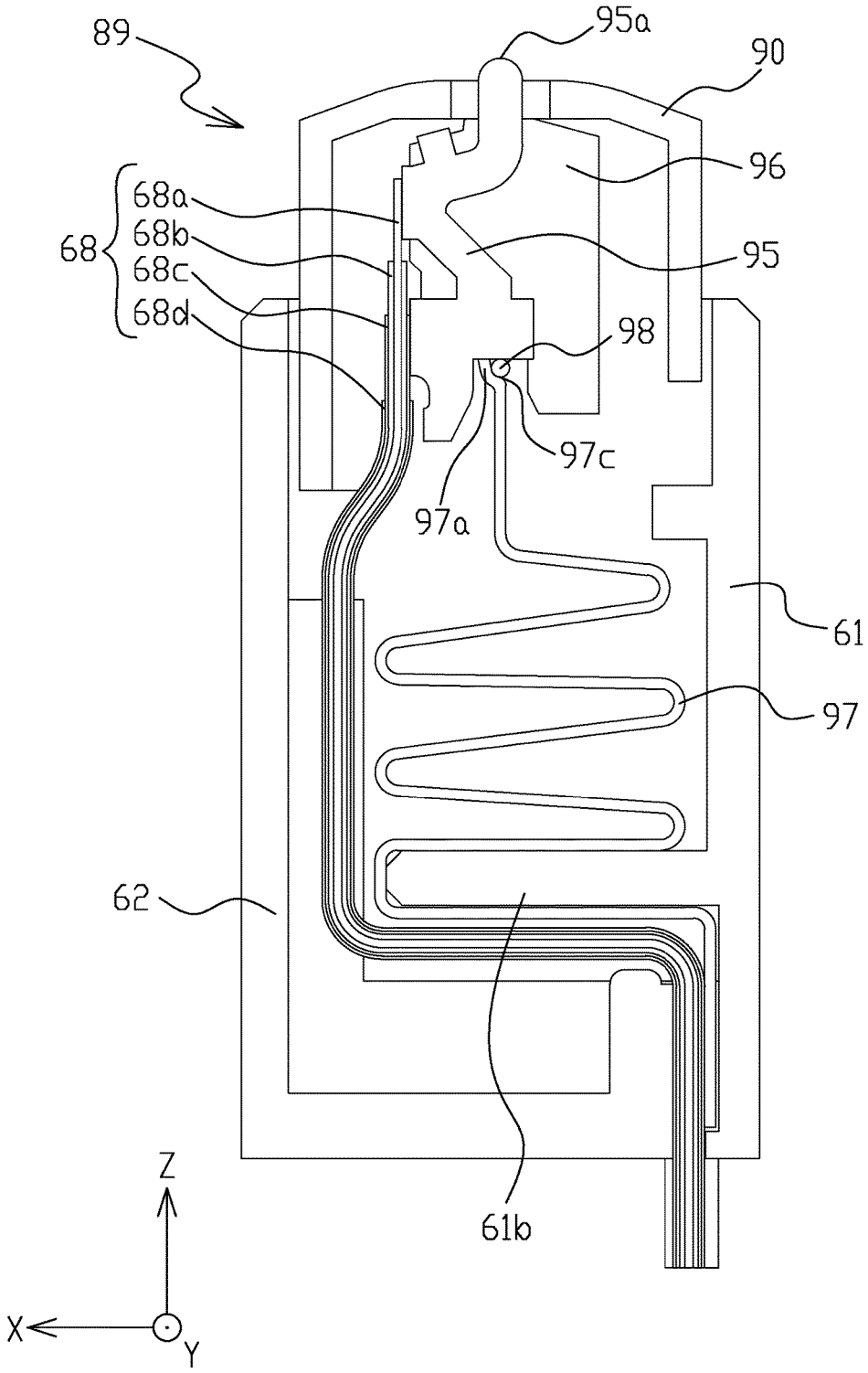
FIG. 46 is a cross-sectional view showing the configuration of the first connector according to the fourth embodiment.

FIG. 46 is a cross-sectional view taken along line C-C in FIG. 43. As shown in FIG. 46, the second contact 95 includes a second contact portion 95*a* that is electrically connected to the second connection terminal 81 (see FIG. 23) of the second connector 79 when the second connection terminal 81 is pressed in the −Z direction. As shown in FIG. 46, the second contact 95 has a different shape from the second contact 65 shown in FIG. 19, but the other configuration of the second contact 95 is the same as that of the second contact 65.

As shown in FIG. 46, a second holding member 96 and a second elastic member 97 are provided in the internal space formed by the base body 61, the cover 62, and the protection member 90. As shown in FIG. 46, the second holding member 96 and the second elastic member 97 have different shapes from the second holding member 76 and the second elastic member 77 shown in FIG. 19, respectively, but the other configurations of the second holding member 96 and the second elastic member 97 are the same as those of the second holding member 76 and the second elastic member 77, respectively.

As shown in FIGS. 45 and 46, a grounding connection member 98 is provided, instead of the grounding connection member 78 shown in FIG. 21, in the internal space formed by the base body 61, the cover 62, and the protection member 90. The grounding connection member 98 includes a conductor and is constituted by a round bar having a circular cross section in the ZX plane and extending in the Y direction. The grounding connection member 98 is disposed between the ground terminal 92 and the first elastic member 94 and between the second contact 95 and the second elastic member 97.

Figure 47:
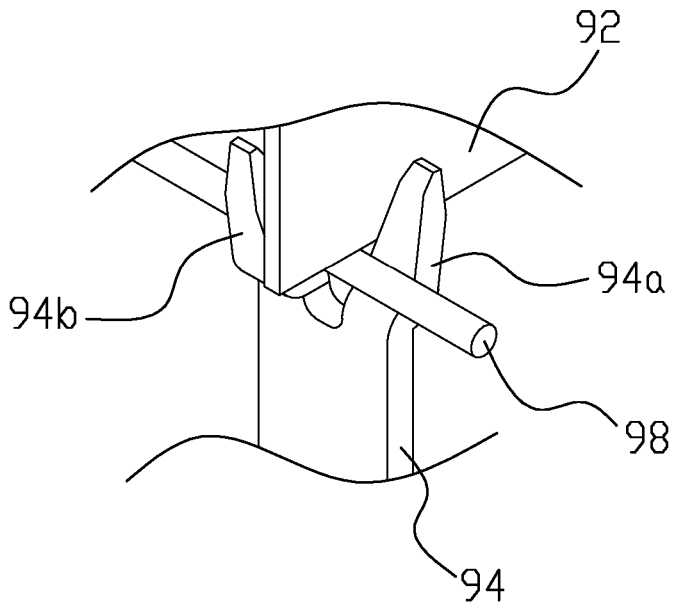
FIG. 47 is a view for describing how a grounding connection member, a ground terminal, and a first elastic member according to the fourth embodiment are connected.
Figure 47:
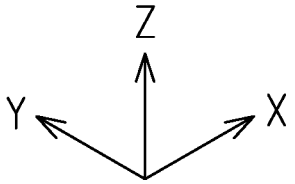

FIG. 47 is a view for describing how the grounding connection member 98, the ground terminal 92, and the first elastic member 94 are connected. As shown in FIG. 47, two holding portions 94*a* and 94*b* for holding the grounding connection member 98 and a support portion 94*c* for supporting the grounding connection member 98 are formed on an upper part (+Z direction side) of the first elastic member 94. The grounding connection member 98 is held by the holding portion 94*a* on the +X direction side and by the holding portion 94*b* on the −X direction side. Furthermore, the grounding connection member 98 is supported by the support portion 94*c* on the −Z direction side. The grounding connection member 98 is pressed against the ground terminal 92 by the elastic force of the first elastic member 94.

In addition, as in the first elastic member 94, a holding portion 97*a* (see FIG. 46) for holding the grounding connection member 98, a holding portion (not shown), and a support portion 97*c* for supporting the grounding connection member 98 are formed on an upper part (+Z direction side) of the second elastic member 97. The grounding connection member 98 is held by the holding portion 97*a* on the +X direction side and by the holding portion (not shown) on the −X direction side. Furthermore, the grounding connection member 98 is supported by the support portion 97*c* on the −Z direction side. The grounding connection member 98 is pressed against the second contact 95 by the elastic force of the second elastic member 97.

That is, the grounding connection member 98 is pressed against the ground terminal 92 by the elastic force of the first elastic member 94, and the grounding connection member 98 is pressed against the second contact 95 by the elastic force of the second elastic member 97, whereby the ground terminal 92 and the second contact 95 are electrically connected. In other words, the ground terminal 92 and the second contact 95, as well as the ground terminals 92, and the second contacts 95, can be electrically connected to each other via the grounding connection member 98 by the elastic force of the first elastic member 94 and the elastic force of the second elastic member 97 without soldering, for example. Therefore, a soldering step is not necessary in the step of assembling the first connector 89, and thus the assembling step can be facilitated. The grounding connection member 98 is not soldered to the ground terminal 92 or the second contact 95; therefore, even if the grounding connection member 98 does not have flexibility (elasticity), respective members move individually and the other members can follow the movement while being electrically connected. The ground terminal 92 and the grounding connection member 98 function as connection members that electrically connect the first shield member 67*c*, the second core wire 68*a*, and the second shield member 68*c* to one another.

In the first connector 89 according to the fourth embodiment, the first contact 91 and the first elastic member 94 (the second contact 95 and the second elastic member 97) are formed separately, not integrally. Therefore, the design freedom of the connector can be enhanced. In other words, in a terminal in which the contact and the elastic member are integrated, the size and shape of the terminal, and hence the size and shape of the connector are heavily restricted, thus lowering the design freedom. According to the fourth embodiment, however, since the contact and the elastic member are formed separately, the structure can be simplified compared to that of a terminal in which the contact and the elastic member are integrated, the design freedom concerning the size and shape of the contact increases, and thus the design freedom concerning the size and shape of the connector increases. An increase in the design freedom in turn makes it possible to make the connector compact.

Furthermore, since the design freedom concerning the size and shape of the contact increases, the structure of the contact and a transmission path of the connector can be simplified, and impedance matching for high-speed transmission can be easily performed. That is, it is possible to simplify the cross section of the connector that affects the impedance (the plane perpendicular to the transmission path of the connector) and to reduce the kinds of the cross sections of the connector. Therefore, the impedance can be easily adjusted using a coaxial cable matching the target impedance.

In the first connector 89 according to the fourth embodiment, the protection member 90 protects the first contact portion 91*a* and the second contact portion 95*a*. Therefore, it is possible to provide a connector that is inexpensive and difficult to break down. For example, since the first contact portion 91*a* and the second contact portion 95*a* are protected by the protection member 90, even when a finger, a pen tip or the like touches the first connector 89 by mistake, deformation of the first contact portion 91*a* and the second contact portion 95*a* due to contact with a finger, a pen tip or the like can be prevented. In addition, the first contact portion 91*a* and the second contact portion 95*a* can be brought into contact with the first connection terminal 80 and the second connection terminal 81 respectively with a sufficient pressing force in the final coupled state.

In the first connector 89 according to the fourth embodiment, the first shield member 67*c* of the first coaxial cable 67 and the first elastic member 94 are electrically connected via the ground terminal 92 and the grounding connection member 98. The second core wire 68*a* of the second coaxial cable 68, the second shield member 68*c* of the second coaxial cable 68, and the second elastic member 97 are electrically connected via the second contact 95 and the grounding connection member 98. The eight ground terminals 92 and the five second contacts 95 are all electrically connected via the grounding connection member 98. The eight first elastic members 94 and the five second elastic members 97 are also all electrically connected. Therefore, it is possible to further reinforce the ground, and to improve the high-speed transmission characteristics. Since the second contacts 95 are disposed with the first contacts 91 adjacent to each other interposed therebetween, the ground can be reinforced and the high-speed transmission characteristics can be improved.

The first connector 89 according to the fourth embodiment described above is provided with the grounding connection member 98 having the shape of a round bar. However, it is also possible to provide a grounding connection member having a shape other than the round bar, such as a beltlike planar grounding connection member, instead of the grounding connection member 98.

Next, a connector according to a fifth embodiment will be described with reference to the drawings. The connector according to the fifth embodiment includes a first connector mounted on, for example, a peripheral device such as a keyboard, and a second connector mounted on an external device such as a portable information terminal. The connector according to the fifth embodiment is a press-type connector that is electrically connected to the first connector by pressing a connection terminal of the second connector in a predetermined direction. In the first connector and the second connector according to the fifth embodiment, the same components as those of the first connector 89 shown in FIG. 42 and the second connector 79 shown in FIG. 23 are denoted by the same reference numerals, and illustration and description thereof will be omitted. In the following description, an XYZ orthogonal coordinate system similar to those in FIGS. 42 and 23 is set, and the positional relationship and the like of each part will be described with reference to this orthogonal coordinate system.

Figure 48:
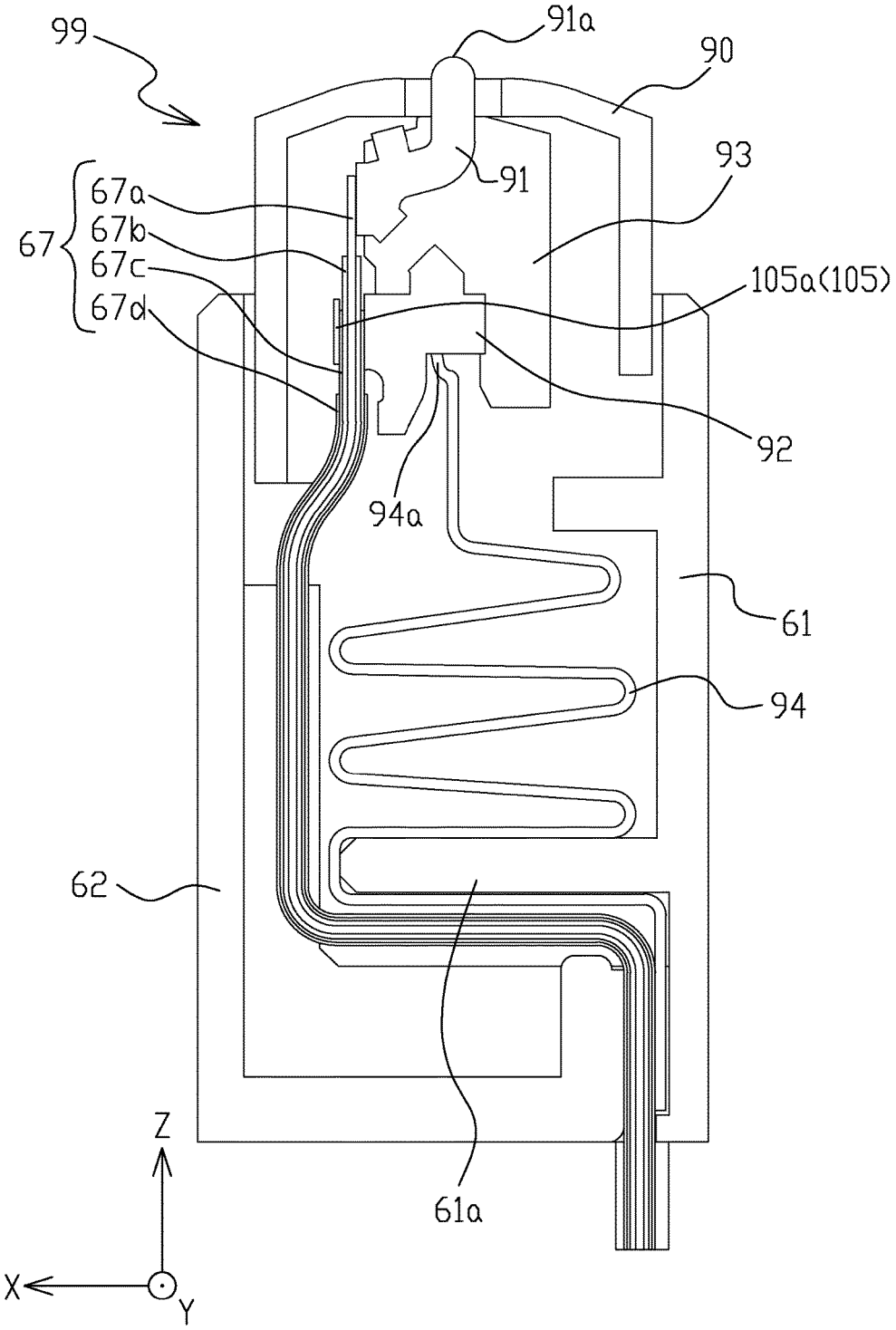
FIG. 48 is a cross-sectional view showing a configuration of a first connector according to a fifth embodiment.

A first connector 99 (see FIG. 48) according to the fifth embodiment includes a base body 61, a cover 62, a protection member 90, a plurality of first contacts 91, a plurality of second contacts 95, a plurality of first coaxial cable 67, and a plurality of second coaxial cables 68. An external appearance of the first connector 99 is the same as that of the first connector 89 shown in FIGS. 42 and 43. Therefore, for the first connector 99 according to the fifth embodiment, reference is made to the front view of FIG. 43 used for describing the first connector 89 according to the fourth embodiment. FIG. 48 is a cross-sectional view taken along line B-B in FIG. 43.

Figure 49:
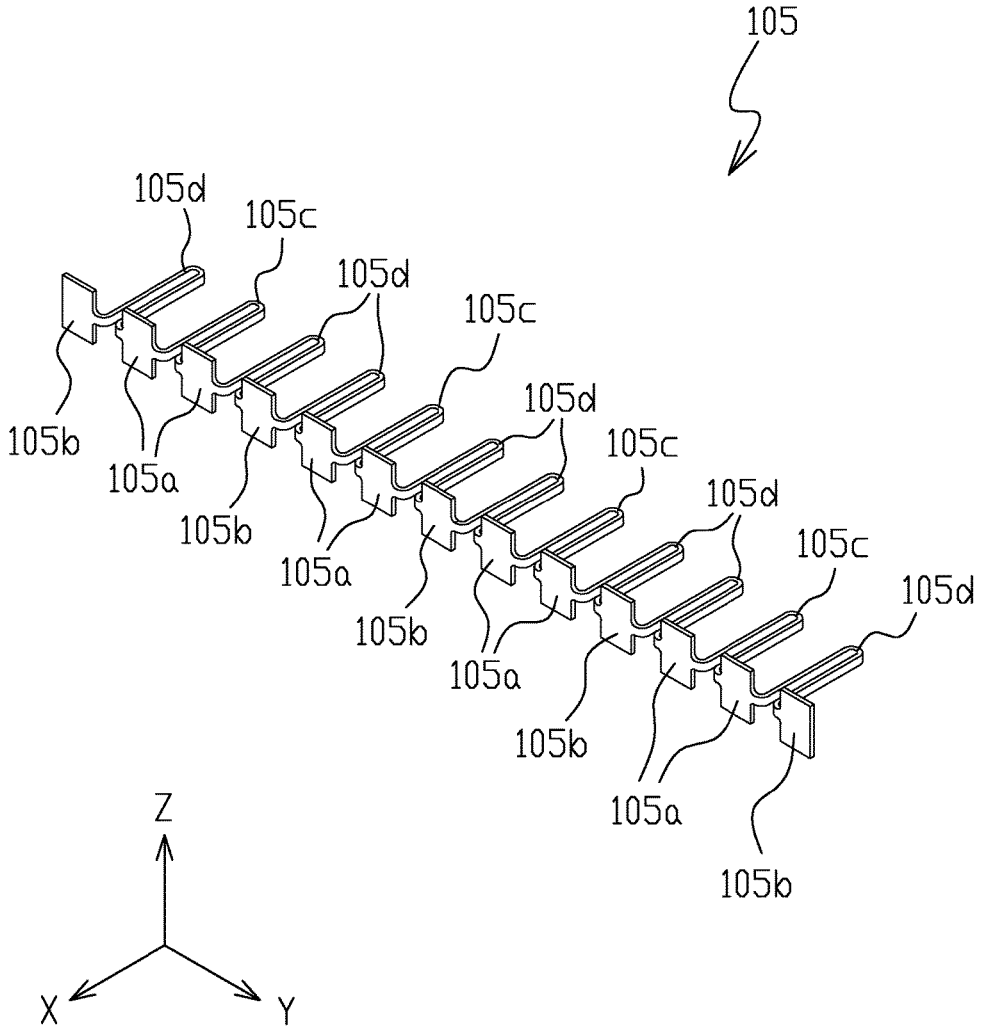
FIG. 49 is a view showing a configuration of a grounding connection member according to the fifth embodiment.

As shown in FIG. 48, a grounding connection member 105 including a conductor is provided, in place of the grounding connection member 98 shown in FIGS. 45 and 46, in an internal space formed by the base body 61, the cover 62, and the protection member 90. FIG. 49 is a view showing a configuration of the grounding connection member 105. As shown in FIG. 49, the grounding connection member 105 is formed of one flat plate and includes eight first flat portions 105*a* and five second flat portions 105*b*. The grounding connection member 105 also includes four first bent portions 105*c* bent in the shape of U. Each first bent portion 105*c* has flexibility and couples the first flat portions 105*a* adjacent to each other. The grounding connection member 105 further includes eight second bent portions 105*d* bent in the shape of U. Each second bent portion 105*d* has flexibility and couples the first flat portion 105*a* and the second flat portion 105*b* adjacent to each other.

As shown in FIG. 48, the first flat portion 105*a* is electrically connected to a first shield member 67*c* of the first coaxial cable 67 on the +X direction side. Since the adjacent first flat portions 105*a* are coupled by the first bent portion 105*c*, adjacent ground terminals 92 are electrically connected via the first shield member 67*c* and the grounding connection member 105. The second flat portion 105*b* is electrically connected to a second shield member 68*c* of the second coaxial cable 68 on the +X direction side. Since the first flat portion 105*a* and the second flat portion 105*b* adjacent to each other are coupled by the second bent portion 105*d*, the ground terminal 92 and the second contact 95 adjacent to each other are electrically connected via the first shield member 67*c*, the grounding connection member 105, and the second shield member 68*c*. Since the first bent portion 105*c* and the second bent portion 105*d* have flexibility, it is possible that respective members move individually and the other members follow the movement while being electrically connected.

In the first connector 99 according to the fifth embodiment, the first contact 91 and the first elastic member 94 (the second contact 95 and the second elastic member 97) are formed separately, not integrally. Therefore, the design freedom of the connector can be enhanced. In other words, in a terminal in which the contact and the elastic member are integrated, the size and shape of the terminal, and hence the size and shape of the connector are heavily restricted, thus lowering the design freedom. According to the fifth embodiment, however, since the contact and the elastic member are formed separately, the structure can be simplified compared to that of a terminal in which the contact and the elastic member are integrated, the design freedom concerning the size and shape of the contact increases, and thus the design freedom concerning the size and shape of the connector increases. An increase in the design freedom in turn makes it possible to make the connector compact.

Furthermore, since the design freedom concerning the size and shape of the contact increases, the structure of the contact and a transmission path of the connector can be simplified, and impedance matching for high-speed transmission can be easily performed. That is, it is possible to simplify the cross section of the connector that affects the impedance (the plane perpendicular to the transmission path of the connector) and to reduce the kinds of the cross sections of the connector. Therefore, the impedance can be easily adjusted using a coaxial cable matching the target impedance.

In the first connector 99 according to the fifth embodiment, the protection member 90 protects the first contact portion 91*a* and the second contact portion 95*a*. Therefore, it is possible to provide a connector that is inexpensive and difficult to break down. For example, since the first contact portion 91*a* and the second contact portion 95*a* are protected by the protection member 90, even when a finger, a pen tip or the like touches the first connector 99 by mistake, deformation of the first contact portion 91*a* and the second contact portion 95*a* due to contact with a finger, a pen tip or the like can be prevented. In addition, the first contact portion 91*a* and the second contact portion 95*a* can be brought into contact with the first connection terminal 80 and the second connection terminal 81 respectively with a sufficient pressing force in the final coupled state.

In the first connector 99 according to the fifth embodiment, the first shield member 67*c* of the first coaxial cable 67 and the first elastic member 94 are electrically connected via the ground terminal 92 and the grounding connection member 105. The second core wire 68*a* of the second coaxial cable 68, the second shield member 68*c* of the second coaxial cable 68, and the second elastic member 97 are electrically connected via the second contact 95 and the grounding connection member 105. The eight ground terminals 92 and the five second contacts 95 are all electrically connected via the grounding connection member 105. The eight first elastic members 94 and the five second elastic members 97 are also all electrically connected. Therefore, it is possible to further reinforce the ground, and to improve the high-speed transmission characteristics. Since the second contacts 95 are disposed with the first contacts 91 adjacent to each other interposed therebetween, the ground can be reinforced and the high-speed transmission characteristics can be improved.

Next, a connector according to a sixth embodiment will be described with reference to the drawings. The connector according to the sixth embodiment includes a first connector mounted on, for example, a peripheral device such as a keyboard, and a second connector mounted on an external device such as a portable information terminal. The connector according to the sixth embodiment is a press-type connector that is electrically connected to the first connector by pressing a connection terminal of the second connector in a predetermined direction. In the first connector and the second connector according to the sixth embodiment, the same components as those of the first connector 89 shown in FIG. 42 and the second connector 79 shown in FIG. 23 are denoted by the same reference numerals, and illustration and description thereof will be omitted. In the following description, an XYZ orthogonal coordinate system similar to those in FIGS. 42 and 23 is set, and the positional relationship and the like of each part will be described with reference to this orthogonal coordinate system.

Figure 50:
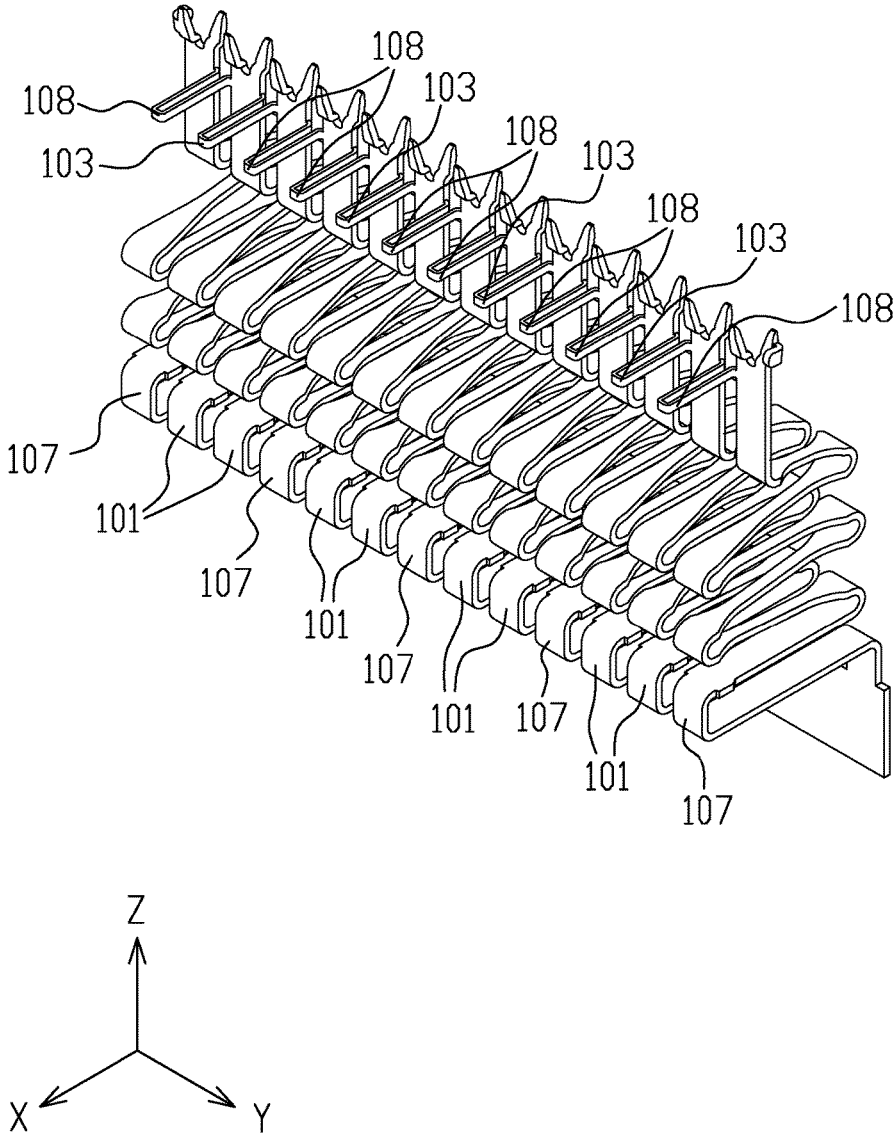
FIG. 50 is a view showing configurations of a first elastic member and a second elastic member according to a sixth embodiment.

In the first connector according to the sixth embodiment, a first elastic member 101 and a second elastic member 107 each including a conductor are provided, in place of the first elastic member 94, the second elastic member 97, and the grounding connection member 98 shown in FIGS. 45 and 46, in an internal space formed by a base body 61, a cover 62, and a protection member 90. FIG. 50 is a view showing configurations of the first elastic member 101 and the second elastic member 107. As shown in FIG. 50, four first bent portions 103 bent in the shape of U are each formed between the adjacent first elastic members 101. Each first bent portion 103 has flexibility and couples the adjacent first elastic members 101. Eight second bent portions 108 bent in the shape of U are each formed between the first elastic member 101 and the second elastic member 107 adjacent to each other. Each second bent portion 108 has flexibility and couples the first elastic member 101 and the second elastic member 107 adjacent to each other. The first bent portion 103 and the second bent portion 108 are disposed on the +Z direction side of the first elastic member 101 and the second elastic member 107.

The first bent portion 103 is electrically connected to one of adjacent ground terminals 92 and also to the other adjacent ground terminal 92. That is, the first bent portion 103 functions as a connection member that electrically connects one ground terminal 92 and the other ground terminal 92 (adjacent ground terminals 92), and the one ground terminal 92 and the other ground terminal 92 are electrically connected via the first bent portion 103. The second bent portion 108 is electrically connected to the adjacent ground terminal 92 and also to the adjacent second contact 95. That is, the second bent portion 108 functions as a connection member that electrically connects the adjacent ground terminal 92 and the adjacent second contact 95 (the ground terminal 92 and the second contact 95 adjacent to each other), and the ground terminal 92 and the second contact 95 are electrically connected via the second bent portion 108. Since the first bent portion 103 and the second bent portion 108 have flexibility, it is possible that respective members move individually and the other members follow the movement while being electrically connected.

In the first connector according to the sixth embodiment, the first contact 91 and the first elastic member 101 (the second contact 95 and the second elastic member 107) are formed separately, not integrally. Therefore, the design freedom of the connector can be enhanced. In other words, in a terminal in which the contact and the elastic member are integrated, the size and shape of the terminal, and hence the size and shape of the connector are heavily restricted, thus lowering the design freedom. According to the sixth embodiment, however, since the contact and the elastic member are formed separately, the structure can be simplified compared to that of a terminal in which the contact and the elastic member are integrated, the design freedom concerning the size and shape of the contact increases, and thus the design freedom concerning the size and shape of the connector increases. An increase in the design freedom in turn makes it possible to make the connector compact.

Furthermore, since the design freedom concerning the size and shape of the contact increases, the structure of the contact and a transmission path of the connector can be simplified, and impedance matching for high-speed transmission can be easily performed. That is, it is possible to simplify the cross section of the connector that affects the impedance (the plane perpendicular to the transmission path of the connector) and to reduce the kinds of the cross sections of the connector. Therefore, the impedance can be easily adjusted using a coaxial cable matching the target impedance.

In the first connector according to the sixth embodiment, the protection member 90 protects the first contact portion 91*a* and the second contact portion 95*a*. Therefore, it is possible to provide a connector that is inexpensive and difficult to break down. For example, since the first contact portion 91*a* and the second contact portion 95*a* are protected by the protection member 90, even when a finger, a pen tip or the like touches the first connector by mistake, deformation of the first contact portion 91*a* and the second contact portion 95*a* due to contact with a finger, a pen tip or the like can be prevented. In addition, the first contact portion 91*a* and the second contact portion 95*a* can be brought into contact with the first connection terminal 80 and the second connection terminal 81 respectively with a sufficient pressing force in the final coupled state.

In the first connector according to the sixth embodiment, the first shield member 67*c* of the first coaxial cable 67 and the first elastic member 101 are electrically connected via the ground terminal 92. The second core wire 68*a* of the second coaxial cable 68, the second shield member 68*c* of the second coaxial cable 68, and the second elastic member 107 are electrically connected via the second contact 95. The eight ground terminals 92 and the five second contacts 95 are all electrically connected via the first bent portions 103 and the second bent portions 108. The eight first elastic members 101 and the five second elastic members 107 are also all electrically connected. Therefore, it is possible to further reinforce the ground, and to improve the high-speed transmission characteristics. Since the second contacts 95 are disposed with the first contacts 91 adjacent to each other interposed therebetween, the ground can be reinforced and the high-speed transmission characteristics can be improved.

Next, a connector according to a seventh embodiment will be described with reference to the drawings. The connector according to the seventh embodiment includes a first connector mounted on, for example, a peripheral device such as a keyboard, and a second connector mounted on an external device such as a portable information terminal. The connector according to the seventh embodiment is a press-type connector that is electrically connected to the first connector by pressing a connection terminal of the second connector in a predetermined direction. In the first connector and the second connector according to the seventh embodiment, the same components as those of the first connector 89 shown in FIG. 42 and the second connector 79 shown in FIG. 23 are denoted by the same reference numerals, and illustration and description thereof will be omitted. In the following description, an XYZ orthogonal coordinate system similar to those in FIGS. 42 and 23 is set, and the positional relationship and the like of each part will be described with reference to this orthogonal coordinate system.

Figure 51:
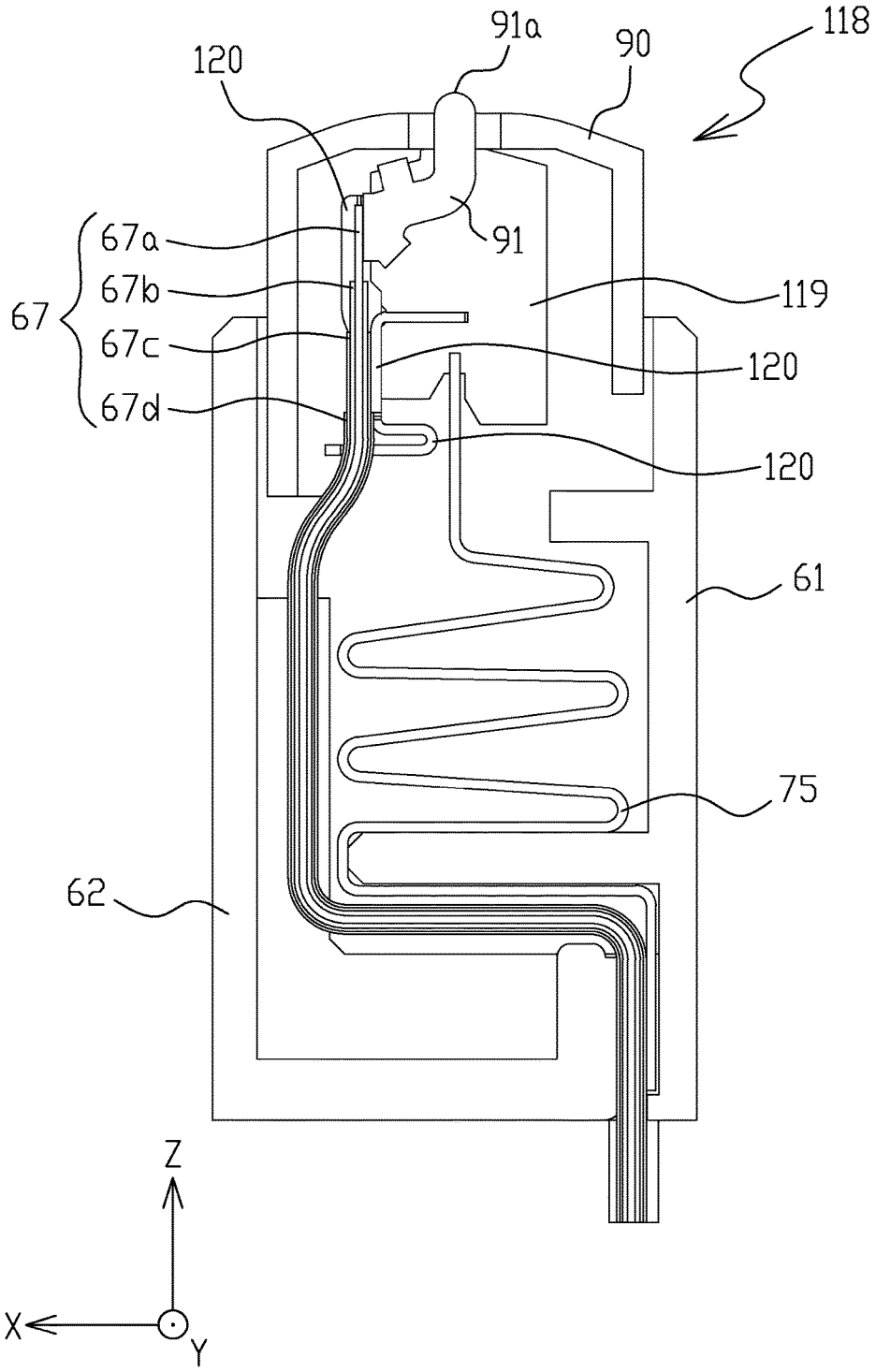
FIG. 51 is a cross-sectional view showing a configuration of a first connector according to a seventh embodiment.

A first connector 118 (see FIGS. 51 and 52) according to the seventh embodiment includes a base body 61, a cover 62, a protection member 90, a plurality of first contacts 91, a plurality of second contacts 122, a plurality of first coaxial cable 67, and a plurality of second coaxial cables 68. An external appearance of the first connector 118 is the same as that of the first connector 89 shown in FIGS. 42 and 43. Therefore, for the first connector 118 according to the seventh embodiment, reference is made to the front view of FIG. 43 used for describing the first connector 89 according to the fourth embodiment. FIG. 51 is a cross-sectional view taken along line B-B in FIG. 43, and FIG. 52 is a cross-sectional view taken along line C-C in FIG. 43.

As shown in FIG. 51, a first holding member 119 including an insulator in place of the first holding member 93 shown in FIG. 45, a first elastic member 75 in place of the first elastic member 94 shown in FIG. 45, and a connection member 120 including a conductor in place of the ground terminal 92 and the grounding connection member 98 shown in FIG. 45, are provided in an internal space formed by the base body 61, the cover 62, and the protection member 90. The first holding member 119 holds the first contact 91 and the connection member 120 and is movable in the ±Z direction. That is, the first contact 91 moves in the ±Z direction along with the movement of the first holding member 119, and thus the position of the first contact portion 91*a* of the first contact 91 in the Z direction also changes. The first holding member 119 includes a square hole portion 119*a* for press-fitting a first press-fit portion 120*f* (see FIG. 53, to be described later) of the connection member 120. The other configuration of the first holding member 119 is the same as that of the first holding member 93 shown in FIG. 45. The configuration of the first elastic member 75 is the same as that of the first elastic member 75 shown in FIG. 18.

Figure 52:
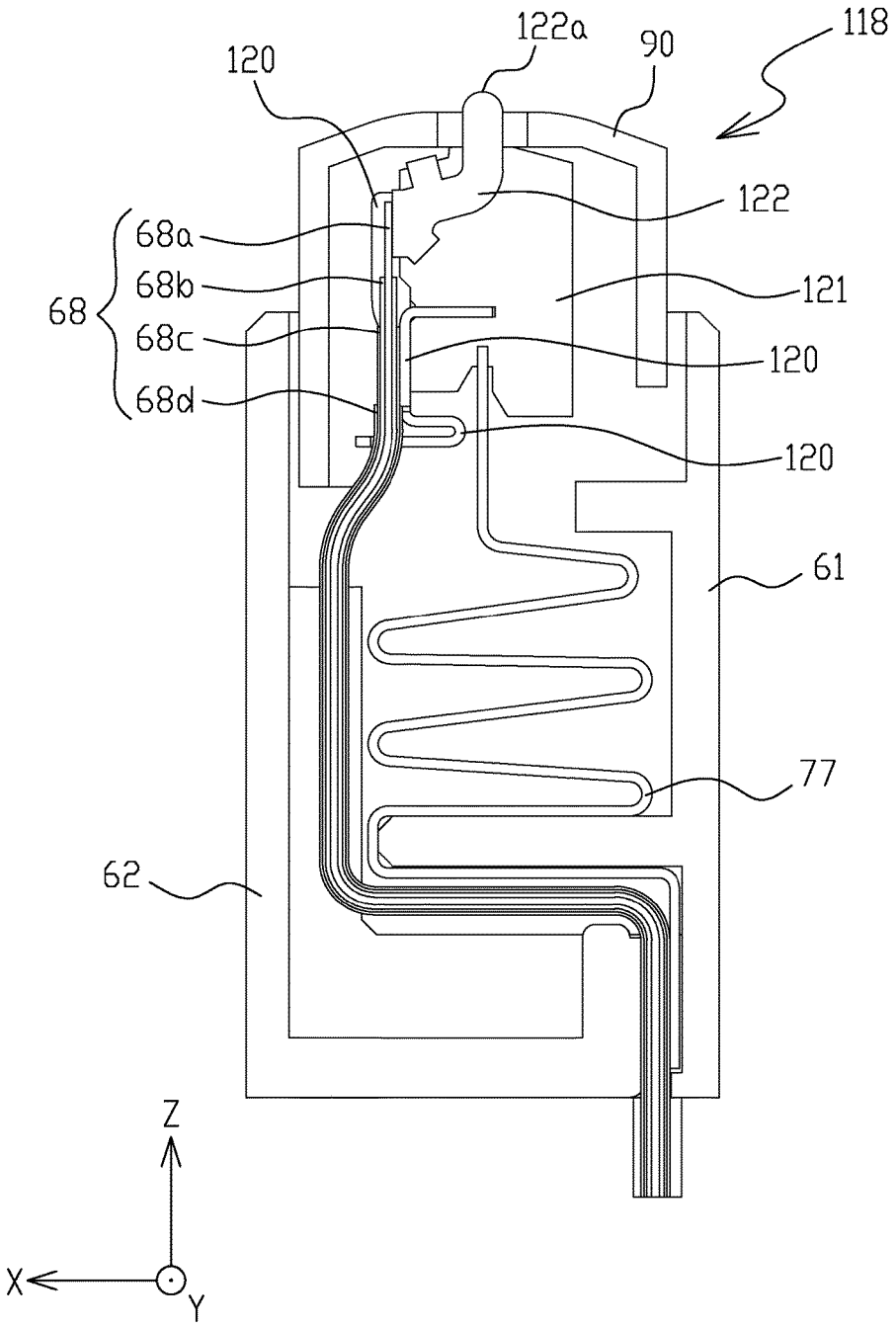
FIG. 52 is a cross-sectional view showing the configuration of the first connector according to the seventh embodiment.

As shown in FIG. 52, the second contact 122 including a conductor in place of the second contact 95 shown in FIG. 46, a second holding member 121 including an insulator in place of the second holding member 96 shown in FIG. 46, and a second elastic member 77 in place of the second elastic member 97 shown in FIG. 46, are provided in the internal space formed by the base body 61, the cover 62, and the protection member 90. As shown in FIG. 52, the second contact 122 includes a second contact portion 122*a* that is electrically connected to the second connection terminal 81 (see FIG. 23) of the second connector 79 when the second connection terminal 81 is pressed in the −Z direction. As shown in FIG. 52, the second contact 122 has a different shape from the second contact 95 shown in FIG. 46, but the other configuration of the second contact 122 is the same as that of the second contact 95.

The second holding member 121 holds the second contact 122 and the connection member 120 and is movable in the ±Z direction. That is, the second contact 122 moves in the ±Z direction along with the movement of the second holding member 121, and thus the position of the second contact portion 122*a* of the second contact 122 in the Z direction also changes. The second holding member 121 includes a square hole portion 121*a* for press-fitting a second press-fit portion 120*g* (see FIG. 53, to be described later) of the connection member 120. The other configuration of the second holding member 121 is the same as that of the second holding member 96 shown in FIG. 46. The configuration of the second elastic member 77 is the same as that of the second elastic member 77 shown in FIG. 19.

Figure 53:
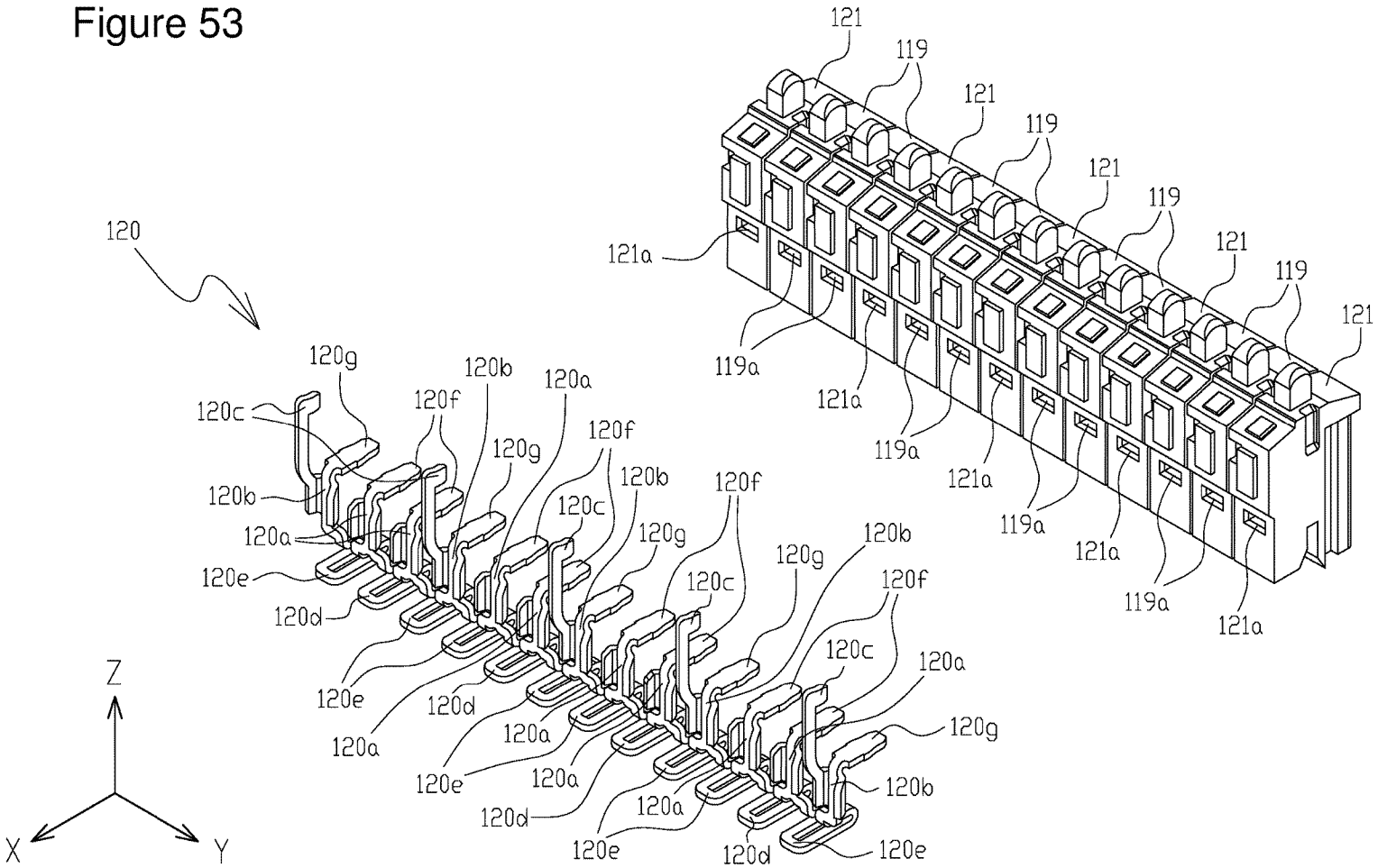
FIG. 53 is a view showing configurations of a first holding member, a second holding member, and a connection member according to the seventh embodiment.

FIG. 53 is a view showing the configurations of the first holding member 119, the second holding member 121, and the connection member 120. As shown in FIG. 53, the connection member 120 is formed of one flat plate, and includes eight first fixing portions 120*a*, five second fixing portions 120*b*, five ground portions 120*c*, four first flexible portions 120*d*, eight second flexible portions 120*e*, eight first press-fit portions 120*f*, and five second press-fit portions 120*g*.

A first shield member 67*c* of the first coaxial cable 67 is fixed to the first fixing portion 120*a* by soldering, for example. The first fixing portion 120*a* is formed by being bent in the shape of U so as to wrap the first shield member 67*c*. A second shield member 68*c* of the second coaxial cable 68 is fixed to the second fixing portion 120*b* by soldering, for example. The second fixing portion 120*b* is formed by being bent in the shape of U so as to wrap the second shield member 68*c*. A second core wire 68*a* of the second coaxial cable 68 is fixed to the ground portion 120*c* by soldering, for example. The ground portion 120*c* is formed to protrude in the +Z direction so as to be connected to the second core wire 68*a*. The ground portion 120*c* functions as a second fixing portion that fixes the second core wire 68*a*, which functions as a second grounding conductor.

The first flexible portion 120*d* is disposed between the adjacent first fixing portions 120*a* and has flexibility (elasticity). The second flexible portion 120*e* is disposed between the first fixing portion 120*a* and the second fixing portion 120*b* and has flexibility (elasticity). The first flexible portion 120*d* and the second flexible portion 120*e* are formed by being bent in the shape of U and then further bent in the shape of J. The first press-fit portion 120*f* is press-fitted into the first square hole portion 119*a* of the first holding member 119. The second press-fit portion 120*g* is press-fitted into the second square hole portion 121*a* of the second holding member 121.

Since the adjacent first fixing portions 120*a* are coupled by the first flexible portion 120*d*, the adjacent first shield members 67*c* are electrically connected. Since the first fixing portion 120*a* is coupled to the second fixing portion 120*b* and the ground portion 120*c* by the second flexible portion 120*e*, the first shield member 67*c*, the second core wire 68*a*, and the second shield member 68*c* are electrically connected. Since the first flexible portion 120*d* and the second flexible portion 120*e* have flexibility, it is possible that respective members move individually and the other members follow the movement while being electrically connected.

In the first connector 118 according to the seventh embodiment, the first contact 91 and the first elastic member 75 (the second contact 122 and the second elastic member 77) are formed separately, not integrally. Therefore, the design freedom of the connector can be enhanced. In other words, in a terminal in which the contact and the elastic member are integrated, the size and shape of the terminal, and hence the size and shape of the connector are heavily restricted, thus lowering the design freedom. According to the seventh embodiment, however, since the contact and the elastic member are formed separately, the structure can be simplified compared to that of a terminal in which the contact and the elastic member are integrated, the design freedom concerning the size and shape of the contact increases, and thus the design freedom concerning the size and shape of the connector increases. An increase in the design freedom in turn makes it possible to make the connector compact.

Furthermore, since the design freedom concerning the size and shape of the contact increases, the structure of the contact and a transmission path of the connector can be simplified, and impedance matching for high-speed transmission can be easily performed. That is, it is possible to simplify the cross section of the connector that affects the impedance (the plane perpendicular to the transmission path of the connector) and to reduce the kinds of the cross sections of the connector. Therefore, the impedance can be easily adjusted using a coaxial cable matching the target impedance.

In the first connector 118 according to the seventh embodiment, the protection member 90 protects the first contact portion 91*a* and the second contact portion 122*a*. Therefore, it is possible to provide a connector that is inexpensive and difficult to break down. For example, since the first contact portion 91*a* and the second contact portion 122*a* are protected by the protection member 90, even when a finger, a pen tip or the like touches the first connector 118 by mistake, deformation of the first contact portion 91*a* and the second contact portion 122*a* due to contact with a finger, a pen tip or the like can be prevented. In addition, the first contact portion 91*a* and the second contact portion 122*a* can be brought into contact with the first connection terminal 80 and the second connection terminal 81 respectively with a sufficient pressing force in the final coupled state.

In the first connector 118 according to the seventh embodiment, the eight first shield members 67*c*, the five second core wires 68*a*, and the five second shield members 68*c* are all electrically connected via the connection member 120. Therefore, it is possible to further reinforce the ground, and to improve the high-speed transmission characteristics. Since the second contacts 122 are disposed with the first contacts 91 adjacent to each other interposed therebetween, the ground can be reinforced and the high-speed transmission characteristics can be improved.

Next, a connector according to an eighth embodiment will be described with reference to the drawings. The connector according to the eighth embodiment includes a first connector mounted on, for example, a peripheral device such as a keyboard, and a second connector mounted on an external device such as a portable information terminal. The connector according to the eighth embodiment is a press-type connector that is electrically connected to the first connector by pressing a connection terminal of the second connector in a predetermined direction. In the first connector and the second connector according to the eighth embodiment, the same components as those of the first connector 89 shown in FIG. 42 and the second connector 79 shown in FIG. 23 are denoted by the same reference numerals, and illustration and description thereof will be omitted. In the following description, an XYZ orthogonal coordinate system similar to those in FIGS. 42 and 23 is set, and the positional relationship and the like of each part will be described with reference to this orthogonal coordinate system.

Figure 54:
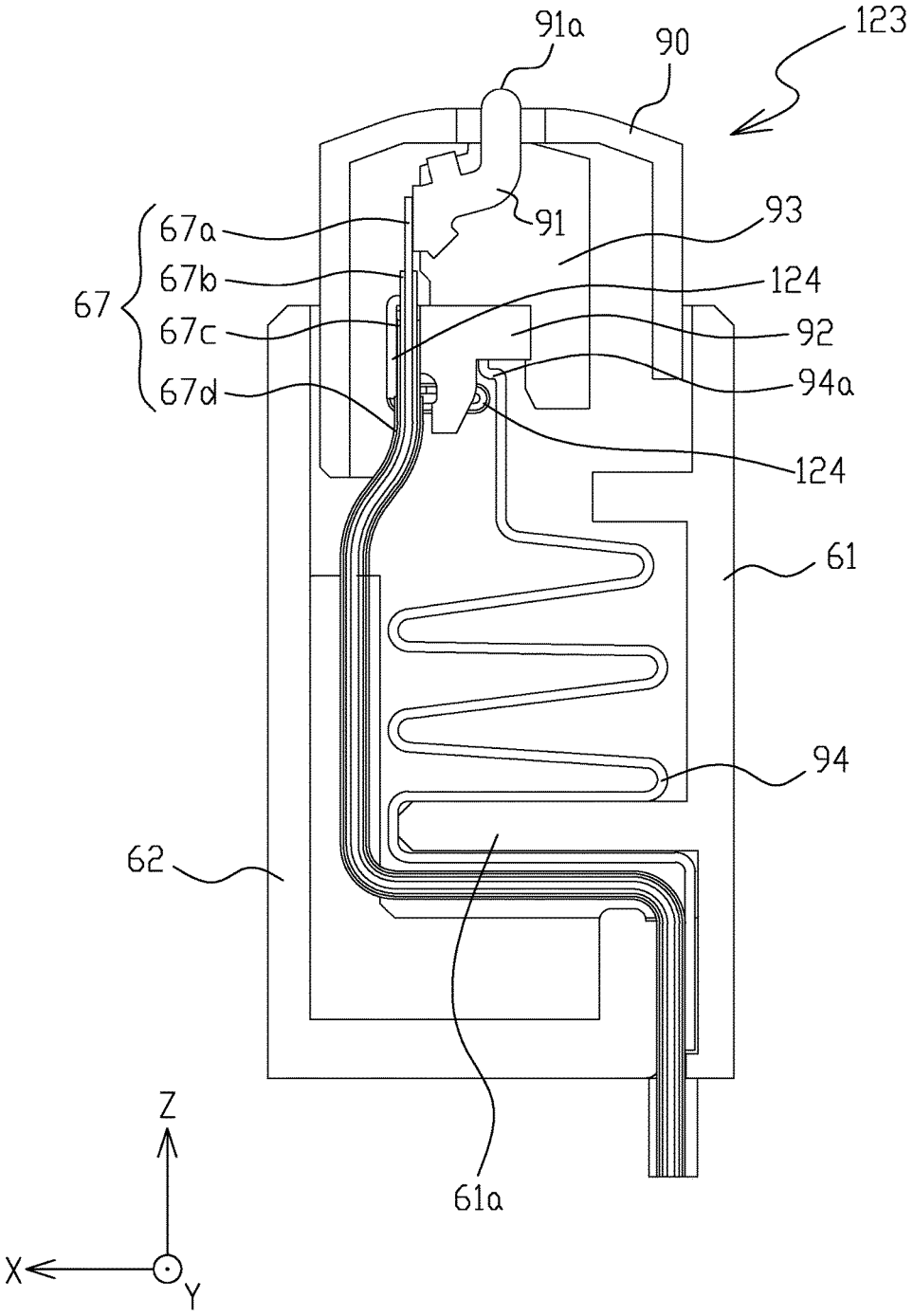
FIG. 54 is a cross-sectional view showing a configuration of a first connector according to an eighth embodiment.

A first connector 123 (see FIGS. 54 and 55) according to the eighth embodiment includes a base body 61, a cover 62, a protection member 90, a plurality of first contacts 91, a plurality of second contacts 95, a plurality of first coaxial cable 67, and a plurality of second coaxial cables 68. An external appearance of the first connector 123 is the same as that of the first connector 89 shown in FIGS. 42 and 43. Therefore, for the first connector 123 according to the eighth embodiment, reference is made to the front view of FIG. 43 used for describing the first connector 89 according to the fourth embodiment. FIG. 54 is a cross-sectional view taken along line B-B in FIG. 43, and FIG. 55 is a cross-sectional view taken along line C-C in FIG. 43.

Figure 55:
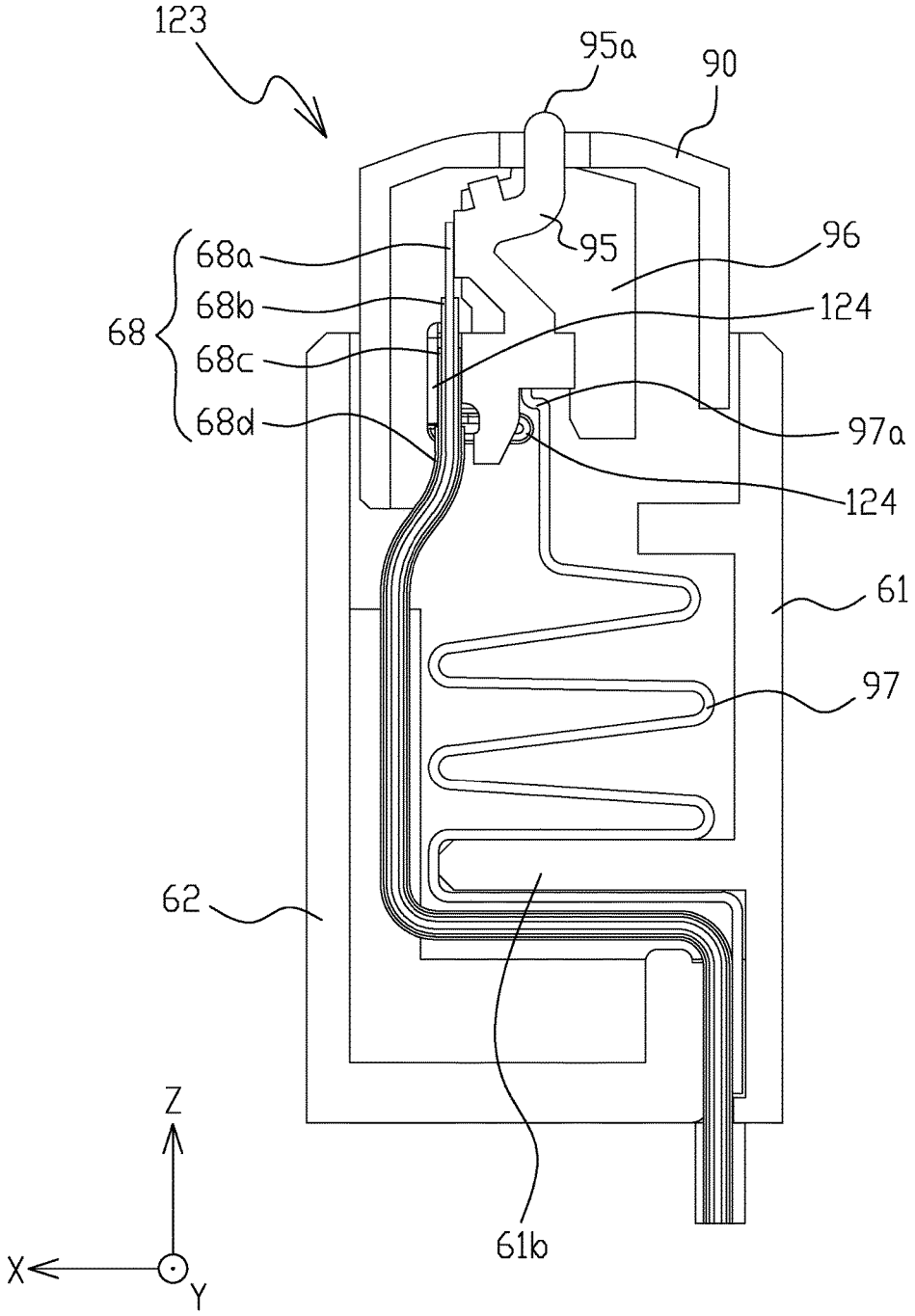
FIG. 55 is a cross-sectional view showing the configuration of the first connector according to the eighth embodiment.
Figure 56:
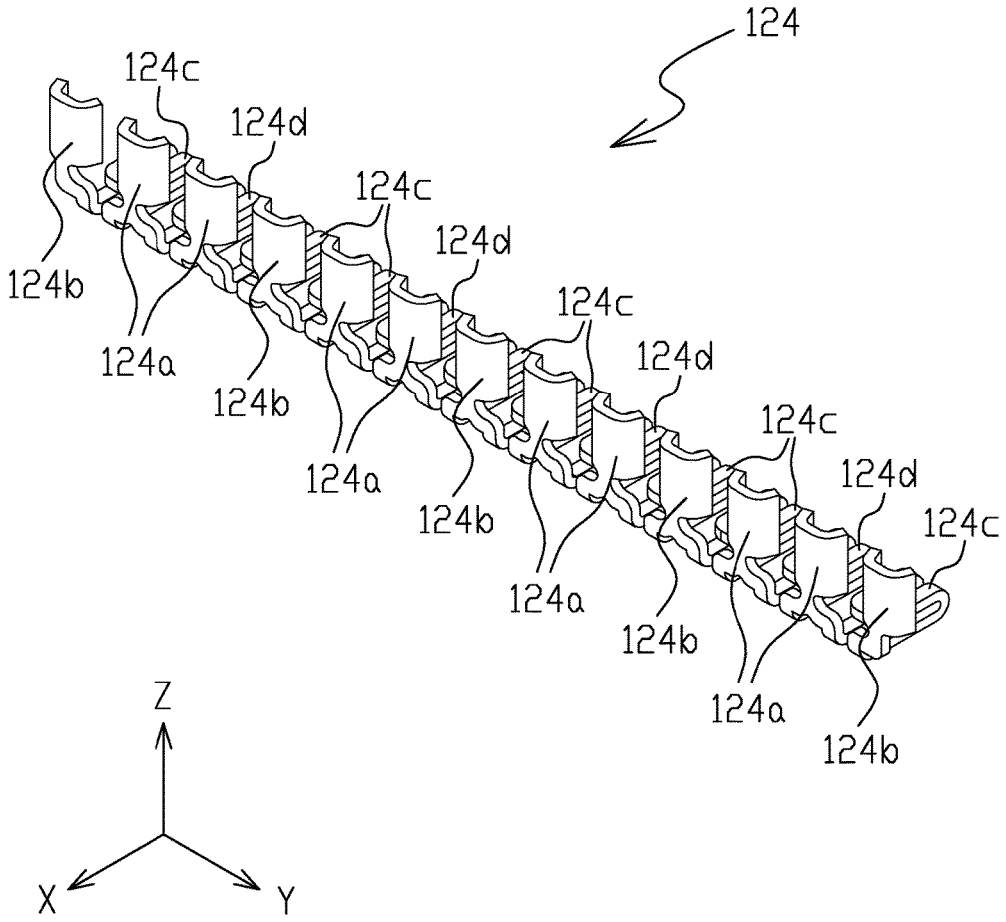
FIG. 56 is a view showing a configuration of a grounding connection member according to the eighth embodiment.

As shown in FIGS. 54 and 55, a grounding connection member 124 including a conductor is provided, in place of the grounding connection member 98 shown in FIGS. 45 and 46, in an internal space formed by the base body 61, the cover 62, and the protection member 90. FIG. 56 is a view showing a configuration of the grounding connection member 124. As shown in FIG. 56, the grounding connection member 124 is formed of one flat plate, and includes eight first fixing portions 124*a*, five second fixing portions 124*b*, four first flexible portions 124*c*, and eight second flexible portions 124*d*.

A first shield member 67*c* of the first coaxial cable 67 is fixed to the first fixing portion 124*a* by soldering, for example. The first fixing portion 124*a* is formed by being bent in the shape of U so as to wrap the first shield member 67*c*. A second shield member 68*c* of the second coaxial cable 68 is fixed to the second fixing portion 124*b* by soldering, for example. The second fixing portion 124*b* is formed by being bent in the shape of U so as to wrap the second shield member 68*c*. The first flexible portion 124*c* is disposed between the adjacent first fixing portions 124*a* and has flexibility (elasticity). The second flexible portion 124*d* is disposed between the first fixing portion 124*a* and the second fixing portion 124*b* and has flexibility (elasticity). The first flexible portion 124*c* and the second flexible portion 124*d* are formed by being bent in the shape of U and then further bent in the shape of U.

Since the adjacent first fixing portions 124*a* are coupled by the first flexible portion 124*c*, the adjacent first shield members 67*c* are electrically connected. Since the first fixing portion 124*a* and the second fixing portion 124*b* are coupled by the second flexible portion 124*d*, the first shield member 67*c* and the second shield member 68*c* are electrically connected. Since the first flexible portion 124*c* and the second flexible portion 124*d* have flexibility, it is possible that respective members move individually and the other members follow the movement while being electrically connected.

In the first connector 123 according to the eighth embodiment, the first contact 91 and the first elastic member 94 (the second contact 95 and the second elastic member 97) are formed separately, not integrally. Therefore, the design freedom of the connector can be enhanced. In other words, in a terminal in which the contact and the elastic member are integrated, the size and shape of the terminal, and hence the size and shape of the connector are heavily restricted, thus lowering the design freedom. According to the eighth embodiment, however, since the contact and the elastic member are formed separately, the structure can be simplified compared to that of a terminal in which the contact and the elastic member are integrated, the design freedom concerning the size and shape of the contact increases, and thus the design freedom concerning the size and shape of the connector increases. An increase in the design freedom in turn makes it possible to make the connector compact.

Furthermore, since the design freedom concerning the size and shape of the contact increases, the structure of the contact and a transmission path of the connector can be simplified, and impedance matching for high-speed transmission can be easily performed. That is, it is possible to simplify the cross section of the connector that affects the impedance (the plane perpendicular to the transmission path of the connector) and to reduce the kinds of the cross sections of the connector. Therefore, the impedance can be easily adjusted using a coaxial cable matching the target impedance.

In the first connector 123 according to the eighth embodiment, the protection member 90 protects the first contact portion 91*a* and the second contact portion 95*a*. Therefore, it is possible to provide a connector that is inexpensive and difficult to break down. For example, since the first contact portion 91*a* and the second contact portion 95*a* are protected by the protection member 90, even when a finger, a pen tip or the like touches the first connector 123 by mistake, deformation of the first contact portion 91*a* and the second contact portion 95*a* due to contact with a finger, a pen tip or the like can be prevented. In addition, the first contact portion 91*a* and the second contact portion 95*a* can be brought into contact with the first connection terminal 80 and the second connection terminal 81 respectively with a sufficient pressing force in the final coupled state.

In the first connector 123 according to the eighth embodiment, the first shield member 67*c* of the first coaxial cable 67 and the first elastic member 94 are electrically connected via the ground terminal 92 and the grounding connection member 124. The second core wire 68*a* of the second coaxial cable 68, the second shield member 68*c* of the second coaxial cable 68, and the second elastic member 97 are electrically connected via the second contact 95 and the grounding connection member 124. The eight ground terminals 92 and the five second contacts 95 are all electrically connected via the grounding connection member 124. The eight first elastic members 94 and the five second elastic members 97 are also all electrically connected. Therefore, it is possible to further reinforce the ground, and to improve the high-speed transmission characteristics. Since the second contacts 95 are disposed with the first contacts 91 adjacent to each other interposed therebetween, the ground can be reinforced and the high-speed transmission characteristics can be improved.

Next, a connector according to a ninth embodiment will be described with reference to the drawings. The connector according to the ninth embodiment includes a first connector mounted on, for example, a peripheral device such as a keyboard, and a second connector mounted on an external device such as a portable information terminal. The connector according to the ninth embodiment is a press-type connector that is electrically connected to the first connector by pressing a connection terminal of the second connector in a predetermined direction. In the first connector and the second connector according to the ninth embodiment, the same components as those of the first connector 89 shown in FIG. 42 and the second connector 79 shown in FIG. 23 are denoted by the same reference numerals, and illustration and description thereof will be omitted. In the following description, an XYZ orthogonal coordinate system similar to those in FIGS. 42 and 23 is set, and the positional relationship and the like of each part will be described with reference to this orthogonal coordinate system.

Figure 57:
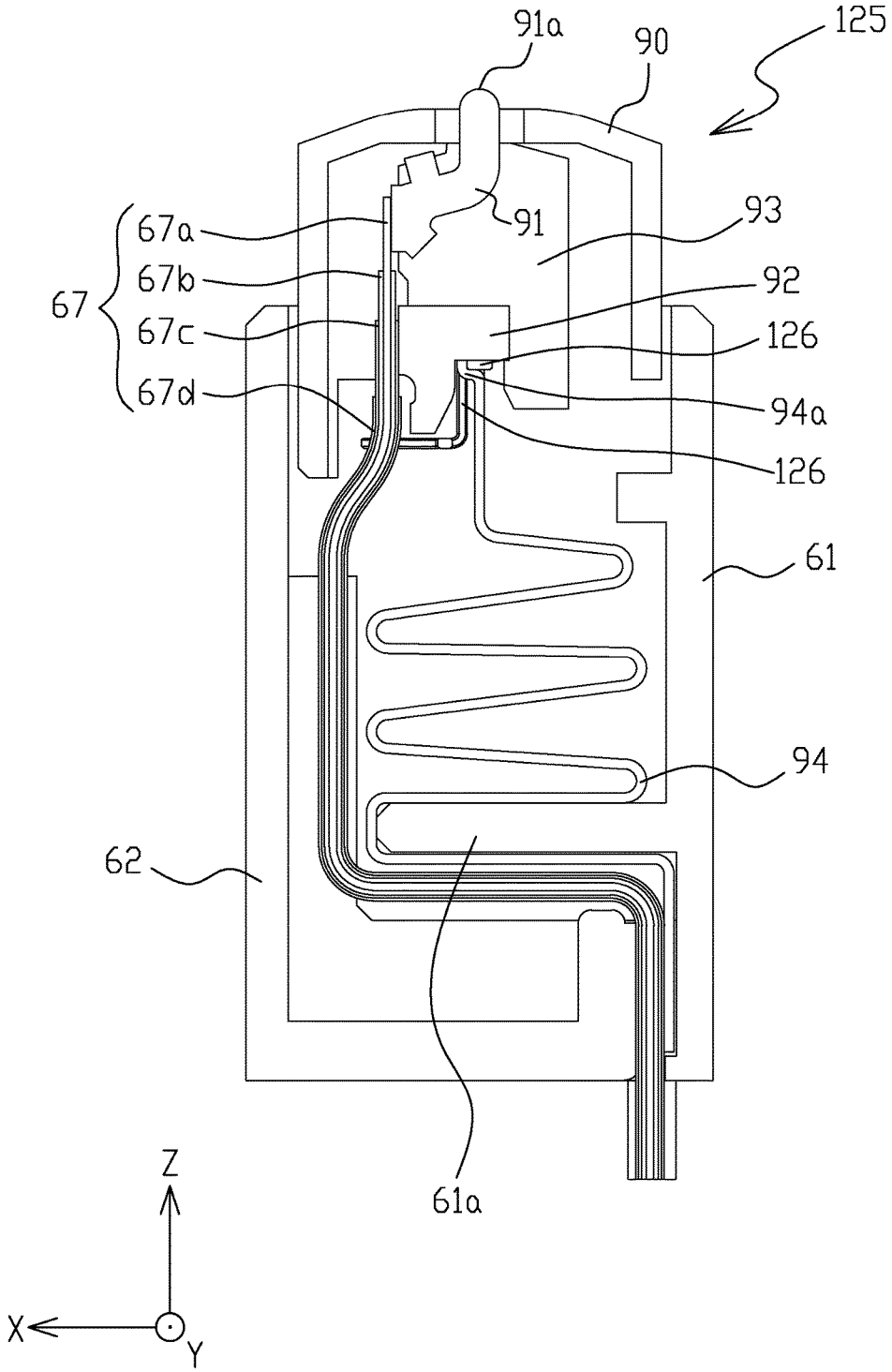
FIG. 57 is a cross-sectional view showing a configuration of a first connector according to a ninth embodiment.

A first connector 125 (see FIGS. 57 and 58) according to the ninth embodiment includes a base body 61, a cover 62, a protection member 90, a plurality of first contacts 91, a plurality of second contacts 95, a plurality of first coaxial cable 67, and a plurality of second coaxial cables 68. An external appearance of the first connector 125 is the same as that of the first connector 89 shown in FIGS. 42 and 43. Therefore, for the first connector 125 according to the ninth embodiment, reference is made to the front view of FIG. 43 used for describing the first connector 89 according to the fourth embodiment. FIG. 57 is a cross-sectional view taken along line B-B in FIG. 43, and FIG. 58 is a cross-sectional view taken along line C-C in FIG. 43.

Figure 58:
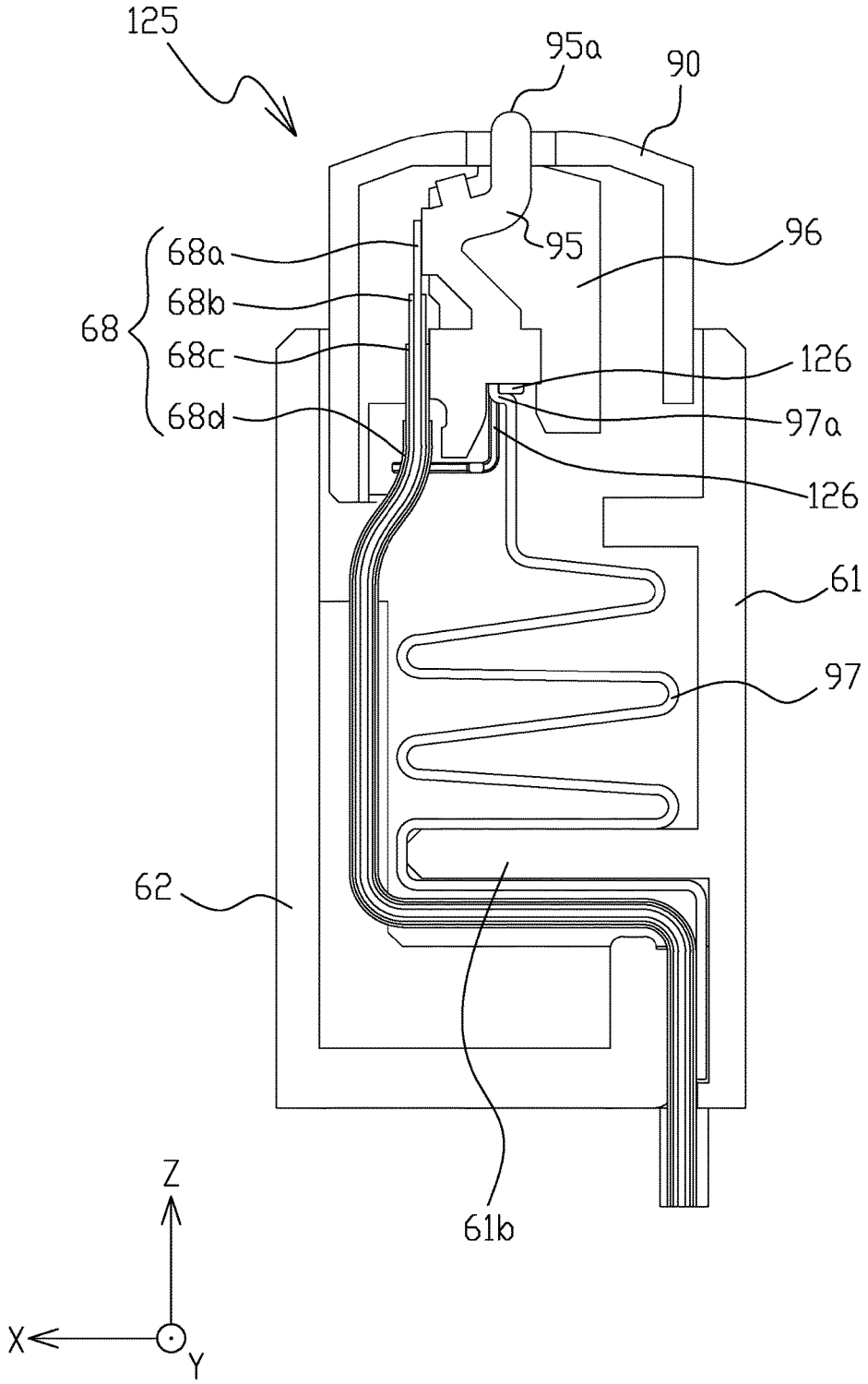
FIG. 58 is a cross-sectional view showing the configuration of the first connector according to the ninth embodiment.
Figure 59:
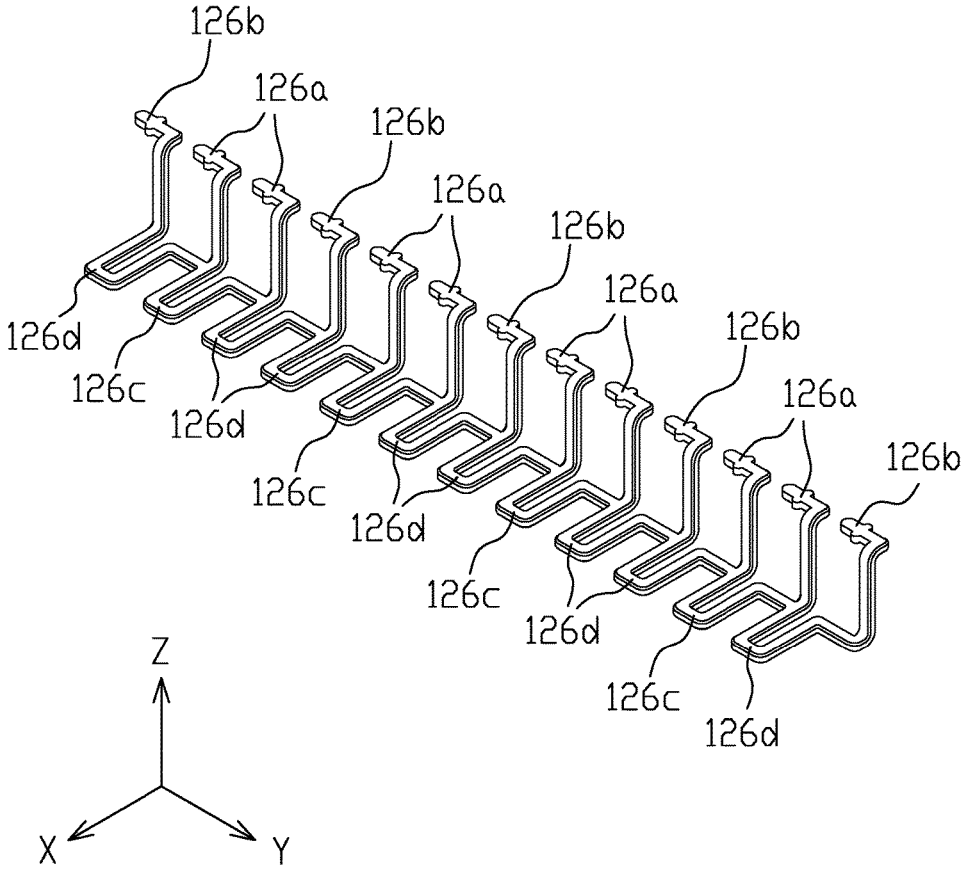
FIG. 59 is a view showing a configuration of a grounding connection member according to the ninth embodiment.

As shown in FIGS. 57 and 58, a grounding connection member 126 including a conductor is provided, in place of the grounding connection member 98 shown in FIGS. 45 and 46, in an internal space formed by the base body 61, the cover 62, and the protection member 90. FIG. 59 is a view showing a configuration of the grounding connection member 126. As shown in FIG. 59, the grounding connection member 126 is formed of one flat plate, and includes eight first connection portions 126*a*, five second connection portions 126*b*, four first flexible portions 126*c*, and eight second flexible portions 126*d*.

As shown in FIG. 57, the first connection portion 126*a* is disposed between a ground terminal 92 and a first elastic member 94. The first connection portion 126*a* is held by a holding portion 94*a* of the first elastic member 94 on the +X direction side, and by a holding portion 94*b* of the first elastic member 94 on the −X direction side. The first connection portion 126*a* is supported by a support portion 94*c* on the −Z direction side. The first connection portion 126*a* is pressed against the ground terminal 92 by the elastic force of the first elastic member 94. As shown in FIG. 58, the second connection portion 126*b* is disposed between the second contact 95 and a second elastic member 97. The second connection portion 126*b* is held by a holding portion 97*a* of the second elastic member 97 on the +X direction side and by a holding portion 97*b* of the second elastic member 97 on the −X direction side. The second connection portion 126*b* is supported by a support portion 97*c* on the −Z direction side. The second connection portion 126*b* is pressed against the second contact 95 by the elastic force of the second elastic member 97.

The first flexible portion 126*c* is disposed between the adjacent first connection portions 126*a* and has flexibility (elasticity). The second flexible portion 126*d* is disposed between the first connection portion 126*a* and the second connection portion 126*b* and has flexibility (elasticity). The first flexible portion 126*c* and the second flexible portion 126*d* are formed by being bent in the shapes of L and U.

Since the adjacent first connection portions 126*a* are coupled by the first flexible portion 126*c*, the adjacent first shield members 67*c* are electrically connected. Since the first connection portion 126*a* and the second connection portion 126*b* are coupled by the second flexible portion 126*d*, the first shield member 67*c* and the second shield member 68*c* are electrically connected. Since the first flexible portion 126*c* and the second flexible portion 126*d* have flexibility, it is possible that respective members move individually and the other members follow the movement while being electrically connected.

In the first connector 125 according to the ninth embodiment, the first contact 91 and the first elastic member 94 (the second contact 95 and the second elastic member 97) are formed separately, not integrally. Therefore, the design freedom of the connector can be enhanced. In other words, in a terminal in which the contact and the elastic member are integrated, the size and shape of the terminal, and hence the size and shape of the connector are heavily restricted, thus lowering the design freedom. According to the ninth embodiment, however, since the contact and the elastic member are formed separately, the structure can be simplified compared to that of a terminal in which the contact and the elastic member are integrated, the design freedom concerning the size and shape of the contact increases, and thus the design freedom concerning the size and shape of the connector increases. An increase in the design freedom in turn makes it possible to make the connector compact.

Furthermore, since the design freedom concerning the size and shape of the contact increases, the structure of the contact and a transmission path of the connector can be simplified, and impedance matching for high-speed transmission can be easily performed. That is, it is possible to simplify the cross section of the connector that affects the impedance (the plane perpendicular to the transmission path of the connector) and to reduce the kinds of the cross sections of the connector. Therefore, the impedance can be easily adjusted using a coaxial cable matching the target impedance.

In the first connector 125 according to the ninth embodiment, the protection member 90 protects the first contact portion 91*a* and the second contact portion 95*a*. Therefore, it is possible to provide a connector that is inexpensive and difficult to break down. For example, since the first contact portion 91*a* and the second contact portion 95*a* are protected by the protection member 90, even when a finger, a pen tip or the like touches the first connector 125 by mistake, deformation of the first contact portion 91*a* and the second contact portion 95*a* due to contact with a finger, a pen tip or the like can be prevented. In addition, the first contact portion 91*a* and the second contact portion 95*a* can be brought into contact with the first connection terminal 80 and the second connection terminal 81 respectively with a sufficient pressing force in the final coupled state.

In the first connector 125 according to the ninth embodiment, the first shield member 67*c* of the first coaxial cable 67 and the first elastic member 94 are electrically connected via the ground terminal 92 and the grounding connection member 126. The second core wire 68*a* of the second coaxial cable 68, the second shield member 68*c* of the second coaxial cable 68, and the second elastic member 97 are electrically connected via the second contact 95 and the grounding connection member 126. The eight ground terminals 92 and the five second contacts 95 are all electrically connected via the grounding connection member 126. The eight first elastic members 94 and the five second elastic members 97 are also all electrically connected. Therefore, it is possible to further reinforce the ground, and to improve the high-speed transmission characteristics. Since the second contacts 95 are disposed with the first contacts 91 adjacent to each other interposed therebetween, the ground can be reinforced and the high-speed transmission characteristics can be improved.

In the second to ninth embodiments described above, the plurality of first contacts is provided, but at least one first contact would suffice. In addition, although the plurality of second contacts is provided, at least one second contact would suffice.

In the second to sixth, eighth, and ninth embodiments described above, the ground terminals are electrically connected to one another via the grounding connection member or the jumper plate. However, it is sufficient as long as at least two ground terminals are electrically connected to each other via the grounding connection member or the jumper plate. It is also sufficient as long as at least two second contacts are electrically connected to each other via the grounding connection member or the jumper plate. It is also sufficient as long as at least one ground terminal and at least one second contact are electrically connected via the grounding connection member or the jumper plate.

Figure 60:
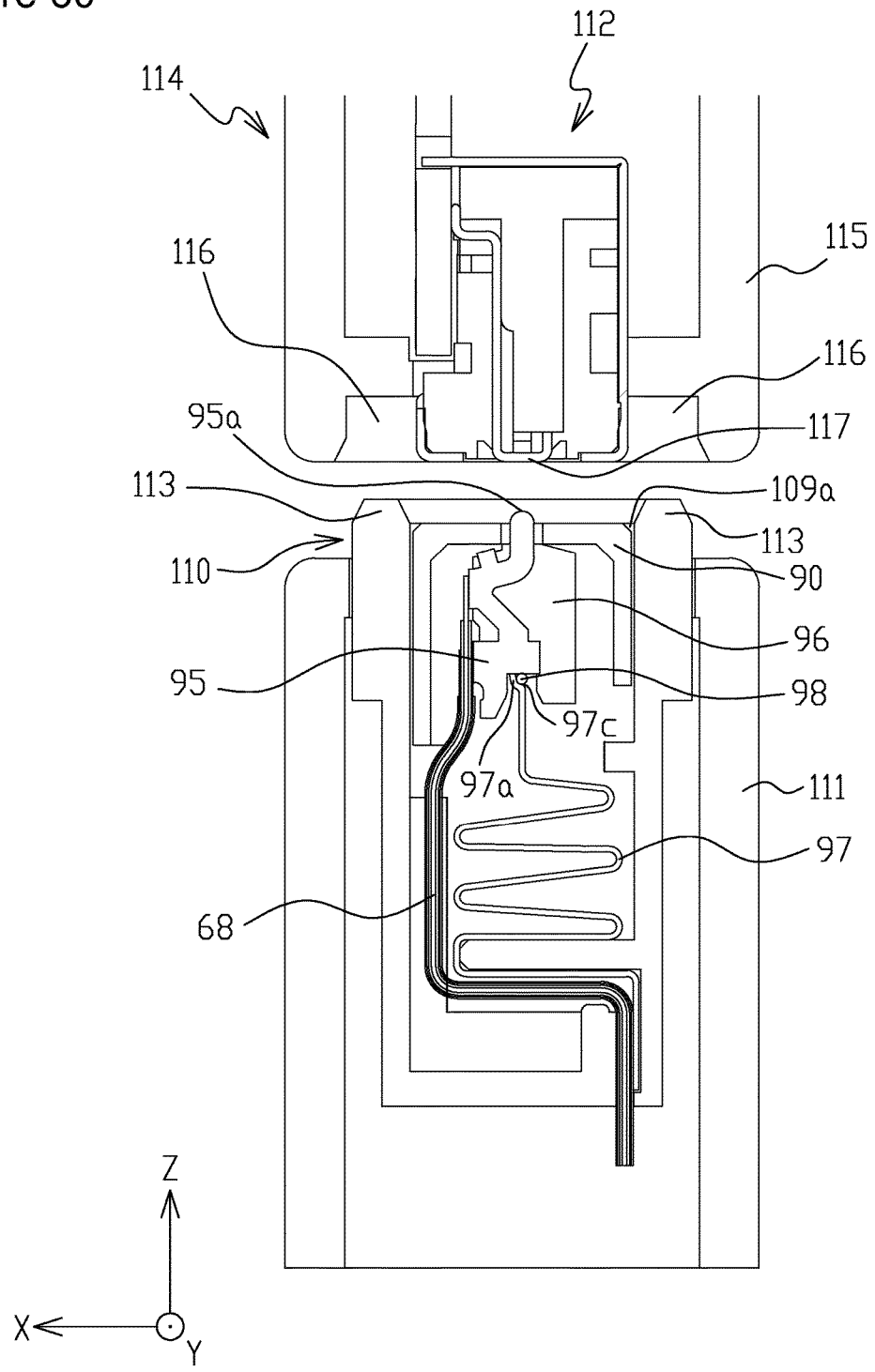
FIG. 60 is a cross-sectional view showing another configuration of the connector according to an embodiment.

In addition, a base body 109 as shown in FIG. 60 may be provided instead of the base body included in the first connector according to each of the above-described embodiments, that is, instead of the base body having a flat surface in which the first opening is formed. As shown in FIG. 60, a first connector 110 is mounted on a housing 111. The base body 109 of the first connector 110 includes an outer edge portion 113. The outer edge portion 113 is disposed around a first opening 109*a*, that is, around a surface in which the first opening 109*a* is formed. The outer edge portion 113 protrudes toward a second connector 112 farther than the surface of the housing 111 on the +Z direction side, the pressing surface of the protection member 90 (surface on the +Z direction side), the first contact portion 91*a* (see FIG. 45), and the second contact portion 95*a*. When the first connector 110 and the second connector 112 are connected, the outer edge portion 113 is inserted into an insertion portion 116 formed in a housing 115 of an external device 114. At this time, the outer edge portion 113 is inserted into the insertion portion 116 before the first contact portion 91*a* and the second contact portion 95*a* of the first connector 110 are connected to the first connection terminal (not shown) and a second connection terminal 117 of the second connector 112 respectively, and before the protection member 90 is pressed against the second connector 112.

In each of the above-described embodiments, the coaxial cable has been described as an example of the wiring member. However, a wiring member other than the coaxial cable, for example, a flexible flat cable (FFC) or a flexible printed circuit (FPC) may be used. In this case, a slit is provided, along the longitudinal direction of the FFC (or FPC), between conductors of the FFC (or FPC) on the side connected to the first contact and the second contact. It is preferable to adopt the following configuration: a first pressing portion that presses the FPC (or FPC) against the first contact or the first holding member is provided on the first contact, and the first pressing portion presses the conductor of the FFC (or the FPC) against the first contact or the first holding member, whereby the first contact and the conductor of the FFC (or the FPC) are electrically connected. It is also preferable to adopt the following configuration: a second pressing portion that presses the FFC (or FPC) against the second contact or the second holding member is provided on the second contact, and the second pressing portion presses the conductor of the FFC (or the FPC) against the second contact or the second holding member, whereby the second contact and the grounding conductor of the FFC (or the FPC) are electrically connected. The grounding conductor of the FPC or FPC includes two or three layers.

In each of the above-described embodiments, two contacts (first contacts) are disposed adjacent to each other, but three or more contacts (first contacts) may be disposed adjacent to one another.

In each of the above-described embodiments, the base body and the protection member are provided, the base body including the first opening through which the protection member protrudes in the +Z direction, the protection member including the second opening through which the contact portion (first contact portion) and the like protrude in the +Z direction. However, it is also possible to adopt a configuration only including a base body, which includes a second opening through which the contact portion (first contact portion) and the like protrude in the +Z direction. In this case, the first contact portion and the second contact portion can protrude from the base body toward the second connector (+Z direction side) farther than the pressing surface against which the second connector (the first connection terminal and the second connection terminal) is pressed. Before the second connector comes in contact with the first contact portion or the second contact portion, the first contact portion and the second contact portion are located at positions protruding in the +Z direction. In the final coupled state with the second connector, the first contact portion and the second contact portion are located on substantially the same plane as the pressing surface against which the second connector (the first connection terminal and the second connection terminal) is pressed.

In each of the above-described embodiments, the connector is attached to an electronic device such as a cradle, a personal computer, a mobile phone, a smartphone, or a tablet terminal.

The embodiments described above have been described for easy understanding of the present invention, not for limiting the present invention. Therefore, each element disclosed in the above embodiments includes all design changes and equivalents belonging to the technical scope of the present invention.

The invention claimed is:

1. A connector comprising:

a first connector; and a second connector mounted on an external device, wherein the first connector includes:

a contact including a contact portion that is electrically connected to a connection terminal of the second connector by pressing the connection terminal in a predetermined direction;

a flexible conductor connected to the contact;

a protection member that protects the contact portion by covering a periphery of the contact;

a base body that accommodates the contact, the flexible conductor, and the protection member; and an elastic member that is formed separately from the contact and presses the contact and the protection member in a direction opposite to the predetermined direction, the base body includes a first opening through which the protection member protrudes in the direction opposite to the predetermined direction, the protection member includes a second opening through which the contact portion protrudes toward the second connector farther than a pressing surface against which the connection terminal of the second connector is pressed, the protection member moving in the predetermined direction when the connection terminal of the second connector is pressed on the contact of the first connector, the protection member moving in the direction opposite to the predetermined direction when the contact of the first terminal is released from the connection terminal of the second connector such that the connection terminal of the second connector is pressed on the contact of the first connector, and before the second connector comes in contact with the contact portion or the protection member, the contact portion is located at a position protruding toward the second connector through the second opening, and in a final coupled state with the second connector, the contact portion is located substantially on the same plane as the pressing surface.

2. A connector comprising:

a first connector; and a second connector mounted on an external device, wherein the first connector includes:

a first contact including a first contact portion that is electrically connected to a first connection terminal of the second connector by pressing the first connection terminal in a predetermined direction;

a second contact including a second contact portion that is electrically connected to a second connection terminal of the second connector by pressing the second connection terminal in the predetermined direction;

one of a coaxial cable, a flexible flat cable, or a flexible printed circuit, the coaxial cable including both a conductor electrically connected to the first contact and a grounding conductor connected to the ground, the flexible flat cable including both the grounding conductor comprising more than two layers and the conductor, the flexible printed circuit including both the grounding conductor comprising more than two layers and the conductor;

a base body that accommodates the first contact, the second contact, and the one of the coaxial cable, the flexible flat cable, or the flexible printed circuit;

a first elastic member that is formed separately from the first contact and presses the first contact in a direction opposite to the predetermined direction; and a second elastic member that is formed separately from the second contact and presses the second contact in the direction opposite to the predetermined direction, the second contact and the grounding conductor are electrically connected, the first contact portion and the second contact portion are protrudable from the base body toward the second connector farther than a pressing surface against which the first connection terminal and the second connection terminal are pressed, and before the second connector comes in contact with the first contact portion or the second contact portion, the first contact portion and the second contact portion are located at positions protruding toward the second connector farther than the pressing surface, and in a final coupled state with the second connector, the first contact portion and the second contact portion are located substantially on the same plane as the pressing surface.

3. The connector according to claim 2, further comprising:

a protection member that protects the first contact portion and the second contact portion by covering peripheries of the first contact and the second contact, wherein the base body includes a first opening through which the protection member protrudes in the direction opposite to the predetermined direction, the first elastic member and the second elastic member press the protection member in the direction opposite to the predetermined direction, the protection member includes a second opening through which the first contact portion protrudes toward the second connector farther than the pressing surface against which the first connection terminal and the second connection terminal of the second connector are pressed, and a third opening through which the second contact portion protrudes toward the second connector farther than the pressing surface, the protection member being movable in the predetermined direction and in the direction opposite to the predetermined direction along with movement of the second connector, and before the second connector comes in contact with the first contact portion, the second contact portion, or the protection member, the first contact portion and the second contact portion are located at positions protruding toward the second connector through the second and third openings respectively, and in a final coupled state with the second connector, the first contact portion and the second contact portion are located substantially on the same plane as the pressing surface.

4. The connector according to claim 2, wherein at least one of impedance between the conductor and the grounding conductor and impedance between the first contact and the second contact is matched.

5. The connector according to claim 2, wherein the grounding conductor includes a first grounding conductor covering the conductor via an insulator and a second grounding conductor electrically connected to the second contact, and the first grounding conductor and the second grounding conductor are electrically connected using a connection member.

6. The connector according to claim 5, wherein the connection member includes a grounding connection member and a ground terminal disposed in the vicinity of the first contact, the second contact and the ground terminal include elastic bodies, or the grounding connection member includes an elastic body, the ground terminal is electrically connected to the first grounding conductor, and the ground terminal and the second contact are electrically connected by being pressed against the grounding connection member.

7. The connector according to claim 5, wherein the connection member includes:

a first fixing portion that fixes the first grounding conductor;

a second fixing portion that fixes the second grounding conductor; and a flexible portion disposed between the first fixing portion and the second fixing portion and having flexibility.

8. The connector according to claim 5, wherein the connection member includes a grounding connection member and a ground terminal disposed in the vicinity of the first contact, the ground terminal is electrically connected to the first grounding conductor, the grounding connection member is disposed between the ground terminal and the first elastic member and between the second contact and the second elastic member, and the grounding connection member is pressed against the ground terminal by an elastic force of the first elastic member and the grounding connection member is pressed against the second contact by an elastic force of the second elastic member, and consequently the ground terminal and the second contact are electrically connected.

9. The connector according to claim 2, wherein the first contact includes a first pressing portion that presses the flexible flat cable or the flexible printed circuit against the first contact or a first member that holds the first contact, and the first contact and the conductor of the flexible flat cable or the conductor of the flexible printed circuit are electrically connected when the first pressing portion presses the conductor against the first contact or the first member.

10. The connector according to claim 2, wherein the second contact includes a second pressing portion that presses the flexible flat cable or the flexible printed circuit against the second contact or a second member that holds the second contact, and the second contact and the grounding conductor of the flexible flat cable or the grounding conductor of the flexible printed circuit are electrically connected when the second pressing portion presses the grounding conductor against the second contact or the second member.

11. The connector according to claim 3, wherein the base body is disposed around the pressing surface of the protection member, and includes an outer edge portion that protrudes toward the second connector farther than the pressing surface of the protection member, the first contact portion, and the second contact portion.

12. The connector according to claim 11, wherein, when the first connector and the second connector are connected, the outer edge portion is inserted into an insertion portion formed in a casing of the external device before the first contact portion and the second contact portion of the first connector are connected to the first connection terminal and the second connection terminal of the second connector respectively.

13. The connector according to claim 2, further comprising a metal plate disposed in the vicinity of the first contact and the second contact, wherein the metal plate is electrically connected to the grounding conductor.

14. The connector according to claim 13, further comprising at least two contact groups, in each of which the two first contacts disposed adjacent to each other, and the two second contacts disposed with the two first contacts interposed therebetween, are arranged in a row, wherein one of the contact groups and the other contact group are arranged in a direction intersecting an arrangement direction in which the two first contacts and the two second contacts are arranged in a row, and the metal plate is disposed between one of the contact groups and the other contact group, one surface of the metal plate facing one of the contact groups, the other surface of the metal plate facing the other contact group.

15. The connector according to claim 13, wherein the metal plate is fixed to the base body, the protection member includes a through hole in which the metal plate is disposed and through which the metal plate protrudes in the direction opposite to the predetermined direction, and in the final coupled state with the second connector, the metal plate protrudes in the direction opposite to the predetermined direction through the through hole and is connected to a grounding terminal of the second connector.

16. A connector comprising:

a first connector; and a second connector mounted on an external device, wherein the second connector includes:

a first connection terminal that is electrically connected to a first contact portion of a first contact of the first connector by being pressed against the first contact portion;

a second connection terminal that is electrically connected to a second contact portion of a second contact of the first connector by being pressed against the second contact portion; and a ground plate electrically connected to the second connection terminal, wherein the ground plate has a plane surface overlapping both the first connection terminal and the second connection terminal.

17. The connector according to claim 16, wherein at least one of impedance between the first connection terminal and the ground plate and impedance between the first connection terminal and the second connection terminal is matched.

18. The connector according to claim 16, comprising:

the at least one ground plate; and at least two each of the first connection terminals and the second connection terminals, wherein the two first connection terminals are disposed adjacent to each other, the two second connection terminals are disposed with the two first connection terminals interposed therebetween, the ground plate is disposed in a plane along an arrangement direction in which the two first connection terminals and the two second connection terminals are arranged in a row, and in a case where the two ground plates are provided, the first connection terminal and the second connection terminal are disposed between one of the ground plates and the other ground plate.

19. The connector according to claim 16, wherein the second connection terminal is wider than the first connection terminal in a plane intersecting a direction in which the first connection terminal and the second connection terminal are arrange in a line.

* * * * *